US010297359B2

(12) United States Patent
Yun et al.

(10) Patent No.: US 10,297,359 B2
(45) Date of Patent: May 21, 2019

(54) X-RAY ILLUMINATION SYSTEM WITH MULTIPLE TARGET MICROSTRUCTURES

(71) Applicant: Sigray, Inc., Concord, CA (US)

(72) Inventors: Wenbing Yun, Walnut Creek, CA (US); Sylvia Jia Yun Lewis, San Francisco, CA (US); Janos Kirz, Berkeley, CA (US); David Charles Reynolds, Martinez, CA (US); Alan Francis Lyon, Berkeley, CA (US)

(73) Assignee: Sigray, Inc., Concord, CA (US)

( * ) Notice: Subject to any disclaimer, the term of this patent is extended or adjusted under 35 U.S.C. 154(b) by 0 days.

(21) Appl. No.: 15/783,855

(22) Filed: Oct. 13, 2017

(65) Prior Publication Data

US 2018/0144901 A1 May 24, 2018
US 2019/0088438 A9 Mar. 21, 2019

Related U.S. Application Data

(63) Continuation-in-part of application No. 15/166,274, filed on May 27, 2016, which is a continuation-in-part
(Continued)

(51) Int. Cl.
*G21K 1/06* (2006.01)
*H01J 35/10* (2006.01)
(Continued)

(52) U.S. Cl.
CPC ..... *G21K 1/067* (2013.01); *H01J 35/108* (2013.01); *H01J 35/14* (2013.01); *H01J 35/26* (2013.01);
(Continued)

(58) Field of Classification Search
CPC ..... G21K 1/06; G21K 2201/06; G21K 1/067; G21K 2201/064; G01N 23/20008;
(Continued)

(56) References Cited

U.S. PATENT DOCUMENTS 1,203,495 A 10/1916 Coolidge
1,211,092 A 1/1917 Coolidge
(Continued)

FOREIGN PATENT DOCUMENTS

CN 102124537 A 7/2011
EP 0432568 6/1991
(Continued)

OTHER PUBLICATIONS

"Diamond," Section 10.4.2 of Zorman et al., "Material Aspects of Micro-Nanoelectromechanical Systems," Chapter 10 of Springer Handbook of Nanotechnology, 2nd ed., Barat Bushan, ed. (Springer Science + Business Media, Inc., New York, 2007), pp. 312-314.
(Continued)

*Primary Examiner* — Chih-Cheng Kao
(74) *Attorney, Agent, or Firm* — Knobbe, Martens, Olson & Bear, LLP

(57) ABSTRACT

An x-ray illumination beam system includes an electron emitter and a target having one or more target microstructures. The one or more microstructures may be the same or different material, and may be embedded or placed atop a substrate formed of a heat-conducting material. The x-ray source may emit x-rays towards an optic system, which can include one or more optics that are matched to one or more target microstructures. The matching can be achieved by selecting optics with the geometric shape, size, and surface coating that collects as many x-rays as possible from the source and at an angle that satisfies the critical reflection angle of the x-ray energies of interest from the target. The x-ray illumination beam system allows for an x-ray source that generates x-rays having different spectra and can be used in a variety of applications.

20 Claims, 41 Drawing Sheets

Related U.S. Application Data of application No. 14/999,147, filed on Apr. 1, 2016, now Pat. No. 9,543,109, which is a continuation-in-part of application No. 14/490,672, filed on Sep. 19, 2014, now Pat. No. 9,390,881.

(60) Provisional application No. 62/155,449, filed on Apr. 30, 2015, provisional application No. 62/141,847, filed on Apr. 1, 2015, provisional application No. 62/008,856, filed on Jun. 6, 2014, provisional application No. 61/931,519, filed on Jan. 24, 2014, provisional application No. 61/894,073, filed on Oct. 22, 2013, provisional application No. 61/880,151, filed on Sep. 19, 2013.

(51) Int. Cl.
*H01J 35/14* (2006.01)
*H01J 35/26* (2006.01)
*H01J 35/30* (2006.01)

(52) U.S. Cl.
CPC ..... *H01J 35/30* (2013.01); *G21K 2201/064* (2013.01); *H01J 35/105* (2013.01); *H01J 2235/086* (2013.01); *H01J 2235/088* (2013.01); *H01J 2235/1204* (2013.01)

(58) Field of Classification Search
CPC ..... G01N 23/22; G01N 2223/05; G01N 2223/056; G01N 2223/07; G01N 2223/076; G01N 2223/315; G01N 2223/32; G01N 2223/33; G01N 2223/3301; H01J 35/30; H01J 35/26; H01J 35/14; H01J 35/108; H01J 2235/088; H01J 35/105; H01J 2235/086; H01J 2235/1204
See application file for complete search history.

(56) References Cited

U.S. PATENT DOCUMENTS 1,215,116 A 2/1917 Coolidge
1,328,495 A 1/1920 Coolidge
1,355,126 A 10/1920 Coolidge
1,790,073 A 1/1931 Pohl
1,917,099 A 7/1933 Coolidge
1,946,312 A 2/1934 Coolidge
2,926,270 A 2/1960 Zunick
3,795,832 A 3/1974 Holland
4,227,112 A 10/1980 Waugh et al.
4,266,138 A 5/1981 Nelson et al.
4,426,718 A 1/1984 Hayashi
4,523,327 A 6/1985 Eversole
4,573,186 A 2/1986 Reinhold
4,807,268 A 2/1989 Wittrey
4,940,319 A 7/1990 Ueda et al.
4,951,304 A 8/1990 Piestrup et al.
4,972,449 A 11/1990 Upadhya et al.
5,001,737 A 3/1991 Lewis et al.
5,008,918 A 4/1991 Lee et al.
5,132,997 A 7/1992 Kojima
5,148,462 A 9/1992 Spitsyn et al.
5,173,928 A 12/1992 Momose et al.
5,249,216 A 9/1993 Ohsugi et al.
5,276,724 A 1/1994 Kumasaka et al.
5,602,899 A 2/1997 Larson
5,604,782 A 2/1997 Cash, Jr.
5,629,969 A 5/1997 Koshishiba
5,657,365 A 8/1997 Yamamoto et al.
5,682,415 A 10/1997 O'Hara
5,715,291 A 2/1998 Momose
5,729,583 A 3/1998 Tang et al.
5,768,339 A 6/1998 O'Hara
5,772,903 A 6/1998 Hirsch
5,778,039 A 7/1998 Hossain
5,812,629 A 9/1998 Clauser
5,825,848 A 10/1998 Virshup et al.
5,832,052 A 11/1998 Hirose et al.
5,857,008 A 1/1999 Reinhold
5,878,110 A 3/1999 Yamamoto et al.
5,881,126 A 3/1999 Momose
5,912,940 A 6/1999 O'Hara
5,930,325 A 7/1999 Momose
6,108,397 A 8/2000 Cash, Jr.
6,108,398 A 8/2000 Mazor et al.
6,125,167 A 9/2000 Morgan
6,278,764 B1 8/2001 Barbee, Jr. et al.
6,359,964 B1 3/2002 Kogan
6,377,660 B1 4/2002 Ukita et al.
6,381,303 B1 4/2002 Vu et al.
6,389,100 B1 5/2002 Verman et al.
6,430,254 B2 8/2002 Wilkins
6,442,231 B1 8/2002 O'Hara
6,456,688 B1 9/2002 Taguchi et al.
6,463,123 B1 10/2002 Korenev
6,487,272 B1 11/2002 Kutsuzawa
6,504,902 B2 1/2003 Iwasaki et al.
6,507,388 B2 1/2003 Burghoorn
6,553,096 B1 4/2003 Zhou et al.
6,560,313 B1 5/2003 Harding et al.
6,560,315 B1 5/2003 Price et al.
6,707,883 B1 3/2004 Tiearney et al.
6,711,234 B1 3/2004 Loxley et al.
6,811,612 B2 11/2004 Gruen et al.
6,815,363 B2 11/2004 Yun et al.
6,829,327 B1 12/2004 Chen
6,847,699 B2 1/2005 Rigali et al.
6,850,598 B1 2/2005 Fryda et al.
6,870,172 B1 3/2005 Mankos et al.
6,885,503 B2 4/2005 Yun et al.
6,914,723 B2 7/2005 Yun et al.
6,917,472 B1 7/2005 Yun et al.
6,947,522 B2 9/2005 Wilson et al.
6,975,703 B2 12/2005 Wilson et al.
7,003,077 B2 2/2006 Jen et al.
7,006,596 B1 2/2006 Janik
7,015,467 B2 3/2006 Maldonado et al.
7,023,955 B2 4/2006 Chen et al.
7,057,187 B1 6/2006 Yun et al.
7,079,625 B2 7/2006 Lenz
7,095,822 B1 8/2006 Yun
7,110,503 B1 * 9/2006 Kumakhov ..... G01N 23/207 378/119
7,119,953 B2 10/2006 Yun et al.
7,130,375 B1 10/2006 Yun et al.
7,170,969 B1 1/2007 Yun et al.
7,180,979 B2 2/2007 Momose
7,180,981 B2 2/2007 Wang
7,183,547 B2 2/2007 Yun et al.
7,215,736 B1 5/2007 Wang et al.
7,215,741 B2 5/2007 Ukita et al.
7,218,700 B2 5/2007 Huber et al.
7,218,703 B2 5/2007 Yada et al.
7,221,731 B2 5/2007 Yada et al.
7,245,696 B2 7/2007 Yun et al.
7,268,945 B2 9/2007 Yun et al.
7,286,640 B2 10/2007 Yun et al.
7,297,959 B2 11/2007 Yun et al.
7,298,826 B2 11/2007 Inazuru
7,330,533 B2 2/2008 Sampayon
7,346,148 B2 3/2008 Ukita
7,346,204 B2 3/2008 Ito
7,359,487 B1 4/2008 Newcome
7,365,909 B2 4/2008 Yun et al.
7,365,918 B1 4/2008 Yun et al.
7,382,864 B2 6/2008 Hebert et al.
7,388,942 B2 6/2008 Wang et al.
7,394,890 B1 7/2008 Wang et al.
7,400,704 B1 7/2008 Yun et al.
7,406,151 B1 7/2008 Yun
7,412,024 B1 8/2008 Yun et al.
7,412,030 B1 8/2008 O'Hara

(56) References Cited

U.S. PATENT DOCUMENTS 7,412,131 B2 8/2008 Lee et al.
7,414,787 B2 8/2008 Yun et al.
7,433,444 B2 10/2008 Baumann
7,443,953 B1 10/2008 Yun et al.
7,453,981 B2 11/2008 Baumann
7,463,712 B2 12/2008 Zhu et al.
7,486,770 B2 2/2009 Baumann
7,492,871 B2 2/2009 Popescu
7,499,521 B2 3/2009 Wang et al.
7,515,684 B2 4/2009 Gibson et al.
7,522,698 B2 4/2009 Popescu
7,522,707 B2 4/2009 Steinlage et al.
7,522,708 B2 4/2009 Heismann
7,529,343 B2 5/2009 Safai et al.
7,532,704 B2 5/2009 Hempel
7,551,719 B2 6/2009 Yokhin et al.
7,551,722 B2 6/2009 Ohshima et al.
7,561,662 B2 7/2009 Wang et al.
7,564,941 B2 7/2009 Baumann
7,583,789 B1 9/2009 Macdonald et al.
7,601,399 B2 10/2009 Barnola et al.
7,639,786 B2 12/2009 Baumann
7,646,843 B2 1/2010 Popescu et al.
7,672,433 B2 3/2010 Zhong et al.
7,680,243 B2 3/2010 Yokhin et al.
7,787,588 B1 8/2010 Yun et al.
7,796,725 B1 9/2010 Yun et al.
7,796,726 B1 9/2010 Gendreau et al.
7,800,072 B2 9/2010 Yun et al.
7,813,475 B1 10/2010 Wu et al.
7,817,777 B2 10/2010 Baumann et al.
7,864,426 B2 1/2011 Yun et al.
7,864,922 B2 1/2011 Kawabe
7,873,146 B2 1/2011 Okunuki et al.
7,876,883 B2 1/2011 O'Hara
7,889,838 B2 2/2011 David et al.
7,889,844 B2 2/2011 Okunuki et al.
7,914,693 B2 3/2011 Jeong et al.
7,920,673 B2 4/2011 Lanza et al.
7,920,676 B2 4/2011 Yun et al.
7,924,973 B2 4/2011 Kottler et al.
7,929,667 B1 4/2011 Zhuang et al.
7,945,018 B2 5/2011 Heismann
7,949,092 B2 5/2011 Brons
7,949,095 B2 5/2011 Ning
7,974,379 B1 7/2011 Case et al.
7,983,381 B2 7/2011 David et al.
7,991,120 B2 8/2011 Okunuki et al.
8,005,185 B2 8/2011 Popescu
8,009,796 B2 8/2011 Popescu
8,041,004 B2 10/2011 David
8,036,341 B2 11/2011 Lee
8,058,621 B2 * 11/2011 Kommareddy ..... G01N 23/207 250/364
8,068,579 B1 11/2011 Yun et al.
8,073,099 B2 12/2011 Niu et al.
8,094,784 B2 1/2012 Morton
8,139,716 B2 3/2012 Okunuki et al.
8,184,771 B2 5/2012 Murakoshi
8,208,602 B2 * 6/2012 Lee ..... G21K 1/062 378/119
8,208,603 B2 6/2012 Sato
8,243,879 B2 8/2012 Itoh et al.
8,243,884 B2 8/2012 Rödhammer et al.
8,280,000 B2 10/2012 Takahashi
8,306,183 B2 11/2012 Koehler
8,306,184 B2 11/2012 Chang et al.
8,351,569 B2 1/2013 Baker
8,351,570 B2 1/2013 Nakamura
8,353,628 B1 1/2013 Yun et al.
8,360,640 B2 1/2013 Reinhold
8,374,309 B2 2/2013 Donath
8,406,378 B2 3/2013 Wang et al.
8,416,920 B2 4/2013 Okumura et al.
8,422,633 B2 4/2013 Lantz et al.
8,451,975 B2 5/2013 Tada
8,422,637 B2 6/2013 Okunuki et al.
8,509,386 B2 8/2013 Lee et al.
8,520,803 B2 8/2013 Behling
8,526,575 B1 9/2013 Yun et al.
8,532,257 B2 9/2013 Mukaide et al.
8,553,843 B2 10/2013 Drory
8,559,597 B2 10/2013 Chen et al.
8,565,371 B2 10/2013 Bredno
8,576,983 B2 11/2013 Baeumer
8,591,108 B2 11/2013 Tada
8,602,648 B1 12/2013 Jacobsen et al.
8,632,247 B2 1/2014 Ishii
8,666,024 B2 3/2014 Okunuki et al.
8,666,025 B2 3/2014 Klausz
8,699,667 B2 4/2014 Steinlage et al.
8,735,844 B1 5/2014 Khaykovich et al.
8,737,565 B1 5/2014 Lyon et al.
8,744,048 B2 6/2014 Lee et al.
8,755,487 B2 6/2014 Kaneko
8,767,915 B2 7/2014 Stutman
8,767,916 B2 7/2014 Hashimoto
8,781,069 B2 7/2014 Murakoshi
8,824,629 B2 9/2014 Ishii
8,831,174 B2 9/2014 Kohara
8,831,175 B2 9/2014 Silver et al.
8,831,179 B2 9/2014 Adler et al.
8,855,265 B2 10/2014 Engel
8,861,682 B2 10/2014 Okunuki et al.
8,903,042 B2 12/2014 Ishii
8,995,622 B2 3/2015 Adler et al.
9,001,967 B2 4/2015 Baturin
9,008,278 B2 4/2015 Lee et al.
9,016,943 B2 4/2015 Jacobsen et al.
9,020,101 B2 4/2015 Omote et al.
9,129,715 B2 9/2015 Adler et al.
9,329,141 B2 5/2016 Stutman
9,357,975 B2 6/2016 Baturin
9,390,881 B2 7/2016 Yun et al.
9,439,613 B2 9/2016 Stutman
9,448,190 B2 9/2016 Yun et al.
9,449,781 B2 9/2016 Yun et al.
9,543,109 B2 1/2017 Yun et al.
9,570,265 B1 2/2017 Yun et al.
9,594,036 B2 3/2017 Yun et al.
9,632,040 B2 4/2017 Stutman
9,719,947 B2 8/2017 Yun et al.
9,823,203 B2 11/2017 Yun et al.
9,874,531 B2 1/2018 Yun et al.
9,939,392 B2 4/2018 Wen
2001/0006413 A1 7/2001 Burghoorn
2002/0085676 A1 7/2002 Snyder
2003/0142790 A1 1/2003 Zhou et al.
2003/0223536 A1 12/2003 Yun et al.
2004/0120463 A1 6/2004 Wilson et al.
2004/0140432 A1 7/2004 Maldonado et al.
2005/0074094 A1 4/2005 Jen et al.
2005/0123097 A1 6/2005 Wang
2005/0163284 A1 7/2005 Inazuru
2005/0282300 A1 12/2005 Yun et al.
2006/0045234 A1 3/2006 Pelc
2006/0062350 A1 3/2006 Yokhin
2007/0030959 A1 2/2007 Ritter
2007/0071174 A1 3/2007 Hebert et al.
2007/0108387 A1 5/2007 Yun et al.
2007/0110217 A1 5/2007 Ukita
2007/0183563 A1 8/2007 Baumann
2007/0183579 A1 8/2007 Baumann et al.
2007/0189449 A1 8/2007 Baumann
2007/0248215 A1 10/2007 Ohshima et al.
2008/0084966 A1 4/2008 Aoki et al.
2008/0089484 A1 4/2008 Reinhold
2008/0094694 A1 4/2008 Yun et al.
2008/0159707 A1 7/2008 Lee et al.
2008/0165355 A1 7/2008 Yasui et al.
2008/0170662 A1 7/2008 Reinhold
2008/0170668 A1 7/2008 Kruit et al.
2008/0181363 A1 7/2008 Fenter et al.
2008/0240344 A1 10/2008 Reinhold

(56) References Cited

U.S. PATENT DOCUMENTS

| | | | |
|---|---|---|---|
| 2008/0273662 | A1 | 11/2008 | Yun |
| 2009/0052619 | A1 | 2/2009 | Endoh |
| 2009/0092227 | A1 | 4/2009 | David |
| 2009/0154640 | A1 | 6/2009 | Baumann et al. |
| 2009/0316860 | A1 | 12/2009 | Okunuki et al. |
| 2010/0012845 | A1 | 1/2010 | Baeumer et al. |
| 2010/0027739 | A1 | 2/2010 | Lantz et al. |
| 2010/0040202 | A1 | 2/2010 | Lee |
| 2010/0046702 | A1 | 2/2010 | Chen et al. |
| 2010/0061508 | A1 | 3/2010 | Takahashi |
| 2010/0091947 | A1 | 4/2010 | Niu |
| 2010/0141151 | A1 | 6/2010 | Reinhold |
| 2010/0246765 | A1 | 9/2010 | Murakoshi |
| 2010/0260315 | A1 | 10/2010 | Sato et al. |
| 2010/0272239 | A1 | 10/2010 | Lantz et al. |
| 2010/0284513 | A1 | 11/2010 | Kawabe |
| 2011/0026680 | A1 | 2/2011 | Sato |
| 2011/0038455 | A1 | 2/2011 | Silver et al. |
| 2011/0058655 | A1 | 3/2011 | Okumura et al. |
| 2011/0064191 | A1 | 3/2011 | Toth et al. |
| 2011/0085644 | A1 | 4/2011 | Verman |
| 2011/0135066 | A1 | 6/2011 | Behling |
| 2011/0142204 | A1 | 6/2011 | Zou et al. |
| 2011/0235781 | A1 | 9/2011 | Aoki et al. |
| 2011/0243302 | A1 | 10/2011 | Murakoshi |
| 2011/0268252 | A1 | 11/2011 | Ozawa et al. |
| 2012/0041679 | A1 | 2/2012 | Stampanoni |
| 2012/0057669 | A1 | 3/2012 | Vogtmeier et al. |
| 2012/0163547 | A1 | 6/2012 | Lee et al. |
| 2012/0163554 | A1 | 6/2012 | Tada |
| 2012/0224670 | A1 | 9/2012 | Kiyohara et al. |
| 2012/0228475 | A1 | 9/2012 | Pang et al. |
| 2012/0269323 | A1 | 10/2012 | Adler et al. |
| 2012/0269324 | A1 | 10/2012 | Adler |
| 2012/0269325 | A1 | 10/2012 | Adler et al. |
| 2012/0269326 | A1 | 10/2012 | Adler et al. |
| 2012/0294420 | A1 | 11/2012 | Nagai |
| 2013/0011040 | A1 | 1/2013 | Kido et al. |
| 2013/0032727 | A1 | 2/2013 | Kondoe |
| 2013/0039460 | A1 | 2/2013 | Levy |
| 2013/0108012 | A1 | 5/2013 | Sato |
| 2013/0108022 | A1 | 5/2013 | Kugland et al. |
| 2013/0195246 | A1 | 8/2013 | Tamura et al. |
| 2013/0223594 | A1 | 8/2013 | Sprong et al. |
| 2013/0259207 | A1 | 10/2013 | Omote et al. |
| 2013/0279651 | A1 | 10/2013 | Yokoyama |
| 2013/0308112 | A1 | 11/2013 | Clube et al. |
| 2013/0308754 | A1 | 11/2013 | Yamazaki et al. |
| 2014/0023973 | A1 | 1/2014 | Marconi et al. |
| 2014/0037052 | A1 | 2/2014 | Adler |
| 2014/0064445 | A1 | 3/2014 | Adler |
| 2014/0072104 | A1 | 3/2014 | Jacobsen et al. |
| 2014/0079188 | A1 | 3/2014 | Hesselink et al. |
| 2014/0105363 | A1 | 4/2014 | Chen et al. |
| 2014/0146945 | A1 | 5/2014 | Fredenberg et al. |
| 2014/0153692 | A1 | 6/2014 | Larkin et al. |
| 2014/0177800 | A1 | 6/2014 | Sato et al. |
| 2014/0185778 | A1 | 7/2014 | Lee et al. |
| 2014/0205057 | A1 | 7/2014 | Koehler et al. |
| 2014/0211919 | A1 | 7/2014 | Ogura et al. |
| 2014/0226785 | A1 | 8/2014 | Stutman et al. |
| 2014/0241493 | A1 | 8/2014 | Yokoyama |
| 2014/0270060 | A1 | 9/2014 | Date et al. |
| 2014/0369469 | A1 | 12/2014 | Ogura et al. |
| 2015/0030126 | A1 | 1/2015 | Radicke |
| 2015/0030127 | A1 | 1/2015 | Aoki et al. |
| 2015/0043713 | A1 | 2/2015 | Chen |
| 2015/0049860 | A1 | 2/2015 | Das |
| 2015/0055743 | A1 | 2/2015 | Vedantham et al. |
| 2015/0055745 | A1 | 2/2015 | Holzner et al. |
| 2015/0092924 | A1 | 4/2015 | Yun et al. |
| 2015/0110252 | A1 | 4/2015 | Yun et al. |
| 2015/0117599 | A1 | 4/2015 | Yun et al. |
| 2015/0194287 | A1 | 7/2015 | Yun et al. |
| 2015/0243397 | A1 | 8/2015 | Yun et al. |
| 2015/0247811 | A1 | 9/2015 | Yun et al. |
| 2015/0260663 | A1 | 9/2015 | Yun et al. |
| 2015/0357069 | A1 | 12/2015 | Yun et al. |
| 2016/0064175 | A1 | 3/2016 | Yun et al. |
| 2016/0066870 | A1 | 3/2016 | Yun et al. |
| 2016/0106387 | A1 | 4/2016 | Kahn |
| 2016/0178540 | A1 | 6/2016 | Yun et al. |
| 2016/0268094 | A1* | 9/2016 | Yun ..... H01J 35/106 |
| 2016/0320320 | A1 | 11/2016 | Yun et al. |
| 2016/0351370 | A1 | 12/2016 | Yun et al. |
| 2017/0047191 | A1 | 2/2017 | Yun et al. |
| 2017/0052128 | A1 | 2/2017 | Yun et al. |
| 2017/0162288 | A1 | 6/2017 | Yun et al. |
| 2017/0162359 | A1 | 6/2017 | Tang et al. |
| 2017/0227476 | A1 | 8/2017 | Zhang et al. |
| 2017/0234811 | A1 | 8/2017 | Zhang et al. |
| 2017/0261442 | A1 | 9/2017 | Yun et al. |
| 2017/0336334 | A1 | 11/2017 | Yun et al. |
| 2018/0144901 | A1 | 5/2018 | Yun et al. |
| 2018/0261352 | A1 | 9/2018 | Matsuyama et al. |
| 2018/0306734 | A1 | 10/2018 | Morimoto et al. |
| 2018/0323032 | A1 | 11/2018 | Strelic et al. |

FOREIGN PATENT DOCUMENTS

| | | |
|---|---|---|
| EP | 0751533 | 1/1997 |
| EP | 1028451 | 8/2000 |
| FR | 2548447 | 1/1985 |
| JP | H06-188092 | 7/1994 |
| JP | H07-056000 | 3/1995 |
| JP | H08-184572 | 7/1996 |
| JP | 2000-306533 | 11/2000 |
| JP | 2007-218683 | 8/2007 |
| JP | 2007-265981 | 10/2007 |
| JP | 2007-311185 | 11/2007 |
| JP | 2008-200359 | 4/2008 |
| JP | 2008-197495 | 8/2008 |
| JP | 2009-195349 | 3/2009 |
| JP | 2009-212058 | 9/2009 |
| JP | 2010-236986 | 10/2010 |
| JP | 2011-029072 | 2/2011 |
| JP | 2011-218147 | 11/2011 |
| JP | 2012-187341 | 10/2012 |
| JP | 2013-508683 | 3/2013 |
| JP | 2013-157269 | 8/2013 |
| JP | 2013-160637 | 8/2013 |
| JP | 2013-239317 | 11/2013 |
| JP | 2015-002074 | 1/2015 |
| JP | 2015-047306 | 3/2015 |
| JP | 2015-077289 | 4/2015 |
| WO | WO 1995/006952 | 3/1995 |
| WO | WO 1998/011592 | 3/1998 |
| WO | WO 2002/039792 | 5/2002 |
| WO | WO 2003/081631 | 10/2003 |
| WO | WO 2005/109969 | 11/2005 |
| WO | WO 2006/096052 | 9/2006 |
| WO | WO 2007/1125833 | 11/2007 |
| WO | WO 2009/098027 | 8/2009 |
| WO | WO 2009/1104560 | 8/2009 |
| WO | WO 2011/032572 | 3/2011 |
| WO | WO 2012/032950 | 3/2012 |
| WO | WO 2013/004574 | 1/2013 |
| WO | WO 2013/111050 | 8/2013 |
| WO | WO 2013/118593 | 8/2013 |
| WO | WO 2013/160153 | 10/2013 |
| WO | WO 2013/168468 | 11/2013 |
| WO | WO 2014/054497 | 4/2014 |
| WO | WO 2015/016019 | 2/2015 |
| WO | WO 2015/034791 | 3/2015 |
| WO | WO 2015/066333 | 5/2015 |
| WO | WO 2015/084466 | 6/2015 |
| WO | WO 2015/168473 | 11/2015 |
| WO | WO 2015/176023 | 11/2015 |
| WO | WO 2015/187219 | 12/2015 |
| WO | WO 2016/187623 | 11/2016 |
| WO | WO 2017/031740 | 3/2017 |
| WO | WO 2017/204850 | 11/2017 |
| WO | WO 2017/213996 | 12/2017 |
| WO | WO 2018/175570 | 9/2018 |

(56) References Cited

FOREIGN PATENT DOCUMENTS

OTHER PUBLICATIONS

"Element Six CVD Diamond Handbook" (Element Six, Luxembourg, 2015).
"High performance benchtop EDXRF spectrometer with Windows® software," published by: Rigaku Corp., Tokyo, Japan; 2017.
"Monochromatic Doubly Curved Crystal Optics," published by: X-Ray Optical Systems, Inc. (XOS), East Greenbush, NY; 2017.
"Optics and Detectors," Section 4 of XS-Ray Data Booklet, 3rd Ed., A.C. Thompson ed. (Lawrence Berkeley Nat'l Lab, Berkeley, CA, 2009).
"Properties of Solids," Ch. 12 of CRC Handbook of Chemistry and Physics, 90th ed., Devid R. Lide & W.M. "Mickey" Haynes, eds. (CRC Press, Boca Raton, FL, 2009), pp. 12-41-12-46; 12-203-12-212.
"Science and Technology of Future Light Sources", Arthur L. Robinson (LBNL) and Brad Plummer (SLAG), eds. Report Nos. ANL-08/39 / BNL-81895-2008 / LBNL-1090E-2009 / SLAC-R-917 (Lawrence Berkeley Nal'l Lab, Berkeley, CA, Dec. 2008).
"Series 5000 Packaged X-ray Tubes," Product Technical Data Sheet DS006 Rev. G, X-Ray Technologies Inc. (Oxford Insstruments), Scotts Valley, CA (no date).
"Toward Control of Matter: Energy Science Needs for a New Class of X-Ray Light Sources" (Lawrence Berkeley Nal'l Lab, Berkeley, CA, Sep. 2008).
"X-ray Optics for BES Light Source Facilities," Report of the Basic Energy Sciences Workshop on X-ray Optics for BES Light Source Facilities, D. Mills & H. Padmore, Co-Chairs, (U.S. Dept. of Energy, Office of Science, Potomac, MD, Mar. 2013).
Abullian et al., "Quantitative determination of the lateral density and intermolecular correlation between proteins anchored on the membrane surfaces using grazing incidence small-angle X-ray scattering and grazing incidence X-ray fluorescence," Nov. 28, 2012, The Journal of Chemical Physics, vol. 137, pp. 204907-1 to 204907-8.
Adachi et al., "Development of the 17-inch Direct-Conversion Dynamic Flat-panel X-ray Detector (FPD)," Digital R/F (Shimadzu Corp., 2 pages (no date, published-2004 with product release).
Aharonovich et al., "Diamond Nanophotonics," Adv. Op. Mat'ls vol. 2, Issue 10 (2014).
Als-Nielsen et al., "Phase contrast imaging" Sect. 9.3 of Ch. 9 of "Elements of Modern X-ray Physics, Second Edition", (John Wiley & Sons Ltd, Chichester, West Sussex, UK, 2011), pp. 318-329.
Als-Nielsen et al., "Photoelectric Absorption," Ch. 7 of "Elements of Modern X-ray Physics, Second Edition," (John Wiley & Sons Ltd, Chichester, West Sussex, UK, 2011).
Als-Nielsen et al., "Refraction and reflection from interfaces," Ch. 3 of "Elements of Modern X-ray Physics, Second Edition," (John Wiley & Sons Ltd., Chichester, West Sussex, UK, 2011), pp. 69-112.
Als-Nielsen et al., "X-rays and their interaction with matter", and "Sources", Ch. 1 & 2 of "Elements of Modern X-ray Physics, Second Edition" (John Wiley & Sons Ltd, Chichester, West Sussex, UK, 2011).
Altapova et al., "Phase contrast Iaminography based on Talbot interferometry," Opt. Express, vol. 20, No. 6, (2012) pp. 6496-6508.
Ando et al., "Smooth and high-rate reactive ion etching of diamond," Diamond and Related Materials, vol. 11, (2002) pp. 824-827.
Arfelli et al., "Mammography with Synchrotron Radiation: Phase-Detection Techniques," Radiology vol. 215, (2000), pp. 286-293.
Arndt et al., Focusing Mirrors for Use with Microfocus X-ray Tubes, 1998, Journal of Applied Crystallography, vol. 31, pp. 733-741.
Balaic et al., "X-ray optics of tapered capillaries," Appl. Opt. vol. 34 (Nov. 1995) pp. 7263-7272.
Baltes et al., "Coherent and incoherent grating reconstruction," J. Opt. Soc. Am. A vol. 3(8), (1986), pp. 1268-1275.
Barbee Jr., "Multilayers for x-ray optics," Opt. Eng. vol. 25 (Aug. 1986) pp. 898-915.
Baron et al., "A compact optical design for Bragg reflections near backscattering," J. Synchrotron Rad., vol. 8 (2001), pp. 1127-1130.
Bech, "In-vivo dark-field and phase-contrast x-ray imaging," Scientific Reports 3, (2013), Article No. 03209.
Bech, "X-ray imaging with a grating interferometer," University of Copenhagan PhD. Thesis, (May 1, 2009).
Bergamin et al., "Measuring small lattice distortions in Si-crystals by phase-contrast x-ray topography," J. Phys. D: Appl. Phys. vol. 33 (Dec. 31, 2000) pp. 2678-2682.
Bernstorff, "Grazing Incidence Small Angle X-ray Scattering (GISAXS)," Presentation at Advanced School on Synchrotron and Free Electron Laser Sources and their Multidisciplinary Applications, Apr. 2008, Trieste, Italy.
Bilderback et al., "Single Capillaries," Ch. 29 of "Handbook of Optics vol. III, 2nd Ed." (McGraw Hill, New York, 2001).
Birkholz, "Chapter 4: Grazing Incidence Configurations," Thin Film Analysis by X-ray Scattering (Wiley-VCH Verlag GmbH & Co. KGaA, Weinheim, Germany, 2006).
Bjeoumikhov et al., "A modular system for XRF and XRD applications consisting of a microfocus X-ray source and different capillary optics," X-ray Spectrometry, vol. 33 (2004), pp. 312-316.
Bjeoumikhov et al., "Capillary Optics for X-Rays," Ch. 18 of "Modern Developments in X-Ray and Neutron Optics," A. Erko et al., eds. (Springer, Berlin, Germany, 2008), pp. 287-306.
Canberra Model S-5005 WinAxil X-Ray Analysis Software, published by: Canberra Eurisys Benelux N.V./S.A.,Zellik, Belgium; Jun. 2004.
Cerrina, "The Schwarzschild Objective," Ch. 27 of "Handbook of Optics vol. III, 2nd Ed." (McGraw Hill, New York, 2001).
Chen et al., "Advance in detection of low sulfur content by wavelength dispersive XRF," Proceedings of the Annual ISA Analysis Division Symposium (2002).
Chen et al., "Doubly curved crystal (DCC) X-ray optics and applications," Powder Diffraction, vol. 17(2) (2002), pp. 99-103.
Chen et al., "Guiding and focusing neutron beams using capillary optics," Nature vol. 357 (Jun. 4, 1992), pp. 391-393.
Chervenak et al., "Experimental thick-target bremsstrahlung spectra from electrons in the range 10 to 30 keV", Phys. Rev. A vol. 12 (1975), pp. 26-33.
Coan et al., "In vivo x-ray phase contrast analyzer-based imaging for longitudinal osteoarthritis studies in guinea pigs," Phys. Med. Biol. vol. 55(24) (2010), pp. 7649-62.
Cockcroft et al., "Chapter 2: Experimental Setups," Powder Diffraction: Theory and Practice, R.E. Dinnebier and S.J.L. Billinge, eds (Royal Society of Chemistry Publishing, London, UK, 2008).
Cohen et al., "Tunable laboratory extended x-ray absorption fine structure system," Rev. Sci. Instr. vol. 51, No. 3, Mar. 1980, pp. 273-277.
Cong et al., "Fourier transform-based iterative method for differential phase-contrast computed tomography", Opt. Lett. vol. 37 (2012), pp. 1784-1786.
Cornaby et al., "Advances in X-ray Microfocusing with Monocapillary Optics at CHESS," CHESS News Magazine (2009), pp. 63-66.
Cornaby et al., "Design of Single-Bounce Monocapillary X-ray Optics," Advances in X-ray Analysis: Proceedings of the 55th Annual Conference on Applications of X-ray Analysis, vol. 50, (International Centre for Diffraction Data (ICDD), 2007), pp. 194-200.
Cornaby, "The Handbook of X-ray Single Bounce Monocapillary Optics, Including Optical Design and Synchrotron Applications" (PhD Dissertation, Cornell University, Ithaca, NY, May 2008).
David et al., "Fabrication of diffraction gratings for hard x-ray phase contrast imaging," Microelectron. Eng. vol. 84, (2007), pp. 1172-1177.
David et al., "Hard X-ray phase imaging and tomography using a grating interferometer," Spectrochimica Acta Part B vol. 62 (2007) pp. 626-630.
Davis et al., "Bridging the Micro-to-Macro Gap: A New Application for Micro X-Ray Fluorescence," Microsc Microanal., vol. 17(3) (Jun. 2011), pp. 410-417.

(56) References Cited

OTHER PUBLICATIONS

Diaz et al., "Monte Carlo Simulation of Scatter Field for Calculation of Contrast of Discs in Synthetic CDMAM Images," In: Digital Mammography, Proceedings 10th International Workshop IWDM 2010 (Springer Verlag, Berlin Heidelberg), (2010), pp. 628-635 (9 pages). Jun. 18, 2010.
Ding et al., "Reactive Ion Etching of CVD Diamond Films for MEMS Applications," Micromachining and Microfabrication, Proc. SPIE vol. 4230 (2000), pp. 224-230.
Dobrovinskaya et al., "Thermal Properties," Sect. 2.1.5 of "Sapphire: Material, Manufacturing,, Applications" (Springer Science + Business Media, New York, 2009).
Dong et al., "Improving Molecular Sensitivity in X-Ray Fluorescence Molecular Imaging (XFMI) of Iodine Distribution in Mouse-Sized Phantoms via Excitation Spectrum Optimization," IEEE Access, vol. 6, pp. 56966-56976 (2018).
Erko et al., "X-ray Optics," Ch. 3 of "Handbook of Practical X-Ray Fluorescence Analysis," B. Beckhoff et al., eds. (Springer, Berlin, Germany, 2006), pp. 85-198.
Falcone et al., "New directions in X-ray microscopy," Contemporary Physics, vol. 52, No. 4, (Jul.-Aug. 2010), pp. 293-318.
Fernández-Ruiz, "TXRF Spectrometry as a Powerful Tool for the Study of Metallic Traces in Biological Systems," Development in Analytical Chemistry, vol. 1 (2014), pp. 1-14.
Freund, "Mirrors for Synchrotron Beamlines," Ch. 26 of "Handbook of Optics vol. III, 2nd Ed." (McGraw Hill, New York, 2001).
Ge et al., "Investigation of the partially coherent effects in a 2D Talbot interferometer," Anal. Bioanal. Chem. vol. 401, (2011), pp. 865-870. Apr. 29, 2011 pub Jun. 14, 2011.
Gibson et al., "Polycapillary Optics: An Enabling Technology for New Applications," Advances in X-ray Analysis, vol. 45 (2002), pp. 286-297.
Gonzales et al., "Angular Distribution of Bremsstrahlung Produced by 10-Kev and 20 Kev Electrons Incident on a Thick Au Target", in Application of Accelerators in Research and Industry, AIP Conf. Proc. 1221 (2013), pp. 114-117.
Gonzales et al., "Angular distribution of thick-target bremsstrahlung produced by electrons with initial energies ranging from 10 to 20 keV incident on Ag", Phys. Rev. A vol. 84 (2011): 052726.
Guttmann et al., "Ellipsoidal capillary as condenser for the BESSSY full-field x-ray microscope," J. Phys. Conf. Ser. vol. 186 (2009): 012064.
Harasse et al., "Iterative reconstruction in x-ray computed laminography from differential phase measurements", Opt. Express. vol. 19 (2011), pp. 16560-16573.
Harasse et al., "X-ray Phase Laminography with a Grating Interferometer using Iterative Reconstruction", in International Workshop on X-ray and Neutron Phase Imaging with Gratings, AIP Conf. Proc. vol. 1466, (2012), pp. 163-168.
Harasse et al., "X-ray Phase Laminography with Talbot Interferometer", in Developments in X-Ray Tomography VII, Proc. SPIE vol. 7804 (2010), 780411.
Hasse et al., "New developments in laboratory-based x-ray sources and optics," Adv. In Laboratory-based X-Ray Sources, Optics, and Applications VI, ed. A.M. Khounsary, Proc. SPIE vol. 10387, 103870B-1 (2017).
Hemraj-Benny et al., "Near-Edge X-ray Absorption Fine Structure Spectroscopy as a Tool for Investigating Nanomaterials," Small, vol. 2(1), (2006), pp. 26-35.
Henke et al., "X-ray interactions: photoabsorption, scattering, transmission, and reflection at E=50-30000 eV, Z=1-92," Atomic Data and Nuclear Data Tables, vol. 54 (No. 2) (Jul. 1993), pp. 181-342.
Hennekam et al., "Trace metal analysis of sediment cores using a novel X-ray fluorescence core scanning method," Quaternary Int'l, https://doi.org/10.1016/j.quaint.2018.10.018 (2018).
Honma et al., Full-automatic XAFS Measurement System of the Engineering Science Research II beamline BL14B2 at Spring-8, 2011, AIP Conference Proceedings 1234, pp. 13-16.
Howard et al., "High-Definition X-ray Fluorescence Elemental Mapping of Paintings," Anal. Chem., 2012, vol. 84(7), pp. 3278-3286.
Howells, "Gratings and Monochromators in the VUV and Soft X-Ray Spectral Region," Ch. 21 of Handbook of Optics vol. III, 2nd Ed. (McGraw Hill, New York, 2001).
Howells, "Mirrors for Synchrotron-Radiation Beamlines," Publication LBL-34750 (Lawrence Berkeley Laboratory, Berkeley, CA, Sep. 1993).
Hrdý et al, "Diffractive-Refractive Optics: X-ray Crystal Monochromators with Profiled Diffracting Surfaces," Ch. 20 of "Modern Developments in X-Ray and Neutron Optics," A. Erko et al., eds. (Springer, Berlin Heidelberg New York, 2008).
Hwang et al, "New etching process for device fabrication using diamond," Diamond & Related Materials, vol. 13 (2004) pp. 2207-2210.
Ide-Ektessabi et al., "The role of trace metallic elements in neurodegenerative disorders: quantitative analysis using XRF and XANES spectroscopy," Anal. Sci., vol. 21(7) (Jul. 2005), pp. 885-892.
Ihsan et al., "A microfocus X-ray tube based on a microstructured X-ray target", Nuclear Instruments and Methods in Physics Research B vol. 267 (2009) pp. 3566-3573.
Ishisaka et al., "A New Method of Analyzing Edge Effect in Phase Contrast Imaging with Incoherent X-rays," Optical Review, vol. 7, No. 6, (2000), pp. 566-572.
Ito et al., "A Stable In-Laboratory EXAFS Measurement System," Jap. J. Appl. Phys., vol. 22, No. 2, Feb. 1, 1983, pp. 357-360.
Itoh et al., "Two-dimensional grating-based X-ray phase-contrast imaging using Fourier transform phase retrieval," Op. Express, vol. 19, No. 4 (2011) pp. 3339-3346.
Janssens et al, "Recent trends in quantitative aspects of microscopic X-ray fluorescence analysis," TrAC Trends in Analytical Chemistry 29.6 (Jun. 2010): 464-478.
Jiang et al., "X-Ray Phase-Contrast Imaging with Three 2D Gratings," Int. J. Biomed. Imaging, (2008), 827152, 8 pages.
Joy, "Astronomical X-ray Optics," Ch. 28 of "Handbook of Optics vol. III, 2nd Ed.," (McGraw Hill, New York, 2001).
Keyrilainen et al., "Phase contrast X-ray imaging of breast," Acta Radiologica, vol. 51 (8), (2010), pp. 866-884. Jan. 18, 2010 pub Jun. 15, 2010.
Kidalov et al., "Thermal Conductivity of Diamond Composites," Materials, vol. 2 (2009) pp. 2467-2495.
Kido et al., "Bone Cartilage Imaging with X-ray Interferometry using a Practical X-ray Tube", in Medical Imaging 2010: Physics of Medical Imaging, Proc. SPIE vol. 7622 (2010), 762240.
Kim, "Talbot images of wavelength-scale amplitude gratings," Opt. Express vol. 20(5), (2012), pp. 4904-4920.
Kirkpatrick et al., "Formation of Optical Images by X-Rays", J. Opt. Soc. Am. vol. 38(9) (1948), pp. 766-774.
Kirz, "Phase zone plates for x rays and the extreme uv," J. Op. Soc. Am. vol. 64 (Mar. 1974), pp. 301-309.
Kirz et al., "The History and Future of X-ray Microscopy", J. Physics: Conden. Series vol. 186 (2009): 012001.
Kiyohara et al., "Development of the Talbot-Lau Interferometry System Available for Clinical Use", in International Workshop on X-ray and Neutron Phase Imaging with Gratings, AIP Cong. Proc. vol. 1466, (2012), pp. 97-102.
Klockenkämper et al., "7.1 Instrumental Developments" and "7.3 Future Prospects by Combinations," from Chapter 7 of Total Reflection X-ray Fluorescence Analysis and Related Methods 2nd Ed. (J. Wiley and Sons, Hoboken, NJ, 2015).
Klockenkämper et al., "Chapter 3: Instrumentation for TXRF and GI-XRF," Total Reflection X-ray Fluorescence Analysis and Related Methods 2nd Ed. (J. Wiley and Sons, Hoboken, NJ, 2015).
Kottler et al., "A two-directional approach for grating based differential phase contrast imaging using hard x-rays," Opt. Express vol. 15(3), (2007), pp. 1175-1181.
Kottler et al., "Dual energy phase contrast x-ray imaging with Talbot-Lau interferometer," J. Appl. Phys. vol. 108(11), (2010), 114906. Jul. 7, 2010 pub Dec. 7, 2010.
Kumakhov et al., "Multiple reflection from surface X-ray optics," Physics Reports, vol. 191(5), (1990), pp. 289-350.

(56) References Cited

OTHER PUBLICATIONS

Kumakhov, "X-ray Capillary Optics. History of Development and Present Status" in Kumakhov Optics and Application, Proc. SPIE 4155 (2000), pp. 2-12.
Kuwabara et al., "Hard-X-ray Phase-Difference Microscopy with a Low-Brilliance Laboratory X-ray Source", Appl. Phys. Express vol. 4 (2011) 062502.
Kuznetsov, "X-Ray Optics Calculator," Institute of Microelectronics Technology and High Purity Materials, Russian Academy of Sciences (IMT RAS), Chernogolovka, Russia (6 pages submitted); 2016.
Lagomarsino et al., "Reflective Optical Arrays," Ch. 19 of "Modern Developments in X-Ray and Neutron Optics," A. Erko et al. eds. (Springer, Berlin, Germany, 2008), pp. 307-317.
Lai, "X-Ray Microfocusing Optics," Slide Presentation from Argonne National Laboratory, 71 slides, Cheiron Summer School 2007.
Langhoff et al., "X-ray Sources," Ch. 2 of "Handbook of Practical X-Ray Fluorescence Analysis," B. Beckhoff et al., eds. (Springer, Berlin Heidelberg New York, 2006), pp. 33-82.
Lechner et al., "Silicon drift detecors for high count rate X-ray spectroscopy at room temperature," Nuclear Instruments and Methods, vol. 458A (2001), pp. 281-287.
Leenaers et al., "Application of Glancing Incidence X-ray Analysis," 1997, X-ray Spectrometry, vol. 26, pp. 115-121.
Lengeler et al., "Refractive X-ray Optics," Ch. 20 of "Handbook of Optics vol. III, 2nd Ed." (McGraw Hill, New York, 2001.
Li et al., "Source-optic-crystal optimisation for compact monochromatic imaging," Proc. SPIE 5537 (2004), pp. 105-114.
Lohmann et al., "An interferometer based on the Talbot effect," Optics Communications vol. 2 (1971), pp. 413-415.
MacDonald et al., "An Introduction to X-ray and Neutron Optics," Ch. 19 of "Handbook of Optics vol. III, 2nd Ed." (McGraw Hill, New York, 2001).
MacDonald et al., "Polycapillary and Multichannel Plate X-Ray Optics," Ch. 30 of "Handbook of Optics vol. III, 2nd Ed.," (McGraw Hill, New York, 2001).
MacDonald et al., "Polycapillary X-ray Optics for Microdiffraction," J. Appl. Cryst., vol. 32 (1999) pp. 160-167.
MacDonald, "Focusing Polycapillary Optics and Their Applications," X-Ray Optics and Instrumentation, vol. 2010, (Oct. 2010): 867049.
Maj et al., "Etching methods for improving surface imperfections of diamonds used for x-ray monochromators," Adv. X-ray Anal., vol. 48 (2005), pp. 176-182.
Malgrange, "X-ray Optics for Synchrotron Radiation," ACTA Physica Polinica A, vol. 82(1) (1992) pp. 13-32.
Malzer et al., "A laboratory spectrometer for high throughput X-ray emission spectroscopy in catalysis research," Rev. Sci. Inst. 89, 113111 (2018).
Masuda et al., "Fabrication of Through-Hole Diamond Membranes by Plasma Etching Using Anodic Porous Alumina Mask," Electrochemical and Solid-State Letters, vol. 4(11) (2001) pp. G101-G103.
Matsushita, "Mirrors and Multilayers," Slide Presentation from Photon Factor, Tsukuba, Japan, 65 slides, (Cheiron School 2009, Sprint-8, Japan, Nov. 2009).
Matsushita, "X-ray monochromators," Slide Presentation from Photon Factory, Tsukuba, Japan, 70 slides, (Cheiron School 2009, Spring-8, Japan, Nov. 2009).
Matsuyama et al., "Wavefront measurement for a hard-X-ray nanobeam using single-grating interferometry", Opt Express vol. 20 (2012), pp. 24977-24986.
Miao et al., "Motionless phase stepping in X-ray phase contrast imaging with a compact source," Proceedings of the National Academy of Sciences, vol. 110(48), (2013), pp. 19268-19272.
Michette, "Zone and Phase Plates, Bragg-Fresnel Optics," Ch. 23 of "Handbook of Optics vol. III, 2nd Ed.," (McGraw Hill, New York, 2001).
Mizutani et al., X-ray microscopy for neural circuit reconstruction in 9th International Conference on X-Ray Microscopy, J. Phys: Conf. Ser. 186 (2009) 012092.
Modregger et al., "Grating-Based X-ray Phase Contrast Imaging," Ch. 3 of Emerging Imaging Technologies in Medicine, M. Anastasio & P. La Riviere, ed., CRC Press, Boca Raton, FL, (2012), pp. 43-56.
Momose et al., "Biomedical Imaging by Talbot-Type X-Ray Phase Tomography" in Developments in X-Ray Tomography V, Proc. SPIE vol. 6318 (2006) 63180T.
Momose et al., "Grating-Based X-ray Phase Imaging Using Multiline X-ray Source", Jpn. J. Appl. Phys. vol. 48 (2009), 076512.
Momose et al., "Phase Tomography by X-ray Talbot Interferometry for Biological Imaging" Jpn. J. Appl. Phys. vol. 45 2006 pp. 5254-5262.
Momose et al., "Phase Tomography Using X-ray Talbot Interferometer", in Synchrotron Radiation Instrumentation: Ninth International Conference, AIP Conf. Proc. vol. 879 (2007), pp. 1365-1368.
Momose et al., "Phase-Contrast X-Ray Imaging Using an X-Ray Interferometer for Biological Imaging", Analytical Sciences vol. 17 Supplement (2001), pp. i527-i530.
Momose et al., "Sensitivity of X-ray Phase Imaging Based on Talbot Interferometry", Jpn. J. Appl. Phys. vol. 47 (2008), pp. 8077-8080.
Momose et al., "X-ray Phase Measurements with Talbot Interferometry and Its Applications", in International Conference on Advanced Phase Measurement Methods in Optics and Imaging, AIP Conf. Proc. vol. 1236 (2010), pp. 195-199.
Momose et al., "X-ray Phase Imaging—From Static Observation to Dynamic Observation—", in International Workshop on X-ray and Neutron Phase Imaging with Gratings AIP Conf. Proc. vol. 1466, (2012), pp. 67-77.
Momose et al., "X-ray Phase Imaging Using Lau Effect", Appl. Phys. Express vol. 4 (2011) 066603.
Momose et al., "X-Ray Phase Imaging with Talbot Interferometry", in "Biomedical Mathematics: Promising Directions in Imaging, Therapy Planning, and Inverse Problems", Y. Censor, M. Jiang & G.Wang, eds. (Medical Physics Publishing, Madison, WI, USA, 2010), pp. 281-320.
Momose et al., "X-ray phase tomography with a Talbot interferometer in combination with an X-ray imaging microscope", in 9th International Conference on X-Ray Microscopy, J. Phys: Conf. Ser. 186 (2009) 012044.
Momose et al., "X-ray Talbot Interferometry with Capillary Plates", Jpn. J. Appl. Phys. vol. 45 (2006), pp. 314-316.
Momose et al., "Four-dimensional X-ray phase tomography with Talbot interferometry and white synchrotron radiation: dynamic observation of a living worm", Opt. Express vol. 19 (2011), pp. 8423-8432.
Momose et al., "High-speed X-ray phase imaging and X-ray phase tomography with Talbot interferometer and white synchrotron radiation", Opt. Express vol. 17 (2009), pp. 12540-12545.
Momose et al., "Phase Imaging with an X-ray Talbot Interferometer", Advances in X-ray Analysis vol. 49(3) (2006), pp. 21-30.
Momose et al., "Demonstration of X-Ray Talbot Interferometry", Jpn. J. Appl. Phys. vol. 42 (2003), pp. L866-L868.
Momose et al., "Phase Tomography Using an X-ray Talbot Interferometer", in Developments in X-Ray Tomography IV, Proc. SPIE vol. 5535 (2004), pp. 352-360.
Momose, "Recent Advances in X-ray Phase Imaging", Jpn. J. Appl. Phys. vol. 44 (2005), pp. 6355-6367.
Montgomery, "Self Imaging Objects of Infinite Aperture," J. Opt. Soc. Am. vol. 57(6), (1967), pp. 772-778.
Morimoto et al., "Development of multiline embedded X-ray targets for X-ray phase contrast imaging," XTOP 2012 Book of Abstracts, (Ioffe Physical-Technical Institute of the Russian Academy of Sciences, St. Petersburg, Russia, 2012), pp. 74-75.
Morimoto et al., X-ray phase contrast imaging by compact Talbot-Lau interferometer with a signal transmission grating, 2014, Optics Letters, vol. 39, No. 15, pp. 4297-4300.
Munro et al., Design of a novel phase contrast imaging system for mammography, 2010, Physics in Medicine and Biology, vol. 55, No. 14, pp. 4169-4185.
Nango et al., "Talbot-defocus multiscan tomography using the synchrotron X-ray microscope to study the lacuno-canalicular network in mouse bone", Biomed. Opt. Express vol. 4 (2013), pp. 917-923.

(56) References Cited

OTHER PUBLICATIONS

Neuhausler et al., "Non-destructive high-resolution X-ray imaging of ULSI micro-electronics using keV X-ray microscopy in Zernike phase contrast," Microelectronic Engineering, Elsevier Publishers BV., Amsterdam, NO, vol. 83, No. 4-9 (Apr. 1, 2006) pp. 1043-1046.
Newville, "Fundamentals of XAFS," (Univ. of Chicago, Chicago, IL, Jul. 23, 2004).
Noda et al., "Fabrication of Diffraction Grating with High Aspect Ratio Using X-ray Lithography Technique for X-ray Phase Imaging," Jpn. J. Appl. Phys. vol. 46, (2007), pp. 849-851.
Noda et al., "Fabrication of High Aspect Ratio X-ray Grating Using X-ray Lithography" J. Solid Mech_Mater. Eng. vol. 3 (2009), pp. 416-423.
Nojeh, "Carbon Nanotube Electron Sources: From Electron Beams to Energy Conversion and Optophononics", ISRN Nanomaterials vol. 2014 (2014): 879827.
Nuhn, "From storage rings to free electron lasers for hard x-rays", J.A37 Phys.: Condens. Matter vol. 16 (2004), pp. S3413-S34121.
Nykanen et al., "X-ray scattering in full-field digital mammography," Med. Phys. vol. 30(7), (2003), pp. 1864-1873.
Oji et al., Automatic XAFS measurement system developed at BL14B2 in SPring-8, Available online Nov. 15, 2011, Journal of Synchrotron Radiation, vol. 19, pp. 54-59.
Olbinado et al., "Demonstration of Stroboscopic X-ray Talbot Interferometry Using Polychromatic Synchrotron and Laboratory X-ray Sources", Appl. Phys. Express vol. 6 (2013), 096601.
Ortega et al., "Bio-metals imaging and speciation in cells using proton and synchrotron radiation X-ray microspectroscopy," J. Royal Society Interface vol. 6 suppl. 5 (Oct. 6, 2009), pp. 6S649-58.
Otendal et al., A 9 keV electron-impact liquid-gallium-jet x-ray source, Rev. Sci. Instrum. vol. 79 (2008): 016102.
Oxford Instruments Inc., Series 5000 Model XTF5011 X-ray Tube information, Jun. 1998, 3 pages.
Parrill et al., "GISAXS—Glancing Incidence Small Angle X-ray Scattering," Journal de Physique IV, vol. 3 (Dec. 1993), pp. 411-417.
PAXSCAN Flat Panel X-ray Imaging, Varian Sales Brochure, (Varian Medical Systems, Palo Alto, CA, Nov. 11, 2004).
Pfeiffer et al., "Hard-X-ray dark-field imaging using a grating interferometer," Nature Materials vol. 7, (2008), pp. 134-137.
Pfeiffer et al., "Hard x-ray phase tomography with low brilliance x-ray sources," Phys. Rev. Lett. vol. 98, (2007), 108105.
Pfeiffer et al., "Phase retrieval and differential phase-contrast imaging with low-brilliance X-ray sources," Nature Physics vol. 2, (2006), pp. 258-261.
Pfeiffer, "Milestones and basic principles of grating-based x-ray and neutron phase-contrast imaging," in International Workshop on X-ray and Neutron Phase Imaging with Gratings AIP Conf. Proc. vol. 1466, (2012), pp. 2-11.
Pianetta et al., "Application of synchrotron radiation to TXRF analysis of metal contamination on silicon wafer surfaces," Thin Solid Films, vol. 373(1-2), 2000, pp. 222-226.
Potts, "Electron Probe Microanalysis", Ch. 10 of "A Handbook of Silicate Rock Analysis" (Springer Science + Business Media, New York, 1987), pp. 326-382 (equation quoted from p. 336).
Prewitt et al., "FIB Repair of 5X Recticles and Effects on IC Quality," Integrated Circuit Metrology, Inspection, and Process Control VII, Proc. SPIE vol. 1926 (1993), pp. 517-526.
Prewitt et al., "Focused ion beam repair: staining of photomasks and reticles," J. Phys. D Appl. Phys. vol. 26 (1993), pp. 1135-1137.
Prewitt et al., "Gallium Staining in FIB Repair of Photomasks," Microelectronic Engineering, vol. 21 (1993), pp. 191-196.
Qin et al., "Trace metal imaging with high spatial resolution: Applications in biomedicine," Metallomics, vol. 3 (Jan. 2011), pp. 28-37.
Rayleigh, "On copying diffraction gratings and some phenomena connected therewith," Philos. Mag. vol. 11 (1881), pp. 196-205.
Renaud et al., "Probing surface and interface morphology with Grazing Incidence Small Angle X-ray Scattering," Surface Science Reports, vol. 64:8 (2009), pp. 255-380.
Riege, "Electron Emission from Ferroelectrics—A Review", CERN Report CERN AT/93-18 (CERN, Geneva, Switzerland, Jul. 1993).
Röntgen, "Ueber eine neue Art von Strahlen (Wurzburg Verlag, Warzburg, Germany, 1896) also, in English, On a New Kind of Rays," Nature vol. 53 (Jan. 23, 1896). pp. 274-276.
Rovezzi, "Study of the local order around magnetic impurities in semiconductors for spintronics." PhD Dissertation, Condensed Matter, Université Joseph-Fourier—Grenoble I, 2009, English <tel-00442852>.
Rutishauser, "X-ray grating interferometry for imaging and metrology," 2003, Eth Zurich, Diss. ETH No. 20939.
Sato et al., Two-dimensional gratings-based phase-contrast imaging using a conventional x-ray tube, 2011, Optics Letters, vol. 36, No. 18, pp. 3551-3553.
Scherer et al., "Bi-Directional X-Ray Phase-Contrast Mammography," PLoS ONE, vol. 9, Issue 5 (May 2014) e93502.
Scholz, "X-ray Tubes and Monochromators," Technical Workshop EPIV, Universität Würzburg (2007); 41 slides, 2007.
Scholze et al., "X-ray Detectors and XRF Detection Channels," Ch. 4 of "Handbook of Practical X-Ray Fluorescence Analysis," B. Beckhoff et al., eds. (Springer, Berlin Heidelberg, Germay, 2006), pp. 85-198.
Sebert, "Flat-panel detectors:how much better are they?" Pediatr. Radiol. vol. 36 (Suppl 2), (2006), pp. 173-181.
Shen, "Polarizing Crystal Optics," Ch. 25 of "Handbook of Optics vol. III, 2nd Ed.," (McGraw Hill, New York, 2001).
Shields et al., "Overview of Polycapillary X-ray Optics," Powder Diffraction, vol. 17(2) (Jun. 2002), pp. 70-80.
Shimura et al., "Hard x-ray phase contrast imaging using a tabletop Talbot-Lau interferometer with multiline embedded x-ray targets", Opt. Lett. vol. 38(2) (2013), pp. 157-159.
Siddons, "Crystal Monochromators and Bent Crystals," Ch. 22 of "Handbook of Optics vol. III, 2nd Ed.," (McGraw Hill, New York, 2001).
Smith, "Fundamentals of Digital Mammography:Physics, Technology and Practical Considerations," Publication R-BI-016 (Hologic, Inc., Bedford, MA, Mar. 2005).
Snigirev et al., "Hard X-Ray Microoptics," Ch. 17 of "Modern Developments in X-Ray and Neutron Optics," A. Erko et al., eds (Springer, Berlin, Germany, 2008), pp. 255-285.
Sparks Jr., "X-ray Fluorescence Microprobe for Chemical Analysis," in Synchrotron Radiation Research, H. Winick & S. Doniach, eds. (Plenum Press, New York, NY 1980), pp. 459-512.
Spiller, "Multilayers," Ch. 24 of "Handbook of Optics vol. III, 2nd Ed.," (McGraw Hill, New York, 2001).
Stampanoni et al., "The First Analysis and Clinical Evaluation of Native Breast Tissue Using Differential Phase-Contrast Mammography," Investigative Radiology, vol. 46, pp. 801-806. pub 2011-12-xx.
Strüder et al., "Silicon Drift Detectors for X-ray Imaging," Presentation at Detector Workshop on Synchrotron Radiation Instrumentation, 54 slides, (Argonne Nat'l Lab, Argonne, IL Dec. 8, 2005), available at: <http://www.aps.anl.gov/News/Conferences/2005/Synchrotron_Radiation_Instrumentation/Presentations/Strueder.pdf>.
Strüder et al., "X-Ray Detectors," Ch. 4 of "X-ray Spectrometry: Recent Technological Advances," K. Tsuji et al. eds. (John Wiley & Sons, Ltd. Chichester, West Sussex, UK, 2004), pp. 63-131.
Sun et al., "Combined optic system based on polycapillary X-ray optics and single-bounce monocapillary optics for focusing X-rays from a conventional laboratory X-ray source," Nucl. Inst. and Methods in Phys. Res. A 802 (2015) pp. 5-9.
Sun et al., "Numerical design of in-line X-ray phase-contrast imaging based on ellipsoidal single-bounce monocapillary," Nucl. Inst. and Methods in Phys. Res. A746 (2014) pp. 33-38.
Suzuki et al., "Hard X-ray Imaging Microscopy using X-ray Guide Tube as Beam Condenser for Field Illumination," J. Phys.: Conf. Ser. vol. 463 (2013): 012028.

(56) References Cited

OTHER PUBLICATIONS

Suzuki, "Development of the Digitex Safire Cardiac System Equipped with Direct conversion Flat Panel Detector," Digital Angio Technical Report (Shimadzu Corp., Kyoto, Japan, no date, published—2004 with product release).
Takahama, "RADspeed safire Digital General Radiography System Equipped with New Direct-Conversion FPD," Medical Now, No. 62 (2007).
Takeda et al., "Differential Phase X-ray Imaging Microscopy with X-ray Talbot Interferometer" Appl. Phys. Express vol. 1 (2008) 117002.
Takeda et al., "X-Ray Phase Imaging with Single Phase Grating", Jpn. J. Appl. Phys. vol. 46 (2007), pp. L89-L91.
Takeda et al., "In vivo physiological saline-infused hepatic vessel imaging using a two-crystal-interferometer-based phase-contrast X-ray technique", J. Synchrotron Radiation vol. 19 (2012), pp. 252-256.
Talbot, "Facts relating to optical science No. IV," Philos. Mag. vol. 9 (1836), pp. 401-407.
Tanaka et al., "Cadaveric and in vivo human joint imaging based on differential phase contrast by X-ray Talbot-Lau interferometry", Z. Med. Phys. vol. 23 (2013), pp. 222-227.
Tang et al., "Micro-computed tomography (Micro-CT): a novel appraoch for intraoperative breast cancer specimen imaging," Breast Cancer Res. Treat. vol. 139, pp. 311-316 (2013).
Taniguchi et al., "Diamond nanoimprint lithography," Nanotechnology, vol. 13 (2002) pp. 592-596.
Tkachuk et al., "High-resolution x-ray tomography using laboratory sources", in Developments in X-Ray Tomography V, Proc. SPIE 6318 (2006): 631810.
Tkachuk et al., "Multi-length scale x-ray tomography using laboratory and synchrotron sources", Microsc. Microanal. vol. 13 (Suppl. 2) (2007), pp. 1570-1571.
Töpperwien et al., "Multiscale x-ray phase-contrast tomography in a mouse model of transient focal cerebral ischemia," Biomed. Op. Express, vol. 10, No. 1, Jan. 2019, pp. 92-103.
Touzelbaev et al., "Applications of micron-scale passive diamond layers for the integrated circuits and microelectromechanical systems industries," Diamond and Rel. Mat'ls, vol. 7 (1998) pp. 1-14.
Tsuji et al., "X-Ray Spectrometry: Recent Technological Acvances," John Wiley & Sons Ltd. Chichester, West Susses, UK 2004), Chapters 1-7.
Udagawa, "An Introduction to In-House EXAFS Facilities," The Rigaku Journal, vol. 6, (1) (1989), pp. 20-27.
Udagawa, "An Introduction to X-ray Absorption Fine Structure," The Rigaku Journal, vol. 11(2)(1994), pp. 30-39.
Uehara et al., "Effectiveness of X-ray grating interferometry for non-destructive inspection of packaged devices", J. Appl. Phys. vol. 114 (2013), 134901.
Viermetz et al., "High resolution laboratory grating-based X-ray phase-contrast CT," Scientific Reports 8:15884 (2018).
Vogt, "X-ray Fluorescence Microscopy: A Tool for Biology, Life Science and Nanomedicine," Presentation on May 16, 2012 at James Madison Univ., Harrisonburg, VA (31 slides), 2012.
Wan et al., "Fabrication of Multiple Slit Using Stacked-Sliced Method for Hard X-ray Talbot—Lau Interferometer", Jpn. J. Appl. Phys. vol. 47 (2008), pp. 7412-7414.
Wang et al., "Advantages of intermediate X-ray energies in Zernicke phase constrast X-ray microscopy," Biotech. Adv., vol. 31 (2013) pp. 387-392.
Wang et al., "Non-invasive classification of microcalcifications with phase-contrast X-ray mammography," Nature Comm. vol. 5:3797, pp. 1-9 (2014).
Wang, On the single-photon-counting (SPC) modes of imaging using an XFEL source, presented at IWORLD (2015).
Wang et al., "Precise patterning of diamond films for MEMS application" Journal of Materials Processing Technology vol. 127 (2002), pp. 230-233.
Weitkamp et al., "Design aspects of X-ray grating interferometry," in International Workshop on X-ray and Neutron Phase Imaging with Gratings AIP Conf. Proc. vol. 1466, (2012), pp. 84-89.
Weitkamp et al., "Hard X-ray phase imaging and tomography with a grating interferometer," Proc. SPIE vol. 5535, (2004), pp. 137-142.
Weitkamp et al., "X-ray wavefront diagnostics with Talbot interferometers," International Workshop on X-Ray Diagnostics and Scientific Application of the European XFEL, Ryn, Poland, (2010), 36 slides.
Weitkamp et al., Tomography with grating interferometers at low-brilliance sources, 2006, SPIE, vol. 6318, pp. 0S-1 to 0S-10.
Weitkamp et al., "X-ray phase imaging with a grating interferometer," Opt. Express vol. 13(16), (2005), pp. 6296-6304.
Weitkamp et al., "X-ray wavefront analysis and optics characterization with a grating interferometer," Appl. Phys. Lett. vol. 86, (2005), 054101.
Wen et al., "Fourier X-ray Scattering Radiography Yields Bone Structural Information," Radiology, vol. 251 (2009) pp. 910-918.
Wen et al., "Single-shot x-ray differential phase-contrast and diffraction imaging using two-dimensional transmission gratings," Op. Lett. vol. 35, No. 12, (2010) pp. 1932-1934.
Wobrauschek et al., "Micro XRF of light elements using a polycapillary lens and an ultra-thin window Silicon Drift Detector inside a vacuum chamber," 2005, International Centre for Diffraction Data 2005, Advances in X-ray Analysis, vol. 48, pp. 229-235.
Wobrauschek et al., "Energy Dispersive, X-Ray Fluorescence Analysis," Encyclopedia of Analytical Chemistry, R.A. Meyers, Ed. (Wiley 2010).
Wolter, "Spiegelsysteme streifenden Einfalls als abbildende Optiken fur Rontgenstrahlen" [Grazing Incidence Reflector Systems as Imaging Optics for X-rays] Annalen der Physik vol. 445, Issue 1-2 (1952), pp. 94-114.
X-ray-Optics.de Website, http://www.x-ray-optics.de/, accessed Feb. 13, 2016.
Yakimchuk et al., "Ellipsoidal Concentrators for Laboratory X-ray Sources: Analytical approaches for optimization," Mar. 22, 2013, Crystallography Reports, vol. 58, No. 2, pp. 355-364.
Yamamoto, "Fundamental physics of vacuum electron sources", Reports on Progress in Physics vol. 69, (2006), pp. 181-232.
Yanagihara et al., "X-Ray Optics," Ch. 3 of "X-ray Spectrometry: Recent Technological Advances," K. Tsuji et al. eds. (John Wiley & Sons, Ltd. Chichester, West Sussex, UK, 2004), pp. 63-131.
Yang et al., "Analysis of Intrinsic Stress in Diamond Films by X-ray Diffraction," Advances in X-ray Analysis, vol. 43 (2000), pp. 151-156.
Yashiro et al., "Distribution of unresolvable anisotropic microstructures revealed in visibility-contrast images using x-ray Talbot interferometry", Phys. Rev. B vol. 84 (2011), 094106.
Yashiro et al., "Hard x-ray phase-imaging microscopy using the self-imaging phenomenon of a transmission grating", Phys. Rev. A vol. 82 (2010), 043822.
Yashiro et al., "Theoretical Aspect of X-ray Phase Microscopy with Transmission Gratings" in International Workshop on X-ray and Neutron Phase Imaging with Gratings, AIP Conf. Proc. vol. 1466, (2012), pp. 144-149.
Yashiro et al., "X-ray Phase Imaging and Tomography Using a Fresnel Zone Plate and a Transmission Grating", in "The 10th International Conference on X-ray Microscopy Radiation Instrumentation", AIP Conf. Proc. vol. 1365 (2011) pp. 317-320.
Yashiro et al., "Efficiency of capturing a phase image using cone-beam x-ray Talbot interferometry", J. Opt. Soc. Am. A vol. 25 (2008), pp. 2025-2039.
Yashiro et al., "On the origin of visibility contrast in x-ray Talbot interferometry", Opt. Express (2010), pp. 16890-16901.
Yashiro et al., "Optimal Design of Transmission Grating for X-ray Talbot Interferometer", Advances in X-ray Analysis vol. 49(3) (2006), pp. 375-379.
Yashiro et al., "X-ray Phase Imaging Microscopy using a Fresnel Zone Plate and a Transmission Grating", in The 10th International Conference on Synchrotron Radiation Instrumentation, AIP Conf. Proc. vol. 1234 (2010), pp. 473-476.

(56) References Cited

OTHER PUBLICATIONS

Yashiro et. al., "Hard-X-Ray Phase-Difference Microscopy Using a Fresnel Zone Plate and a Transmission Grating", Phys. Rev. Lett. vol. 103 (2009), 180801.
Yu et al., "Morphology and Microstructure of Tungsten Films by Magnetron Sputtering," Mat. Sci. Forum, vol. 913, pp. 416-423 (2018).
Zanette et al., "Two-Dimensional X-Ray Grating interferometer," Phys. Rev. Lett. vol. 105 (2010) pp. 248102-1 248102-4.
Zeng et al., "Ellipsoidal and parabolic glass capillaries as condensers for x-ray microscopes," Appl. Opt. vol. 47 (May 2008), pp. 2376-2381.
Zeng et al., "Glass Monocapillary X-ray Optics and Their Applications in X-Ray Microscopy," X-ray Optics and Microanalysis: Proceedings of the 20th International Congress, AIP Conf. Proc. vol. 1221, (2010), pp. 41-47.
Zhang et al., "Application of confocal X-ray fluorescence based on capillary X-ray optics in nondestructively measuring the inner diameter of monocapillary optics," Optics Comm. (2018) https://doi.org/10.1016/j.optcom.2018.11.064.
Zhang et al., "Fabrication of Diamond Microstructures by Using Dry and Wet Etching Methods", Plasma Science and Technology vol. 15(6) (Jun. 2013), pp. 552-554.

* cited by examiner

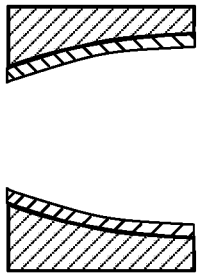
FIGURE 36A
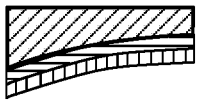
FIGURE 36B
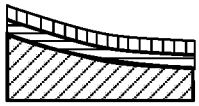

X-RAY ILLUMINATION SYSTEM WITH MULTIPLE TARGET MICROSTRUCTURES

CROSS-REFERENCE TO RELATED APPLICATIONS

The Present patent application is a continuation-in-part of U.S. patent application Ser. No. 15/166,274, filed May 27, 2016 and entitled DIVERGING X-RAY SOURCES USING LINEAR ACCUMULATION, which is a continuation-in-part of U.S. patent application Ser. No. 14/999,147, filed Apr. 1, 2016 and entitled X-RAY SOURCES USING LINEAR ACCUMULATION, which claims the benefit of U.S. Provisional Patent Application No. 62/141,847, filed Apr. 1, 2015 and entitled ADDITIONAL X-RAY SOURCE DESIGNS USING MICROSTRUCTURED TARGETS, and U.S. Provisional Patent Application No. 62/155,449, filed Apr. 30, 2015, and entitled X-RAY TARGET FABRICATION, both of which are incorporated herein by reference in their entirety; and which in turn is also a continuation-in-part of U.S. patent application Ser. No. 14/490,672, filed Sep. 19, 2014 and entitled X-RAY SOURCES USING LINEAR ACCUMULATION, which claims the benefit of U.S. Provisional Patent Application Nos. 61/880,151, filed on Sep. 19, 2013, 61/894,073, filed on Oct. 22, 2013, 61/931,519, filed on Jan. 24, 2014, and 62/008,856, filed on Jun. 6, 2014, all of which are incorporated herein by reference in their entirety.

BACKGROUND

Field of the Invention

The embodiments of the invention disclosed herein relate to high-brightness sources of x-rays. Such high brightness sources may be useful for a variety of applications in which x-rays are employed, including manufacturing inspection, metrology, crystallography, spectroscopy, structure and composition analysis and medical imaging and diagnostic systems.

Description of the Prior Art

X-ray sources have been used for over a century. One common x-ray source design is the electron bombardment reflection x-ray source, in which an electron emitter generates a beam of electrons that are accelerated onto an x-ray target by a voltage differential. The collision of the electrons into the target induces several effects, including the generation of x-rays, including bremsstrahlung continuum and characteristic x-rays of the target material.

For many techniques such as micro x-ray fluorescence, micro x-ray diffraction, crystallography, etc., there is a general a need for a microfocus x-ray source and optic combination that delivers a high brightness beam of x-rays within a small spot size onto a sample, and preferably of x-ray energies that optimal for the specific application. Common approaches to improving brightness of the source include: use of electron optics to guide and shape the path of the electrons, forming a more concentrated, focused beam at the target, use of target materials with higher atomic number to increase bremsstrahlung production (its efficiency scales with atomic number), and use of thermal strategies that allow higher electron power loading onto the target before melting. Thermal approaches include depositing the x-ray generating material on top of a substrate of high thermal conductivity such as diamond or beryllium, mounting the target onto a heat sink or heat pipe, and/or adding water coolant channels within the target.

In addition, low take-off angles are utilized to maximize apparent brightness. Although x-rays may be radiated isotropically, only the x-ray radiation within a small solid angle produced in the direction of a window in the source will be useful. X-ray brightness (also called "brilliance" by some), defined as the number of x-ray photons per second per solid angle in $mrad^2$ per area of the x-ray source in $mm^2$, can be increased by adjusting the geometric factors to maximize the collected x-rays. Generally, the surface of an x-ray target in a source is mounted at lower take-off angles (the angle between the target surface and the center of the emitted x-ray cone), so that the apparent spot size is reduced and apparent brightness is increased.

In principle, it may appear that a take-off angle of 0° would have the largest possible brightness. In practice, radiation at 0° occurs parallel to the surface of a solid metal target for conventional sources, and since the x-rays must propagate along a long length of the target material before emerging, most of the produced x-rays will be attenuated (reabsorbed) by the target material, reducing brightness. Thus, a source with take-off angle of around 6° to 15° (depending on the source configuration, target material, and electron energy) is conventionally used.

Despite these developments, there are still limits on the ultimate x-ray brightness that may be achieved with microfocus x-ray sources.

SUMMARY

The present technology, roughly described, includes an x-ray illumination beam system that includes an electron emitter and a target having one or more target microstructures, collectively referred to as an x-ray source. The one or more microstructures may be the same or different material, and may be embedded or placed atop a substrate formed of a heat-conducting material. The x-ray source may emit x-rays towards an optic system.

The optic system may include one or more optics that are matched to one or more target microstructures. The matching can be achieved by selecting optics with the geometric shape, size, and surface coating that collects as many x-rays as possible from the source and at an angle that satisfies the critical reflection angle of the x-ray energies of interest from the target. In some instances, the matching is based on maximizing the numerical aperture (NA) of the optics for x-ray energies of interest. The optic system may be configured to focus or collimate the beam, and may include a monochromator.

The x-ray illumination system allows for an x-ray source, comprised of an electron emitter and a target having one or more microstructures, to generate x-rays having different energies. The x-ray illumination system can be used in a variety of applications, including but not limited to spectroscopy, fluorescence analysis, microscopy, tomography, diffraction and other applications.

In some instances, an x-ray illumination beam system can provide multiple characteristic x-ray energies from a plurality of x-ray generating materials selected for its x-ray generating properties. The x-ray illumination system can include a vacuum chamber, first window, and an electron optical system. The vacuum chamber includes an electron emitter. The first window is transparent to x-rays and attached to a wall of the vacuum chamber. The electron optical system focusses an electron beam from the electron emitter. In the x-ray illumination beam system, a target can include a plurality of microstructures coupled to a substrate, wherein each microstructure includes a material selected for its x-ray generating properties, and in which a lateral dimension of said material is less than 250 microns;

The x-ray illumination beam system can include a means to position the x-ray target relative to the electron beam and a plurality of total external reflection mirror optics. The optics are matched to the x-ray spectra produced by at least one of the plurality of microstructures and positioned to collect x-rays generated by the at least one of the plurality of microstructures when bombarded by the focused electron beam.

BRIEF DESCRIPTION OF THE DRAWINGS

FIGS. 36A-B illustrate an optic with an interior surface coating.

DETAILED DESCRIPTION

1. Exemplary Embodiment

Figure 6:
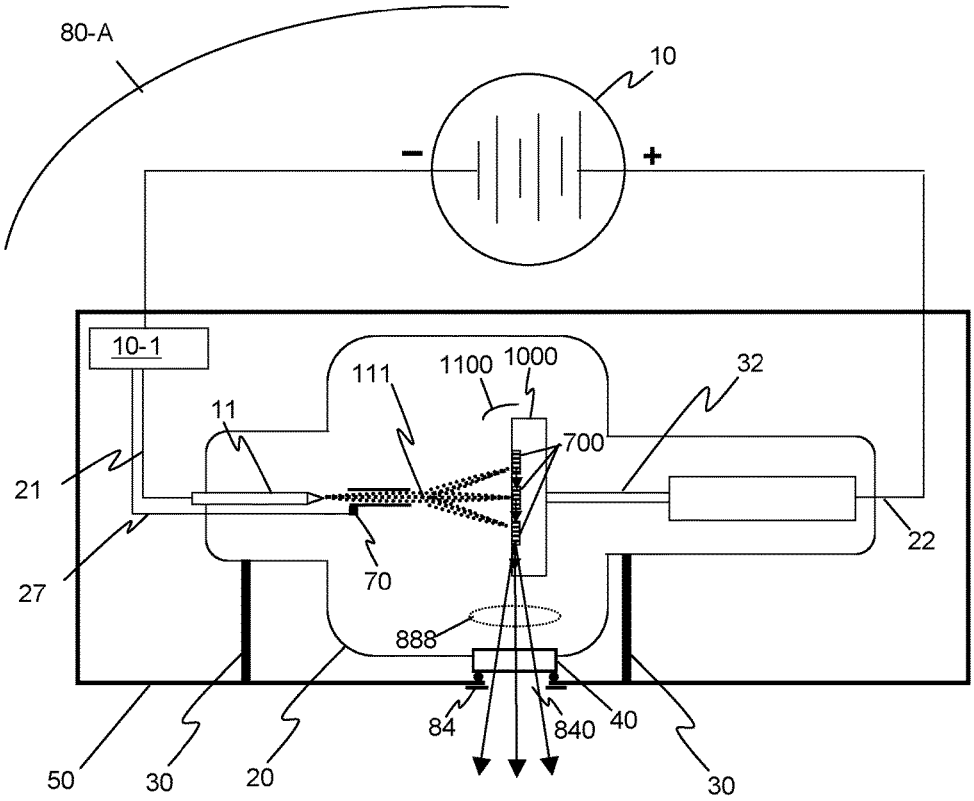
FIG. 6 illustrates a schematic cross-section view of an embodiment of an x-ray system according to the invention.

FIG. 6 illustrates an embodiment of a reflective x-ray system 80-A according to the invention. As in the prior art reflective x-ray system 80 described above, the source comprises a vacuum environment (typically $10^{-6}$ torr or better) commonly maintained by a sealed vacuum chamber 20 or active pumping, and manufactured with sealed electrical leads 21 and 22. The source 80-A will typically comprise mounts 30, and the housing 50 may additionally comprise shielding material, such as lead, to prevent x-rays from being radiated by the source 80-A in unwanted directions.

Inside the chamber 20, an emitter 11 connected through the lead 21 to the negative terminal of a high voltage source 10 serves as a cathode and generates a beam of electrons 111. Any number of prior art techniques for electron beam generation may be used for the embodiments of the invention disclosed herein. Additional known techniques used for electron beam generation include heating for thermionic emission, Schottky emission (a combination of heating and field emission), or emitters comprising nanostructures such as carbon nanotubes). [For more on electron emission options for electron beam generation, see Shigehiko Yamamoto, "Fundamental physics of vacuum electron sources", Reports on Progress in Physics vol. 69, pp. 181-232 (2006)].

As before, a target 1100 comprising a target substrate 1000 and regions 700 of x-ray generating material is electrically connected to the opposite high voltage lead 22 and target support 32, thus serving as an anode. The electrons 111 accelerate towards the target 1100 and collide with it at high energy. The collision of the electrons 111 into the target 1100 induces several effects, including the generation of x-rays, some of which exit the vacuum tube 20 and are transmitted through at least one window 40 and/or an aperture 840 in a screen 84.

In some embodiments of the invention, there may also be an electron beam control mechanism 70 such as an electrostatic lens system or other system of electron optics that is controlled and coordinated with the electron dose and voltage provided by the emitter 11 by a controller 10-1 through a lead 27. The electron beam 111 may therefore be scanned, focused, de-focused, or otherwise directed onto the target 1100.

As illustrated in FIG. 6, the alignment of the microstructures 700 may be arranged such that the bombardment of several of the microstructures 700 by the electron beam or beams 111 will excite radiation in a direction orthogonal to the surface normal of the target such that the intensity in the direction of view will add or accumulate in that direction. The direction may also be selected by means of an aperture 840 in a screen 84 for the system to form the directional beam 888 that exits the system through a window 40. In some embodiments, the aperture 840 may be positioned outside the vacuum chamber, or, more commonly, the window 40 itself may serve as the aperture 840. In some embodiments, the aperture may be inside the vacuum chamber.

Targets such as those to be used in x-ray sources according to the invention disclosed herein have been described in detail in the co-pending US patent application entitled STRUCTURED TARGETS FOR X-RAY GENERATION (U.S. patent application Ser. No. 14/465,816, filed Aug. 21, 2014), which is hereby incorporated by reference in its entirety, along with the provisional Applications to which this co-pending application claims benefit. Any of the target designs and configurations disclosed in the above referenced co-pending application may be considered for use as a component in any or all of the x-ray sources disclosed herein.

Figure 7:
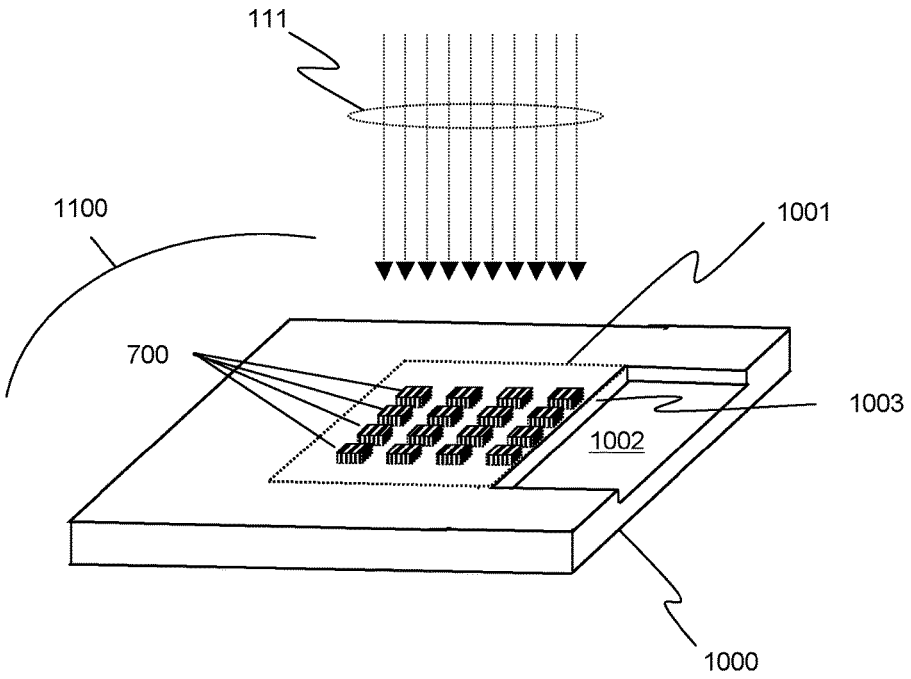
FIG. 7 illustrates a perspective view of a target comprising a grid of embedded rectangular target microstructures on a larger substrate that may be used in some embodiments of the invention.

FIG. 7 illustrates a target 1100 as may be used in some embodiments of the invention. In this figure, a substrate 1000 has a region 1001 that contains an array of microstructures 700 comprising x-ray generating material (typically a metallic material) arranged in a regular array of right rectangular prisms. Electrons 111 bombard the target and generate x-rays in the microstructures 700. The material in the substrate 1000 is selected such that it has relatively low energy deposition rate for electrons in comparison to the x-ray generating microstructure material (typically by selecting a low Z material for the substrate). The material of the substrate 1000 may also be chosen to have a high thermal conductivity, typically larger than 100 W/(m ° C.). The microstructures are typically embedded within the substrate, i.e. if the microstructures are shaped as rectangular prisms, it is preferred that at least five of the six sides are in close thermal contact with the substrate 1000, so that heat generated in the microstructures 700 is effectively conducted away into the substrate 1000. However, targets used in other embodiments may have fewer direct contact surfaces. In general, when the term "embedded" is used in this disclosure, at least half of the surface area of the microstructure will be in close thermal contact with the substrate.

Figure 1:
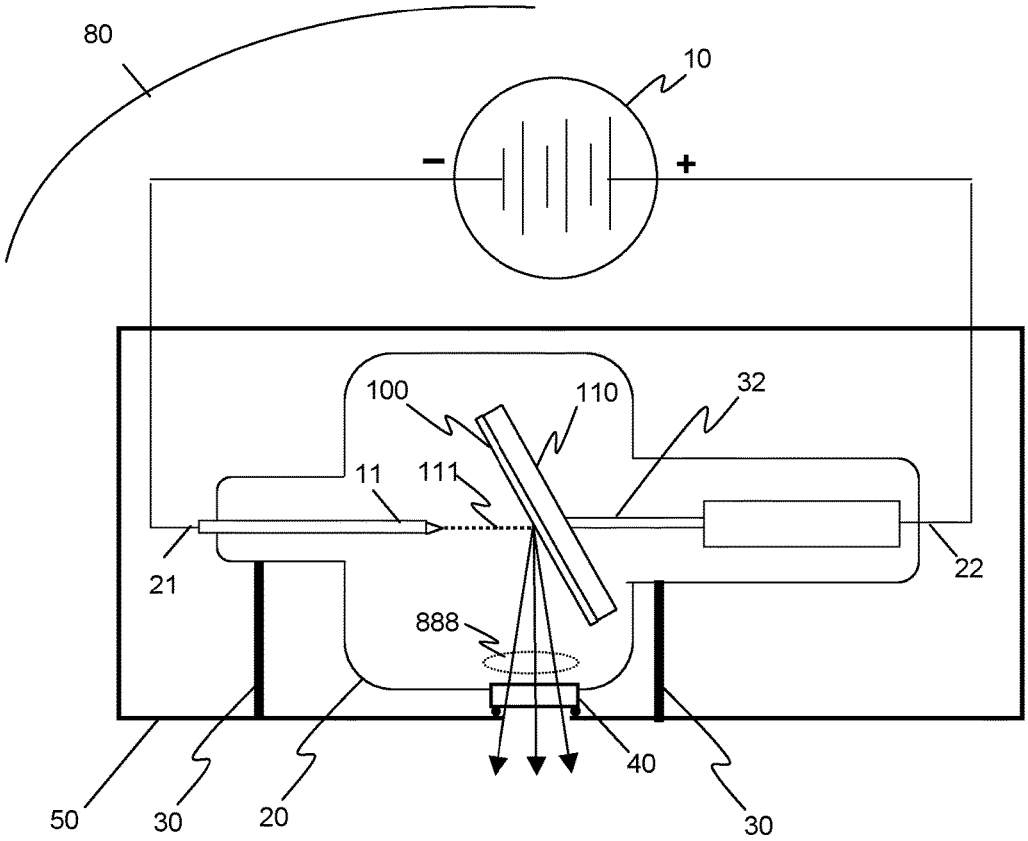
FIG. 1 Prior Art
FIG. 1 illustrates a schematic cross-section diagram of a standard prior art reflection x-ray source.
Figure 5A:
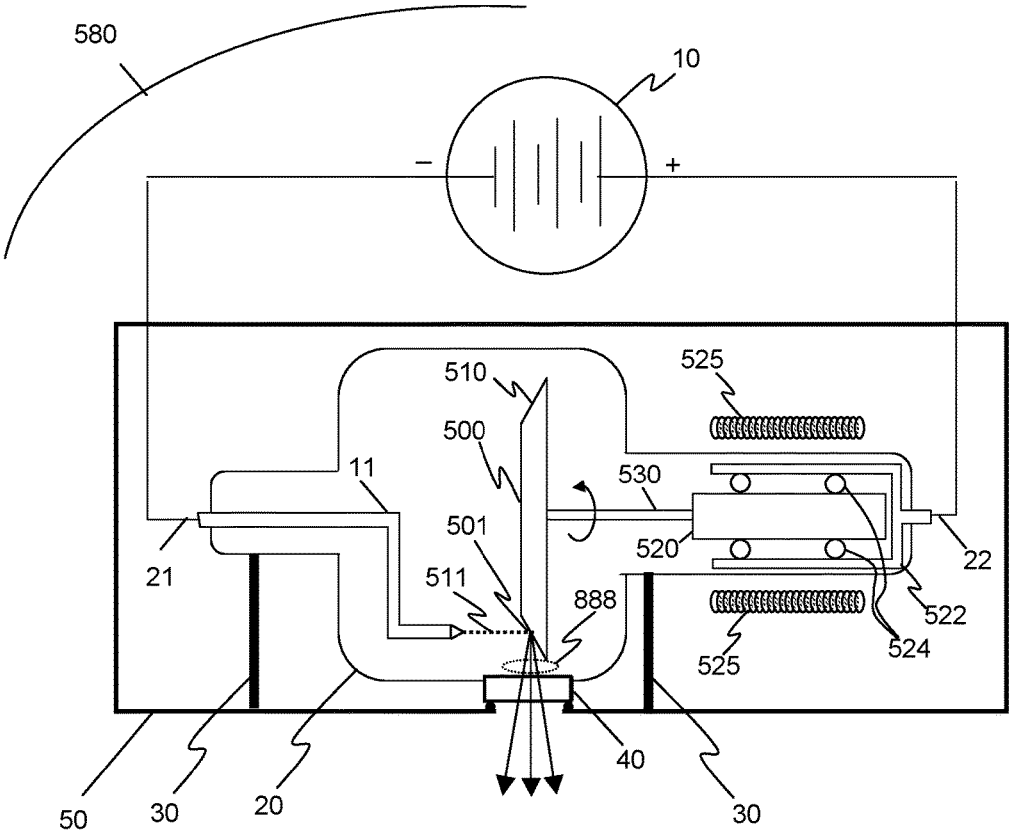
FIG. 5A illustrates a schematic cross-section view of a prior art rotating anode x-ray source.
Figure 5B:
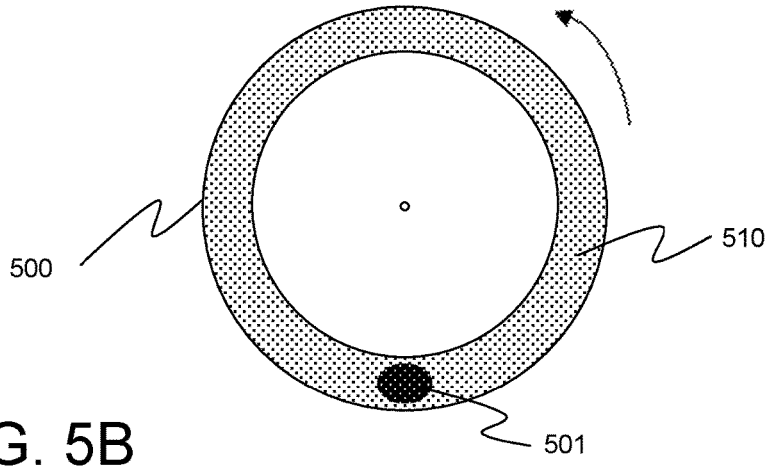
FIG. 5B Prior Art
FIG. 5B illustrates a top view of the anode for the rotating anode system of FIG. 5A.

A target 1100 according to the invention may be inserted as the target in a reflecting x-ray source geometry (e.g. FIG. 1), or adapted for use as the target used in the rotating anode x-ray source of FIGS. 5A and 5B.

It should be noted that the word "microstructure" in this application will only be used for structures comprising materials selected for their x-ray generating properties. It should also be noted that, although the word "microstructure" is used, x-ray generating structures with dimensions smaller than the micrometer scale, or even as small as nano-scale dimensions (i.e. greater than 10 nm) may also be described by the word "microstructures" as used herein.

The microstructures may be placed in any number of relative positions throughout the substrate 1000. In some embodiments, as illustrated in FIG. 7, the target 1100 comprises a recessed shelf 1002. This allows the region 1001 comprising an array of microstructures 700 to be positioned flush with, or close to, a recessed edge 1003 of the substrate, and produce x-rays at or near zero angle without being reabsorbed by the substrate 1000, while providing a more symmetric heat sink for the heat generated when exposed to electrons 111. Some other embodiments may preferably have the microstructures placed near the edge of the substrate to minimize self-absorption.

Figure 8:
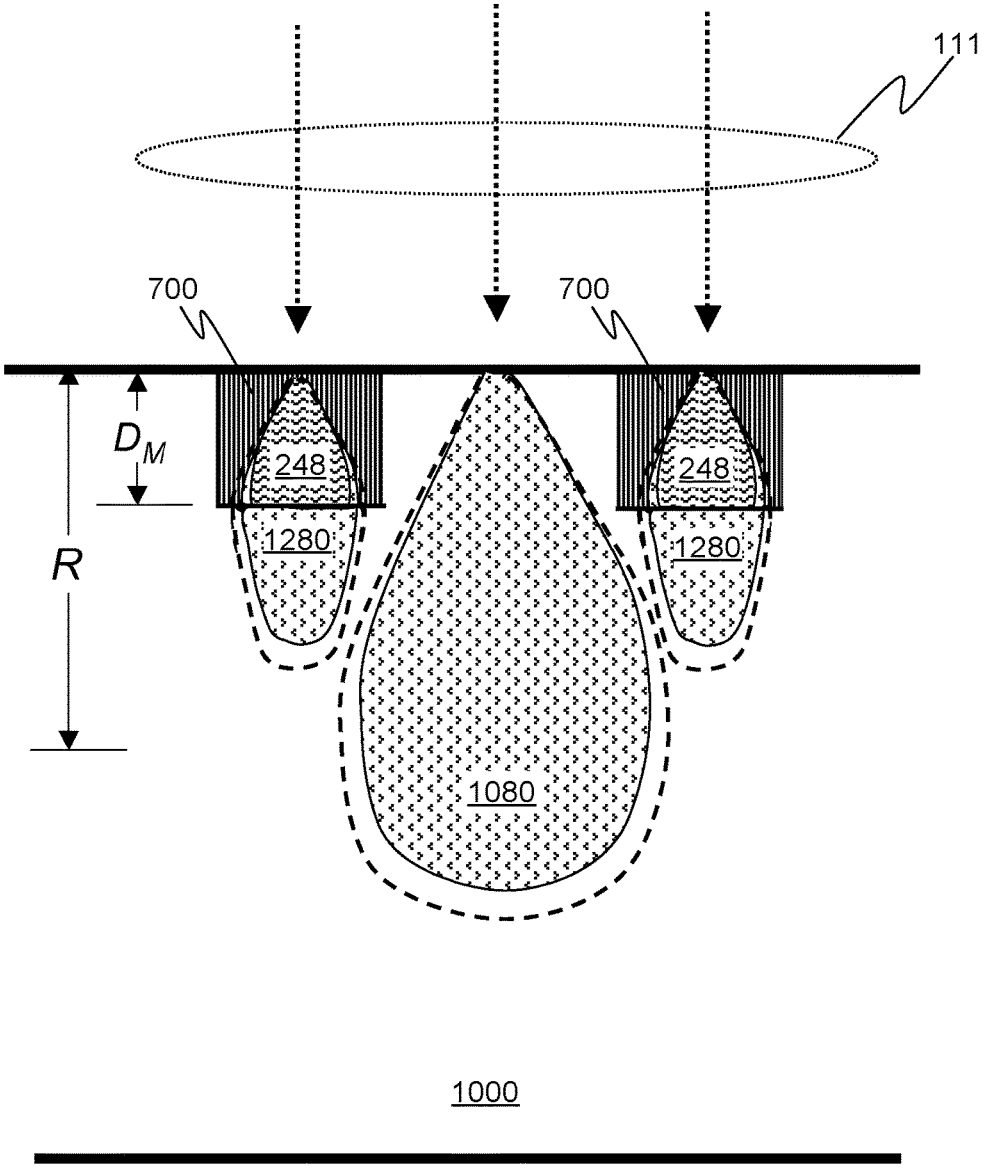
FIG. 8 illustrates a cross-section view of electrons entering a target comprising target microstructures on a larger substrate that may be used in some embodiments of the invention.

FIG. 8 illustrates the relative interaction between a beam of electrons 111 and a target comprising a substrate 1000 and microstructures 700 of x-ray generating material. Three electron interaction volumes are illustrated, with two representing electrons bombarding the two shown microstructures 700, and one representing electrons interacting with the substrate.

As discussed in Eqn. 1 above, the depth of penetration can be estimated by Potts' Law. Using this formula, Table II illustrates some of the estimated penetration depths for some common x-ray target materials.

For the illustration in FIG. 8, if 60 keV electrons are used, and diamond (Z=6) is selected as the material for the substrate 1000 and copper (Z=29) is selected as the x-ray generating material for the microstructures 700, the dimension marked as R to the left side of FIG. 8 corresponds to a reference dimension of 10 microns, and the geometric depth $D_M$ of the x-ray generating material, which, when set to be ⅔ (66%) of the electron penetration depth for copper, becomes $D_M \approx 3.5$ ◦ m.

TABLE II

Estimates of penetration depth for 60 keV electrons into some materials.

| Material | Z | Density (g/cm$^3$) | Penetration Depth (◦ m) |
|---|---|---|---|
| Diamond | 6 | 3.5 | 13.28 |
| Copper | 29 | 8.96 | 5.19 |
| Molybdenum | 42 | 10.28 | 4.52 |
| Tungsten | 74 | 19.25 | 2.41 |

The majority of characteristic Cu K x-rays are generated within depth $D_M$. The electron interactions below that depth are less efficient at generating characteristic Cu K-line x-rays but will contribute to heat generation. It is therefore preferable in some embodiments to set a maximum thickness for the microstructures in the target in order to optimize local thermal gradients. Some embodiments of the invention limit the depth of the microstructured x-ray generating material in the target to between one third and two thirds of the electron penetration depth of the x-ray generating material at the incident electron energy, while others may similarly limit based on the electron penetration depth with respect to the substrate material. For similar reasons, selecting the depth $D_M$ to be less than the electron penetration depth is also generally preferred for efficient generation of bremsstrahlung radiation.

Note: Other choices for the dimensions of the x-ray generating material may also be used. In targets as used in some embodiments of the invention, the depth of the x-ray generating material may be selected to be 50% of the electron penetration depth of either the x-ray generating material or the substrate material. In other embodiments, the depth $D_M$ for the microstructures may be selected related to the "continuous slowing down approximation" (CSDA) range for electrons in the material. Other depths may be specified depending on the x-ray spectrum desired and the properties of the selected x-ray generating material.

Note: In other targets as may be used in some embodiments of the invention, a particular ratio between the depth and the lateral dimensions (such as width $W_M$ and length $L_M$) of the x-ray generating material may also be specified. For example, if the depth is selected to be a particular dimension $D_M$, then the lateral dimensions $W_M$ and/or $L_M$ may be selected to be no more than $5 \times D_M$, giving a maximum ratio of 5. In other targets as may be used in some embodiments of the invention, the lateral dimensions $W_M$ and/or $L_M$ may be selected to be no more than $2 \times D_M$. It should also be noted that the depth $D_M$ and lateral dimensions $W_M$ and $L_M$ (for width and length of the x-ray generating microstructure) may be defined relative to the axis of incident electrons, with respect to the x-ray emission path, and/or with respect to the orientation of the surface normal of the x-ray generating material. For electrons incident at an angle, care must be taken to make sure the appropriate projections for electron penetration depth at an angle are used.

Figure 9:
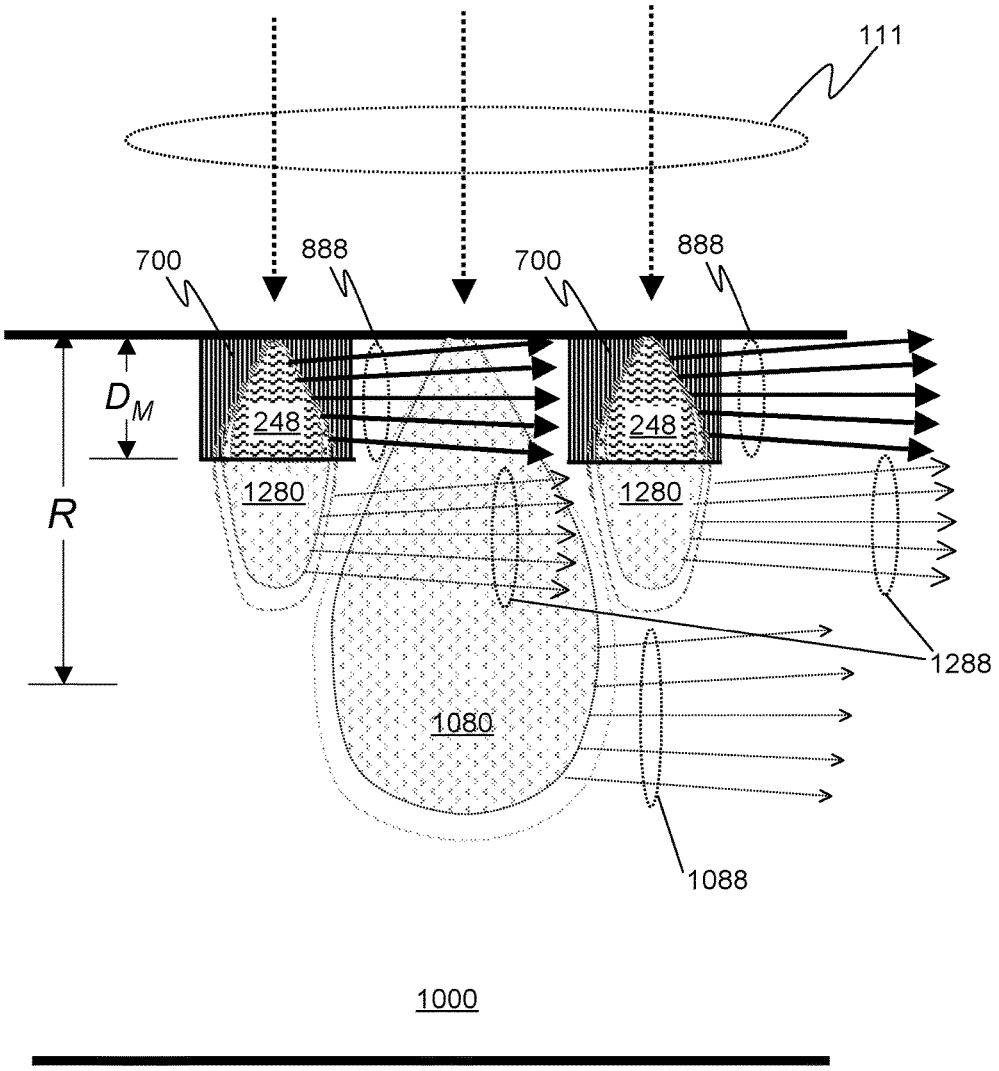
FIG. 9 illustrates a cross-section view of some of the x-rays radiated by the target of FIG. 8.

FIG. 9 illustrates the relative x-ray generation from the various regions shown in FIG. 8. X-rays 888 comprising characteristic x-rays are generated from the region 248 where electron collisions overlap the microstructures 700 of x-ray generating material, while the regions 1280 and 1080 where the electrons interact with the substrate generate characteristic x-rays of the substrate element(s). Additionally, continuum bremsstrahlung radiation x-rays radiated from the region 248 of the microstructures 700 of the x-ray generating material may be stronger than the x-rays 1088 and 1288 produced in the regions 1280 and 1080.

It should be noted that, although the illustration of FIG. 9 shows x-rays radiated only to the right, this is in anticipation of a window or collector being placed to the right.

It should also be noted that materials are relatively transparent to their own characteristic x-rays, so that FIG. 9 illustrates an arrangement that allows the linear accumulation of characteristic x-rays along the microstructures, and therefore can be used to produce a relatively strong characteristic x-ray beam. However, lower energy x-rays may be attenuated by the target materials, which will effectively act as an x-ray filter. Other selections of materials and geometric parameters may be chosen (e.g. a non-linear scheme) if continuum x-rays are desired, (e.g. for near edge or extended fine structure spectroscopy).

Up to this point, targets that are arranged in planar configurations have been presented. These are generally easier to implement, since equipment and process recipes for deposition, etching and other planar processing steps are well known from processing devices for microelectromechanical systems (MEMS) applications using planar diamond, and from processing silicon wafers for the semiconductor industry.

However, in some embodiments, a target with a surface with additional properties in three dimensions (3-D) may be desired. As discussed previously, when the electron beam is larger than the electron penetration depth, the apparent x-ray source size and area is at minimum (and brightness maximized) when viewed at a zero degree (0°) take-off angle.

The distance through which an x-ray beam will be reduced in intensity by 1/e is called the x-ray attenuation length, designated by $\mu_L$, and therefore, a configuration in which the generated x-rays pass through as little additional material as possible, with the distance selected to be related to the x-ray attenuation length, may be desired.

Figure 10:
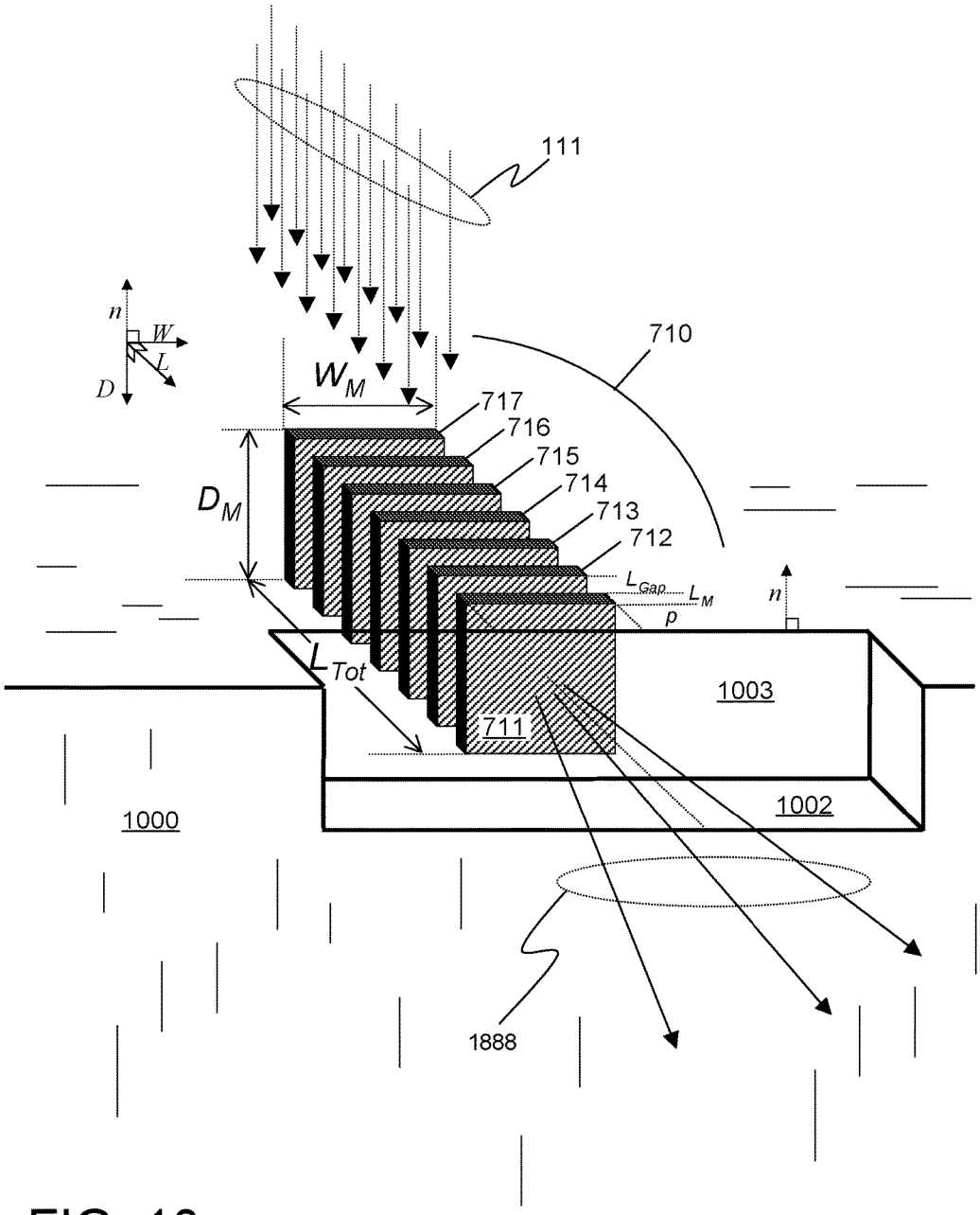
FIG. 10 illustrates a perspective view of a target comprising multiple rectangular microstructures arranged in a linear array on a substrate with a recessed region that may be used in some embodiments of the invention.

An illustration of a portion of a target as may be used in some embodiments of the invention is presented in FIG. 10. In this target, an x-ray generating region 710 with seven microstructures 711, 712, 713, 714, 715, 716, 717 is configured near a recessed edge 1003 of the target substrate 1000 by a shelf 1002, similar to the situation illustrated in FIG. 7. As shown, the x-ray generating microstructures 711, 712, 713, 714, 715, 716, 717 are arranged in a linear array of x-ray generating right rectangular prisms embedded in the substrate 1000, and produce x-rays 1888 when bombarded with electrons 111.

The surface normal in the region of the microstructures 711-717 is designated by n, and the orthogonal length and width dimensions are defined to be in the plane perpendicular to the normal of said predetermined surface, while the depth dimension into the target is defined as parallel to the surface normal. The thickness $D_M$ of the microstructures 711-717 in the depth direction is selected to be between one third and two thirds of the electron penetration depth of the x-ray generating material at the incident electron energy for optimal thermal performance. The width $W_M$ of the microstructures 711-717 is selected to obtain a desired source size in the corresponding direction. As illustrated, $W_M \approx D_M$. As discussed previously, $W_M$ could also be substantially smaller or larger, depending on the shape and size of the source spot desired.

As illustrated, the length of each of the microstructures 711-717 is $L_M \approx W_M/10$, and the length of the separation between each pair of microstructures is a distance $L_{Gap} \approx 2 L_M$, making the total length of the region 710 comprising x-ray generating material $L_{Tot} = 7 \times L_M + 6 \times L_{Gap} \approx 19 \times L_M \approx 1.9 \times D_M$. In other embodiments, larger or smaller dimensions may also be used, depending on the amount of x-rays absorbed by the substrate and the relative thermal gradients that may be achieved between the specific materials of the x-ray generating microstructures 711-717 and the substrate 1000.

Likewise, the distance between the edge of the shelf and the edge of the x-ray generating material p as illustrated is $p \approx L_M$, but may be selected to be any value, from flush with the edge 1003 (p=0) to as much as 1 mm, depending on the x-ray reabsorption properties of the substrate material, the relative thermal properties, and the amount of heat expected to be generated when bombarded with electrons.

For a configuration such as shown in FIG. 10, the total length $L_{Tot}$ of the x-ray generating region 710 will commonly be about twice the linear attenuation length $\mu_L$ for x-rays in the x-ray generating material, but can be selected to be half to more than 4 times that distance.

The microstructures may be embedded in the substrate (as shown), but in some embodiments may they may also be partially embedded, or in other embodiments placed on top of the substrate.

The thermal benefits of a structured target such as that illustrated in FIG. 10 are presented in the U.S. Provisional Application 62/155,449, to which a parent application of this application claims the benefit of priority, and which has been incorporated by reference in this application in its entirety.

In the cited Provisional patent application, calculations therein for two targets are presented using the finite element modeling product Solidworks Simulation Professional.

The first target modeled has a uniform coating of copper 300 microns thick as the x-ray material, as is common in commercial x-ray targets. Simulation of bombardment of the copper layer with electrons over an ellipse 10 microns wide and 66 microns long predicts an increase in the temperature of the copper to over 700° C.

The second target, according to an embodiment of the invention, has 22 discrete structures of copper as the x-ray generating material, arranged in a one-dimensional array similar to that illustrated in FIG. 10. The microstructures of copper are embedded in diamond, and have an axis of orientation perpendicular to the surface normal of the target.

The length of each x-ray generating structure along the axis of the array $L_M$ is 1 micron, and elements are placed with a separation $L_{Gap}$ of 2 microns. The width of the elements in the direction perpendicular to the array axis $W_M$ is 10 microns, and depth perpendicular from the surface into the target $D_M$ is also 10 microns.

In the simulation, both targets are modeled as being bombarded with an electron beam that raises the temperature to the operating temperature of ~700° C. The uniform copper target reaches this temperature with an electron exposure of 16 Watts. However, in the case of the second, structured target, the copper reaches the operating temperature of ~700° C. with an exposure of 65 Watts—a level 4 times higher. Normalizing for the reduced copper volume still gives more than twice the power deposited into the copper regions. Moreover, electron energy deposition rates between the materials is much more substantial in the higher density Cu than in diamond, and is therefore predicted to generate at least twice the number of x-rays. This demonstrates the utility of embedding microstructures of x-ray generating material into a thermally conducting substrate, in spite of a reduction in the total amount of x-ray generating material.

Figure 11A:
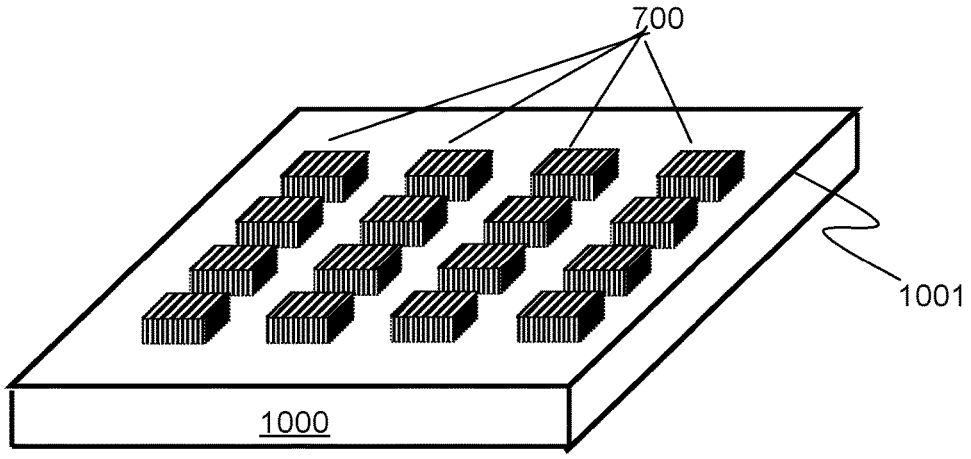
FIG. 11A illustrates a perspective view of a target comprising a grid of embedded rectangular target microstructures that may be used in some embodiments of the invention.
Figure 11B:
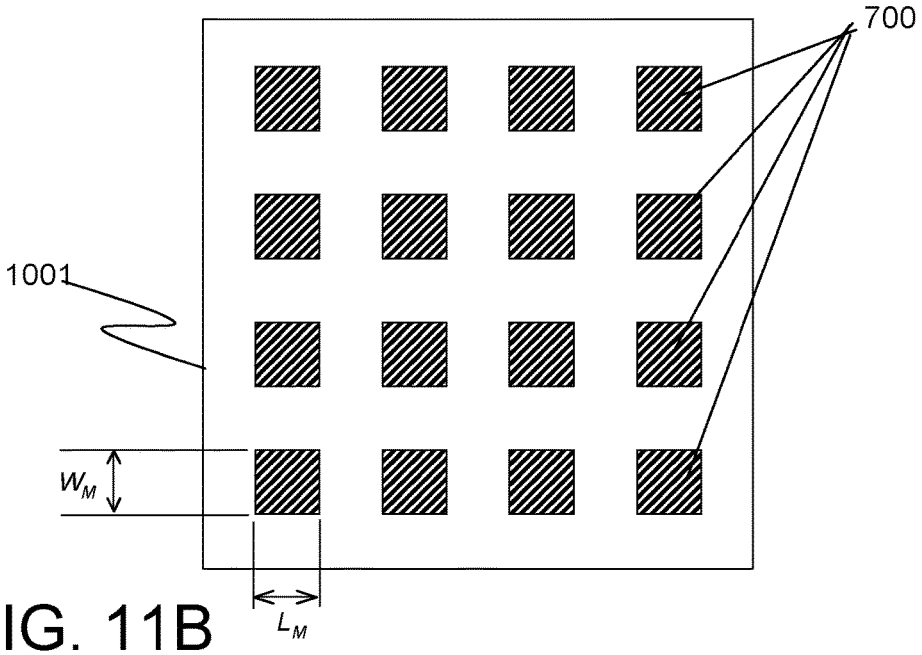
FIG. 11B illustrates a top view of the target of FIG. 11A.
Figure 11C:
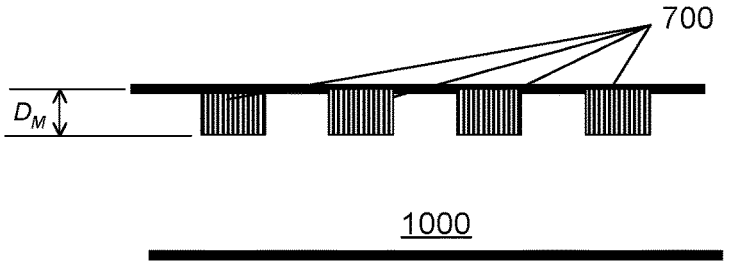
FIG. 11C illustrates a side/cross-section view of the target of FIGS. 11A and 11B.

FIGS. 11A-11C illustrate a region 1001 of a target as may be used in some embodiments of the invention that comprises an array of microstructures 700 in the form of right rectangular prisms comprising x-ray generating material arranged in a two-dimensional regular array. FIG. 11A presents a perspective view of the sixteen microstructures 700 for this target, while FIG. 11B illustrates a top down view of the same region, and FIG. 11C presents a side/cross-section view of the same region.

For a structure comprising the microstructures embedded in the substrate with a side/cross-section view as shown in FIG. 11C with depth $D_M$ and lateral dimensions in the plane of the substrate of $W_M$ and $L_M$, the ratio of the total surface area in contact with the substrate for the embedded microstructures vs. deposited microstructures is $$\frac{A_{Embedded}}{A_{Deposited}} = 1 + 2D_M \frac{(W_M + L_M)}{(W_M \times L_M)} \quad \text{[Eqn. 2]}$$

With a small value for $D_M$ relative to $W_M$ and $L_M$, the ratio is essentially 1. For larger thicknesses, the ratio becomes larger, and for a cube ($D_M = W_M = L_M$) in which 5 equal sides are in thermal contact, the ratio is 5. If an overcoat or cap layer of a material with similar properties as the substrate in terms of mass density and thermal conductivity is used, the ratio may be increased to 6.

Figure 12:
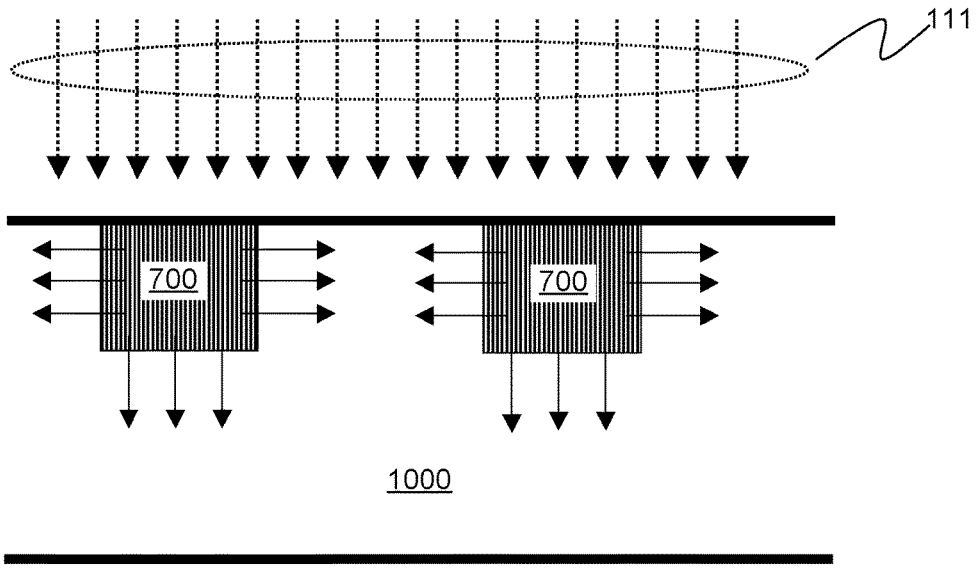
FIG. 12 illustrates a cross-section view of a portion of the target of FIGS. 11A-11C, showing thermal transfer to a thermally conducting substrate under electron beam exposure.

The heat transfer is illustrated with representative arrows in FIG. 12, in which the heat generated in microstructures 700 embedded in a substrate 1000 is conducted out of the microstructures 700 through the bottom and sides (arrows for transfer through the sides out of the plane of the drawing are not shown). The amount of heat transferred per unit time conducted through a material of area A and thickness d increases with the temperature gradient, the thermal conductivity in W/(m ° C.), and the surface area through which heat is transferred. Embedding the microstructures in a substrate of high thermal conductivity increases all these factors.

Figure 13:
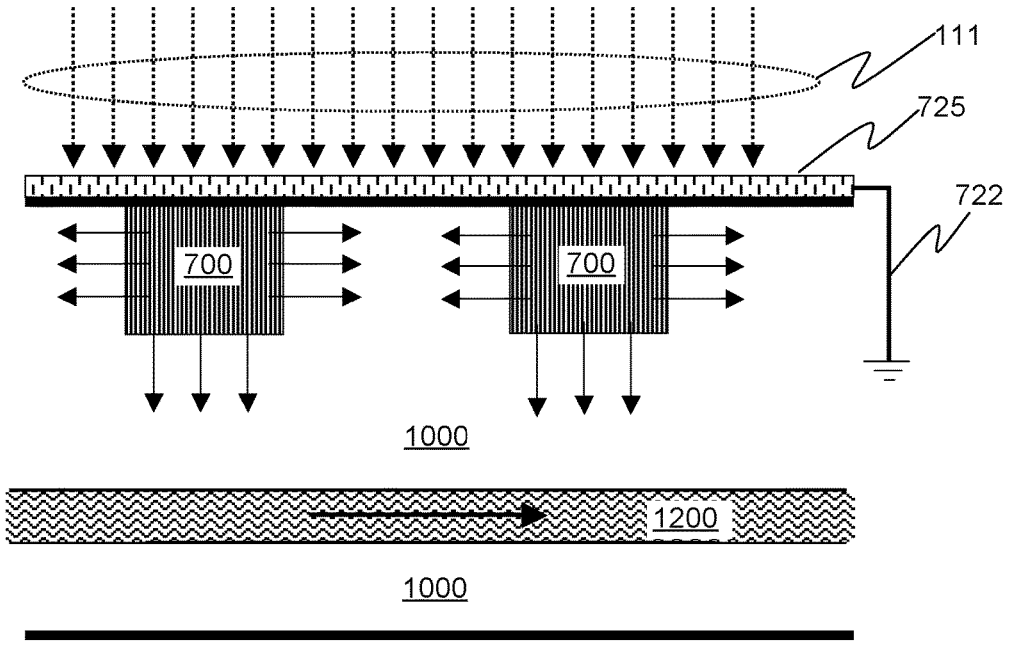
FIG. 13 illustrates a cross-section view of a target as shown in of FIG. 12 having an additional overcoat and a cooling channel.

FIG. 13 illustrates an alternative embodiment in which an overcoat has been added to the surface of the target. This overcoat 725 may be an electrically conducting layer, providing a return path to ground for the electrons bombarding the target. For such embodiments, the thin layer of conducting material that is preferably of relatively low atomic number, such as Titanium (Ti) is used. Other conducting materials, such as silver (Ag), copper (Cu), gold (Au), tungsten (W), aluminum (Al), beryllium (Be), carbon (C), graphene, or chromium (Cr) may be used to allow electrical conduction from the discrete microstructures 700 to an electrical path 722 that connects to a positive terminal relative to the high voltage supply. Such overcoats are typically thin films, with thickness on the order of 5 to 50 nm.

In other embodiments, this overcoat 725 may comprise a material selected for its thermal conductivity. In some embodiments, this overcoat 725 may be a layer of diamond, deposited by chemical vapor deposition (CVD). This allows heat to be conducted away from all sides of the microstructure. It may also provide a protective layer, preventing x-ray generating material from subliming away from the target during extended or prolonged use. Such protective overcoats typically have thicknesses on the order of 0.2 to 5 microns. Such a protective overcoat may also be deposited using an additional dopant to provide electrical conductivity as well. In some embodiments, two distinct layers, one to provide electrical conductivity, the other to provide thermal conductivity and/or encapsulation, may be used. In some embodiments, overcoats may comprise beryllium, diamond, polycrystalline diamond, CVD diamond, diamond-like carbon, graphite, silicon, boron nitride, silicon carbide and sapphire.

In other embodiments the substrate may additionally comprise a cooling channel 1200, as also illustrated in FIG. 13. Such cooling channels may be a prior art cooling channel using flowing water or some other cooling fluid to conduct heat away from the substrate, or may be fabricated according to a design adapted to best remove heat from the regions near the embedded microstructures 700.

Other configurations that may be used in embodiments of the invention, such as a checkerboard array of microstructures, a non-planar "staircase" substrate and various non-uniform shapes of x-ray generating elements, have been described in the above cited parent applications of the present application, U.S. patent application Ser. Nos. 14/490,672 and 14/999,147. Additional target configurations presented in U.S. patent application Ser. No. 14/465,816 are microstructures comprising multiple x-ray generating materials, microstructures comprising alloys of x-ray generating materials, microstructures deposited with an anti-diffusion layer or an adhesion layer, microstructures with a thermally conducting overcoat, microstructures with a thermally conducting and electrically conducting overcoat, microstructured buried within a substrate and the like.

Other target configurations that may be used in embodiments of the invention, as has been described in the above cited U.S. patent application Ser. No. 14/465,816, are arrays of microstructures that may comprise any number of conventional x-ray target materials patterned as features of micron scale dimensions on or embedded in a thermally conducting substrate, such as diamond or sapphire. In some embodiments, the microstructures may alternatively comprise unconventional x-ray target materials, such as tin (Sn), sulfur (S), titanium (Ti), antimony (Sb), etc. that have thus far been limited in their use due to poor thermal properties.

Other target configurations that may be used in embodiments of the invention, as has been described in the above cited U.S. patent application Ser. No. 14/465,816, are arrays of microstructures that take any number of geometric shapes, such as cubes, rectangular blocks, regular prisms, right rectangular prisms, trapezoidal prisms, spheres, ovoids, barrel shaped objects, cylinders, triangular prisms, pyramids, tetrahedra, or other particularly designed shapes, including those with surface textures or structures that enhance surface area, to best generate x-rays of high brightness and that also efficiently disperse heat.

Other target configurations that may be used in embodiments of the invention, as has been described in the above cited U.S. patent application Ser. No. 14/465,816, are arrays of microstructures comprising various materials as the x-ray generating materials, including aluminum, titanium, vanadium, chromium, manganese, iron, cobalt, nickel, copper, gallium, zinc, yttrium, zirconium, molybdenum, niobium, ruthenium, rhenium, rhodium, palladium, silver, tin, iridium, tantalum, tungsten, indium, cesium, barium, germanium, gold, platinum, lead and combinations and alloys thereof.

The embodiments described so far include a variety of x-ray target configurations that comprise a plurality of microstructures comprising x-ray generating material that can be used as targets in x-ray sources to generate x-rays with increased brightness.

2. Generic Considerations for a Linear Accumulation X-Ray Source

Figure 14:
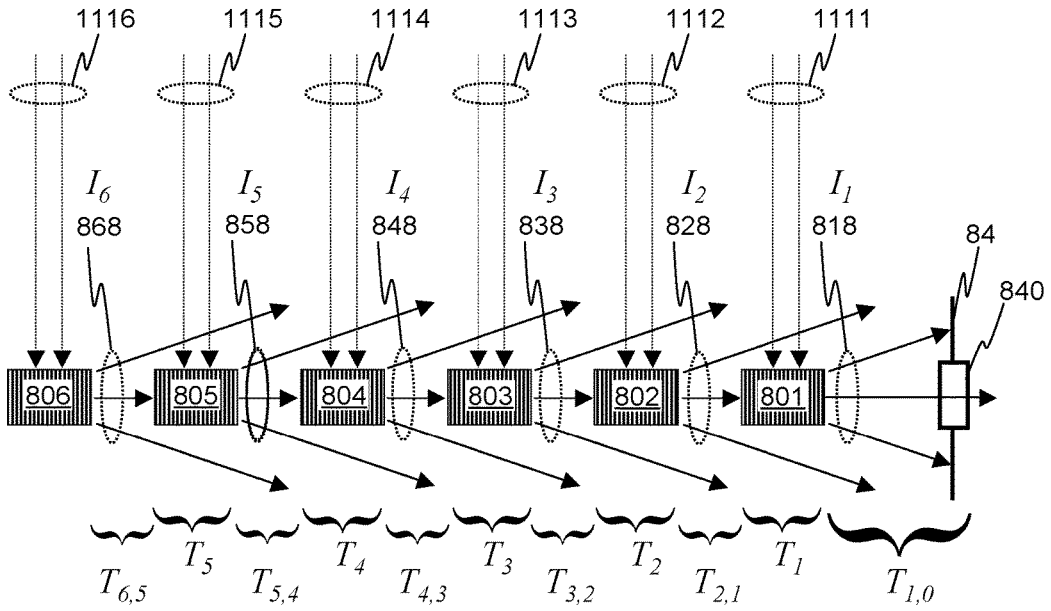
FIG. 14 illustrates a collection of x-ray emitters arranged in a linear array to produce linear accumulation as may be used in some embodiments of the invention.

FIG. 14 illustrates a collection of x-ray sub-sources arranged in a linear array. The long axis of the linear array runs from left to right in the figure, while the short axis would run in and out of the plane of the figure. Several x-ray generating elements 801, 802, 803, 804 . . . etc. comprising one or more x-ray generating materials are bombarded by beams of electrons 1111, 1112, 1113, 1114, . . . etc. at high voltage (anywhere from 1 to 250 keV), and form sub-sources that produce x-rays 818, 828, 838, 848, . . . etc. Although the x-rays tend to be radiated isotropically, this analysis is for a view along the axis down the center of the linear array of sub-sources, where a screen 84 with an aperture 840 has been positioned.

It should be noted that, as drawn in FIG. 14, the aperture allows the accumulated zero-angle x-rays to emerge from the source, but in practice, an aperture which allows several degrees of x-rays radiated at ±3° or even at ±6° to the surface normal may be designed for use in some applications. It is generally preferred that the window be at normal or near normal incidence to the long axis of a linear array, but in some embodiments, a window tilted to an angle as large as 85° may be useful.

Assuming the ith sub-source **80*i* produces x-rays 8*i*8 along the axis to the right in FIG. 14**, the radiation for the right-most sub-source as illustrated simply propagates to the right through free space. However, the x-rays from the other sub-sources are attenuated through absorption, scattering, or other loss mechanisms encountered while passing through whatever material lies between sub-sources, and also by divergence from the propagation axis and by losses encountered by passage through the neighboring sub-source(s) as well.

Using the definitions:

$I_i$ as the x-ray radiation intensity **8*i*8 from the ith sub-source 80*i*;**

$T_{1,0}$ as the x-ray transmission factor for propagation to the right of the 1st sub-source 801;

$T_{i,i-1}$ as the x-ray transmission factor for propagation from the ith sub-source **80*i* to the i-1-th sub-source 80**(*i*-1); and $T_i$ as the x-ray transmission factor for propagation through the ith sub-source **80*i*** (with $T_0 \equiv 1$), the total intensity of x-rays on-axis to the right of the array of N sub-sources can be expressed as:

$$I_{tot} = I_1 \times T_{1,0} + I_2 \times T_{2,1} \times T_1 \times T_{1,0} + I_3 \times T_{3,2} \times T_2 \times T_{2,1} \times T_1 \times T_{1,0} + I_4 \times T_{4,3} \times T_3 \times T_{3,2} \times T_2 \times T_{2,1} \times T_1 \times T_{1,0} + \ldots + I_N \times T_{N,N-1} \times T_{N-1} \times T_{N-1,N-2} \times \ldots \times T_2 \times T_{2,1} \times T_1 \times T_{1,0} \quad \text{[Eqn. 3]}$$

making $$I_{tot} = \sum_{i=1}^{N} I_i \prod_{j=0}^{i-1} T_j \prod_{k=0}^{i-1} T_{k+1,k} \quad \text{[Eqn. 4]}$$

For a source design in which all sub-sources produce approximately the same intensity of x-rays $$I_i \approx I_0 \quad \text{[Eqn. 5]}$$

the total intensity becomes $$I_{tot} = I_0 \sum_{i=1}^{N} \prod_{j=0}^{i-1} T_j \prod_{k=0}^{i-1} T_{k+1,k} \quad \text{[Eqn. 6]}$$

Furthermore, if the sub-sources are arranged in a regular array with essentially the same value for transmission between elements:

$$T_{a,a-1} = T_{2,1}, a > 1, \quad \text{[Eqn. 7]}$$

and if the sizes and shapes of the x-ray generating elements are similar enough such that the transmission through any given element will also be the same:

$$T_a = T_1, a > 0, \quad \text{[Eqn. 8]}$$

then the total intensity becomes $$I_{tot} = I_0 T_{1,0} \left( \sum_{n=0}^{N-1} (T_1 T_{2,1})^n \right) \quad \text{[Eqn. 9]}$$

Note that $T_i$ and $T_{i,i-1}$ represent a reduction in transmission due to losses, and therefore always have values between 0 and 1. If N is large, the sum on the right can be approximated by the geometric series $$\frac{1}{(1-x)} = \sum_{0}^{\infty} x^n \text{ for } |x| < 1 \quad \text{[Eqn. 10]}$$

making the approximate intensity $$I_{tot} \approx I_0 T_{1,0} \frac{1}{(1 - T_1 T_{2,1})} \quad \text{[Eqn. 11]}$$

Note that this can also be used to estimate how many generating elements can be arranged in a row before losses and attenuation would make the addition of another x-ray generating element unproductive. For example, if the width of a generating element is $m_L$, the 1/e attenuation length for x-rays, transmission through the element gives $T_1 = 1/e = 0.3679$. Assuming a transmission between elements of $T_{i,i-1} = T_{2,1} = 0.98$, this makes $$I_{tot} \approx I_0 T_{1,0} \frac{1}{(1 - (0.3679)(0.98))} = I_0 T_{1,0} (1.564) \quad \text{[Eqn. 12]}$$

This means that a large number of elements with a width equal to the 1/e length could only improve the intensity by a factor of 1.564. For 2 elements (a total x-ray generation length of $2 \times m_L$), Eqn. 9 indicates that $I_{tot} \approx I_0 T_{1,0}$ (1.361), 87% of the estimated maximum from Eqn. 12, while for 3 elements (a total x-ray generation length of $3 \times m_L$), $I_{tot} \approx I_0 T_{1,0}$ (1.490), 95% of the estimated maximum, and for 4 elements (a total x-ray generation length of $4 \times m_L$), $I_{tot} \approx I_0 T_{1,0}$ (1.537), which is 98% of the estimated maximum degree of linear accumulation from Eqn. 12. This suggests a general rule that linear accumulation near the maximum may be achieved from a total length of x-ray generating material of only $4 \times m_L$.

Figure 15:
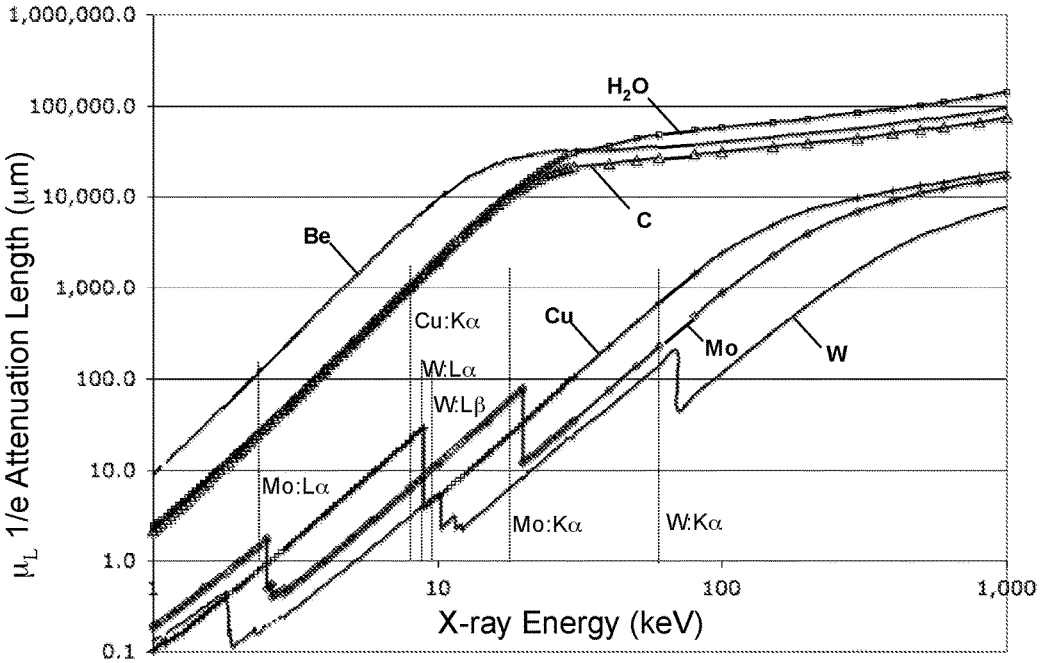
FIG. 15 illustrates a plot of the 1/e attenuation length for several materials for x-rays

FIG. 15 illustrates the 1/e attenuation length for x-rays having energies ranging from 1 keV to 1000 keV for three x-ray generating materials: molybdenum (Mo), copper (Cu), tungsten (W); and from 10 keV to 1000 keV for three substrate materials: graphite (C), beryllium (Be) and water ($H_2O$). [The data presented here were originally published by B. L. Henke, E. M. Gullikson, and J. C. Davis, in "X-ray interactions: photoabsorption, scattering, transmission, and reflection at E=50-30000 eV, Z=1-92", Atomic Data and Nuclear Data Tables vol. 54 (no. 2), pp. 181-342 (July 1993), and may be also accessed at: henke.lbl.gov/optical_constants/atten2.html. Other x-ray absorption tables are available at physics.nist.gov/PhysRefData/XrayMassCoef/chap2.html.]

The 1/e attenuation length $\mu_L$ for a material is related to the transmission factors above for a length L by $$T_i = e^{-\alpha_i L} = e^{-L/\mu_L} \quad \text{[Eqn. 13]}$$

Therefore, a larger $\mu_L$ means a larger $T_i$.

As an example of using the values in FIG. 15, for 60 keV x-rays in tungsten, $\mu_L \approx 200$ ⍾ m, making the transmission of a 20 ⍾ m wide x-ray generating element $$T_i = e^{-L/\mu_L} = e^{-20/200} = 0.905 \quad \text{[Eqn. 14]}$$

For 60 keV x-rays in a beryllium substrate, $\mu_L = 50{,}000$ ⍾ m, which makes the transmission of a 100 ⍾ m wide beryllium gap between embedded tungsten x-ray generating elements to be:

$$T_{i,i-1} = = e^{-L/\mu_L} = e^{-100/50{,}000} = 0.998 \quad \text{[Eqn. 15]}$$

Therefore, for a periodic array of tungsten elements 20 μm wide embedded in a Beryllium substrate and spaced 100 ⍾ m apart, the best-case estimate for the on-axis intensity is:

$$I_{tot} \approx I_0 T_{1,0} \frac{1}{(1-(0.905)(0.998))} = I_0 T_{1,0}(10.312) \quad \text{[Eqn. 16]}$$

which would represent an increase in x-ray intensity by an order of magnitude when compared to a single tungsten x-ray generating element.

3. X-Ray Source Controls

There are several variables through which a generic linear accumulation source may be "tuned" or adjusted to improve the x-ray output. Embodiments of the invention may allow the control and adjustment of some, all, or none of these variables.

3.1. E-Beam Variations.

In some embodiments, the beam or beams of electrons 111 or 1111, 1112, 1113, etc. bombarding the x-ray generating elements 801, 802, 803 . . . etc. may be shaped and directed using one or more electron control mechanisms 70 such as electron optics, electrostatic lenses or magnetic focusing elements. Typically, electrostatic lenses are placed within the vacuum environment of the x-ray source, while the magnetic focusing elements can be placed outside the vacuum.

Figure 16:
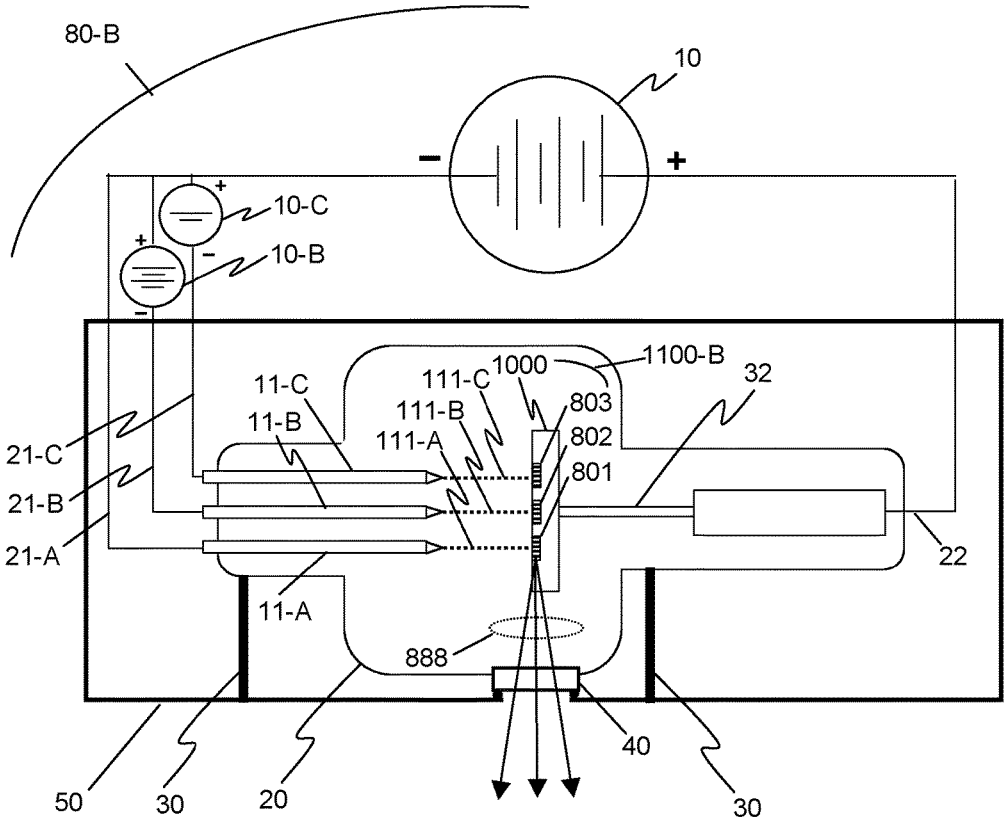
FIG. 16 illustrates a schematic cross-section view of an embodiment of an x-ray system according to the invention comprising multiple electron emitters.

In many embodiments, the area of electron exposure can be adjusted so that the electron beam or beams primarily bombard the x-ray generating elements and do not bombard the regions in between the elements. A source having multiple electron beams that are used to bombard distinct x-ray generating elements independently may also be configured to allow a different accelerating voltage to be used with the different electron beam sources. Such a source 80-B is illustrated in FIG. 16. In this illustration, the previous high voltage source 10 is again connected through a lead 21-A to an electron emitter 11-A that emits electrons 111-A towards a target 1100-B. However, two additional "boosters" for voltage 10-B and 10-C are also provided, and these higher voltage potentials are connected through leads 21-B and 21-C to additional electron emitters 11-B and 11-C that respectively emit electrons 111-B and 111-C of different energies. Although the target 1100-B will usually be uniformly set to the ground potential, the individual electron beam sources used to target the different x-ray generating elements may be set to different potentials, and electrons of varying energy may therefore be used to bombard the different x-ray generating elements 801, 802, 803, . . . etc.

This may offer advantages for x-ray radiation management, in that electrons of different energies may generate different x-ray radiation spectra, depending on the materials used in the individual x-ray generating elements. The heat load generated may also be managed through the use of different electron energies.

3.2. Material Variations.

Although it is simpler to treat the x-ray generating elements as identical units, and to have the intervening regions also be considered identical, there may be advantages in some embodiments to having variations in these parameters.

In some embodiments, the different x-ray generating elements may comprise different x-ray generating materials, so that the on-axis view presents a diverse spectrum of characteristic x-rays from the different materials. Materials that are relatively transparent to x-rays may be used in the position closest to the output window 840 (e.g. the element 801 furthest to the right in FIG. 14), while those that are more strongly absorbing may be used for elements on the other side of the array, so that they attenuate the other x-ray sub-sources less.

In some embodiments, the distance between the x-ray generating elements may be varied. For example, a larger space between elements may be used for elements that are expected to generate more heat under electron bombardment, while smaller gaps may be used if less heat is expected.

3.3. Rotating Anode Embodiments.

Figure 17A:
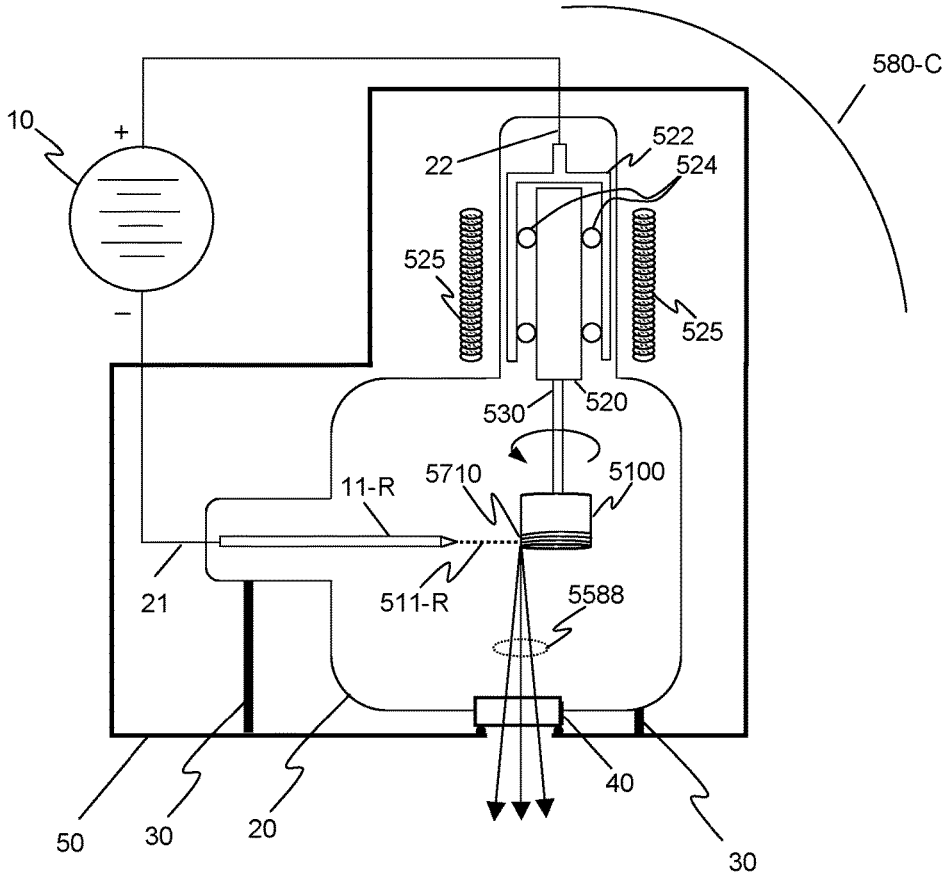
FIG. 17A illustrates a schematic cross-section view of an embodiment of the invention comprising a ring pattern of x-ray generating structures on a rotating anode.
Figure 17B:
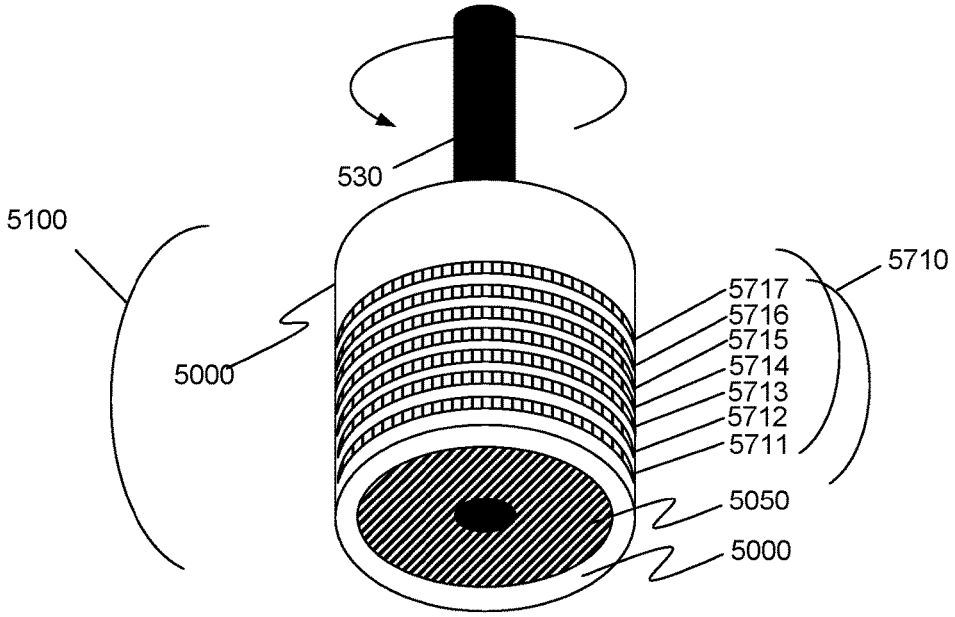
FIG. 17B illustrates a schematic perspective view of the rotating anode of the embodiment of FIG. 17A.
Figure 17C:
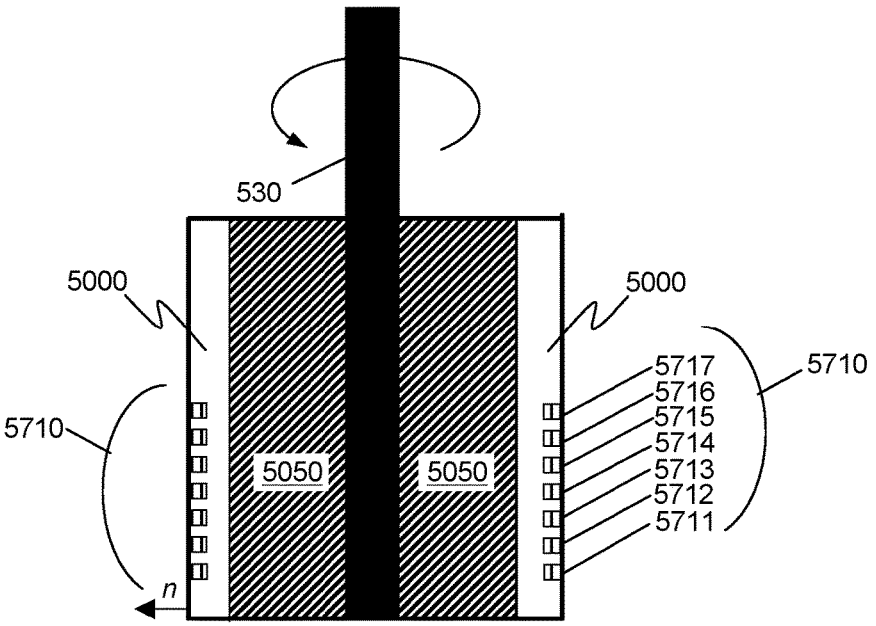
FIG. 17C illustrates a cross-section view of the rotating anode of the embodiment of FIG. 17A.

The target described above might also be used in an embodiment comprising a rotating anode, distributing the heat as the anode rotates. A system 580-C comprising these features is illustrated in FIGS. 17A-17C. In this embodiment, many of the elements are the same as in a conventional rotating anode system, as was illustrated in FIG. 5A, but in the embodiment as illustrated, the rotating mechanism has been rotated 90° relative to the electron beam emitter 11-R and the electron beam 511-R.

The target in the embodiment as illustrated is a rotating cylinder 5100 mounted on a shaft 530. In one end of the cylinder 5100, a set 5710 of rings of x-ray generating material 5711-5717 have been embedded into a layer of substrate material 5000, with a gap between each ring. The "length" (parallel to the shaft axis in this illustration, and perpendicular to the local normal n in the region under bombardment) of each ring may be comparable to the length discussed for the set of microstructures illustrated in FIG. 10 (i.e. micron-scale), and the spacing may be comparable to $L_{Gap}$. (also micron-scale). The depth (i.e. parallel to the local normal n) into the substrate 5000 may also be comparable to the depth discussed in the previous embodiments (i.e. micron scale, and related to either the penetration depth or the CSDA depth for either the x-ray generating material or the substrate.) The "width", however, is the circumference, as the rings 5710 circle the entire cylinder 5100.

This substrate material 5000 may in turn be attached or mounted on a core support 5050 attached to the rotating shaft 530. The core support may comprise any number of materials, but a core of an inexpensive material with high thermal conductivity, such as copper, may be preferred. A solid core/substrate combination that comprises a single material may also be used in some embodiments. The substrate 5000 may be deposited using a CVD process, or pre-fabricated and attached to the core support 5050.

When bombarded with an electron beam 511-R, the portions of the set of rings 5710 of x-ray generating materials that are exposed will generate heat and x-rays 5588. X-rays radiated at a zero-angle (perpendicular to a local surface normal for the target in the region under electron bombardment) or near zero-angle may experience linear accumulation, and appear exceptionally bright. Embedding the set of rings 5710 of x-ray generating material into the substrate 5000 facilitates the transfer of heat away from the x-ray generating structures, allowing higher electron flux to be used to generate more x-rays without causing damage to the structures, as has been demonstrated for the non-rotating case.

It should be noted that the illustrations of FIGS. 17A-17C are provided only to illustrate the functioning of an embodiment of the invention, and that the relative sizes, dimensions, and proportions of the rotating shaft 530, core support 5050, substrate 5000, and rings of x-ray generating material 5711-5717 should not be inferred from these drawings. The use of only seven rings in the illustration is also not meant to be limiting, as embodiments with any number of x-ray generating structures may be used.

In practical embodiments, the substrate thickness may range from a few microns to 200 microns, while the core may typically have a diameter of 2 cm to 20 cm. A cylinder in which the core and substrate are the same material may also be used in some embodiments. Various overcoats for electrical conduction and/or protection, as discussed for planar targets and illustrated in FIG. 13, may also be applied to embodiments having a rotating anode.

Figure 18:
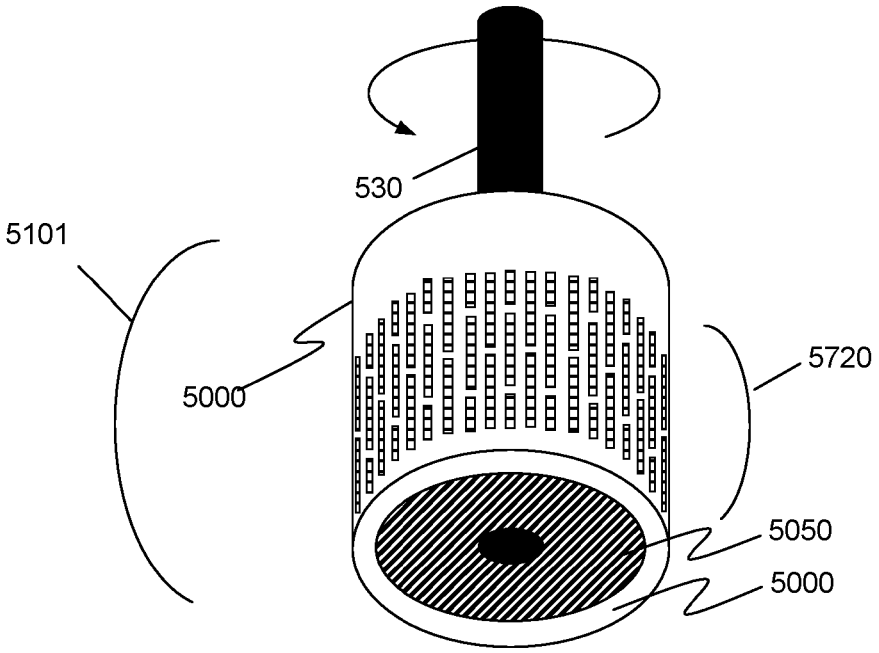
FIG. 18 illustrates a schematic perspective view of a portion of an embodiment of the invention comprising a line pattern of x-ray generating structures on a rotating anode.

Although only parallel rings with zero take-off angle have been illustrated in FIGS. 17A-17C, additional geometries for near-zero take-off angles, such as those using a beveled surface, may have advantages. Likewise, other configurations for the x-ray generating materials may be used. FIG. 18 illustrates a target cylinder 5101 for a rotating anode comprising a set of parallel lines 5720 that have an orientation perpendicular to that used for the rings of FIG. 17B. Other target designs, such as checkerboards, grids, etc. as have been illustrated U.S. Provisional Patent Application Ser. No. 62/141,847 (to which the Parent application of the Present application claims the benefit of priority) as well various designs and structures illustrated in other planar embodiments of the present application and the previously mentioned co-pending applications may be used. Furthermore, additional elements found in other embodiments described in the present application, such as focused electron beams and the like, different x-ray generating material selections and the like, the use of a powered x-ray generating material, etc., as well as those described the co-pending patent applications to which it claims priority, may also be applied to rotating anode embodiments.

3.4. Materials Selection for the Substrate.

For the substrate of a target with microstructures of x-ray generating material, as shown above it is preferred that the transmission of x-rays T for the substrate be near 1. For a substrate material of length L and linear absorption coefficient $\mu_s$, $$T=e^{-\alpha_s L}=e^{-L/\mu_L} \quad \text{[Eqn. 17]}$$

where $\mu_L$ is the length at which the x-ray intensity has dropped by a factor of 1/e.

Generally, $$\mu_L \propto X^3/Z^4 \quad \text{[Eqn. 18]}$$

where X is the x-ray energy in keV and Z is the atomic number. Therefore, to make $\mu_L$ large (i.e. make the material more transparent), higher x-ray energy is called for, and a lower atomic number is highly preferred. For this reason, both beryllium (Z=4) and carbon (Z=6) in its various forms (e.g. diamond, graphite, etc.) may be desirable as substrates, both because they are highly transparent to x-rays, but also because they have high thermal conductivity (see Table I).

4. Design Guidelines for Structured Targets

The embodiments of the invention disclosed in this application can be especially suitable for making a high brightness x-ray source for use at one or more predetermined low take-off angles. In some embodiments, the arrangement of discrete structures of x-ray generating material can be arranged to increase the x-ray radiation into a predetermined cone of angles around a predetermined take-off angle. Such a predetermined cone can be matched to the acceptance angles of a defined x-ray optical system to increase or maximize the useful x-ray intensity that may be delivered to a sample in applications such as XRD, XRF, SAXS, TXRF, especially, with microbeams, such as microXRD, microXRF, microSAXS, microXRD, etc. Examples of such an x-ray optical system is one having a monocapillary x-ray optical element with a defined inner reflective surface, such as a paraboloidal collimator or a dual paraboloidal or ellipsoidal focusing surface.

In other embodiments, the arrangement of discrete structures of x-ray generating material can be arranged to increase the x-ray radiation into a predetermined fan of angles around a predetermined take-off angle. Such a distribution of x-rays may be matched to other x-ray optical elements designed to produce x-ray beams with a line profile or collimated to form a parallel beam instead of a focused spot.

The design of the layout of the x-ray generating elements in the target can be optimized to increase the x-rays radiated in specific directions using two factors. One is the management of the thermal load, so that heat is efficiently transported away from the x-ray generating elements. With effective thermal transfer, the x-ray generating elements can be bombarded with an electron beam of even greater power density to produce more x-rays. The second is the distribution of the x-ray generating materials such that the self-absorption of x-rays propagating through the remaining volume of x-ray generating material is reduced and linear accumulation of x-rays is optimized.

4.1. An Example: Microstructured Target for a Conical X-Ray Beam

Figure 19A:
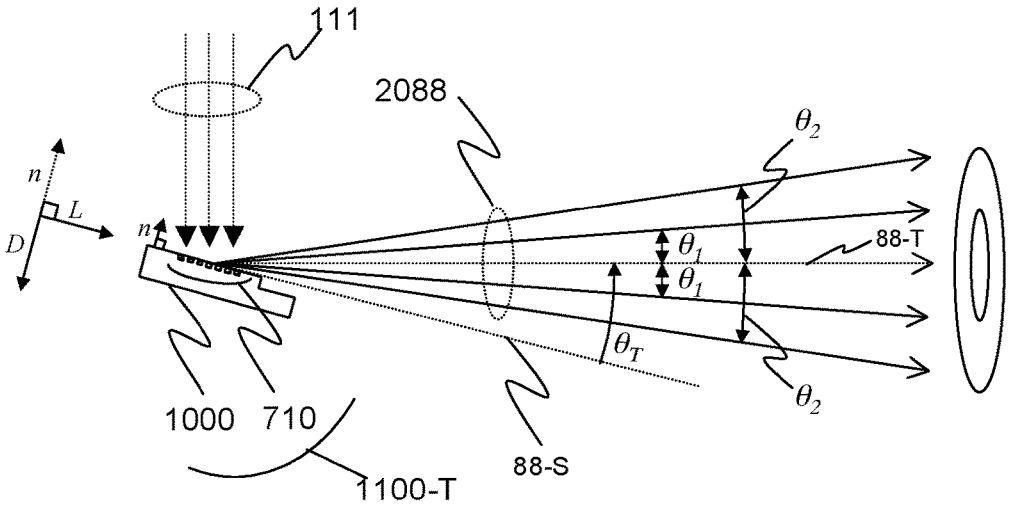
FIG. 19A illustrates a cross-section view of the x-ray generating portion of a source according to an embodiment of the invention.
Figure 19B:
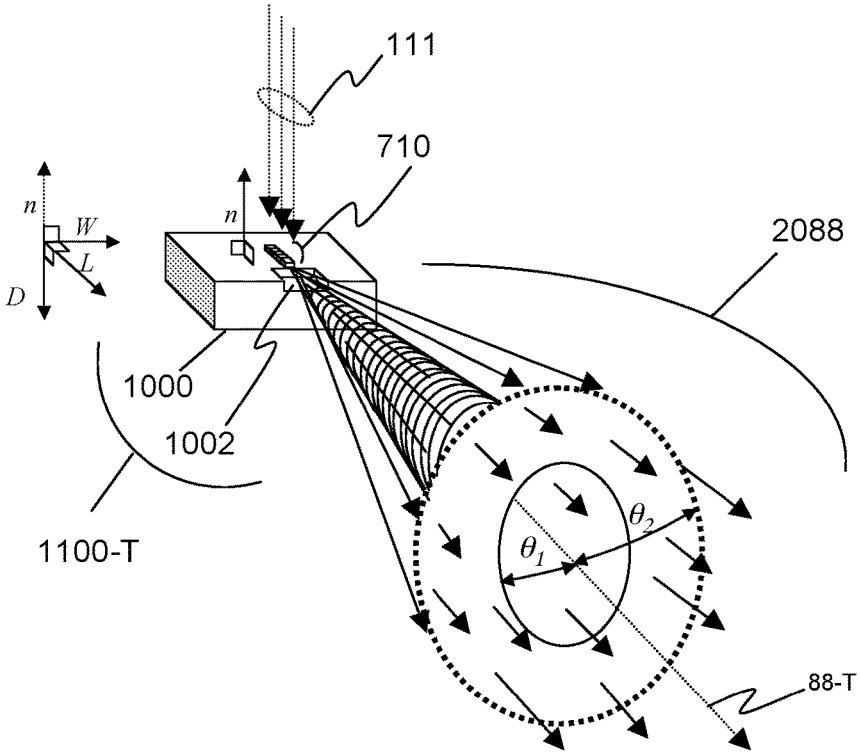
FIG. 19B illustrates a perspective view of the x-ray generating portion of the source illustrated in FIG. 19A.
Figure 19C:
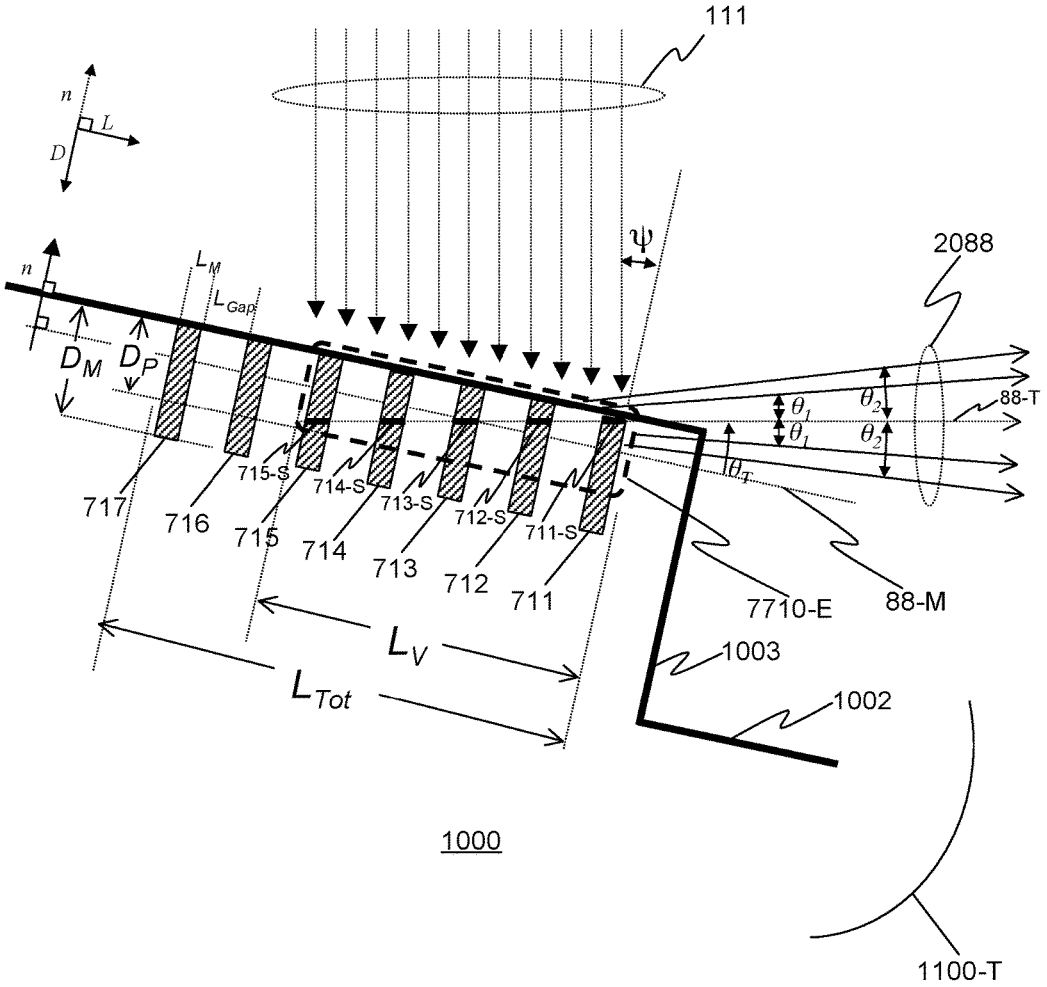
FIG. 19C illustrates detailed cross-section view of the x-ray generating portion of the source illustrated in FIG. 19A.

FIGS. 19A-19C illustrate an example of a target 1100-T comprising a set 710 of embedded microstructures of x-ray generating material 711, 712 . . . 717 embedded within a substrate 1000, similar to the target of FIG. 10. As illustrated, the microstructures 711-717 are embedded near a shelf 1002 at the edge 1003 of the surface of the substrate 1000. When bombarded by electrons 111 within a vacuum chamber, the x-ray generating material produces x-rays 2088.

For the target 1100-T as illustrated, there is a local surface in the area of the x-ray generating elements that has a surface normal n. This defines an axis for the dimension of depth D into the target for determining the depth of the x-ray generating materials. This axis is also used to measure the electron penetration depth or the electron continuous slowing down approximation depth (CSDA depth).

For the target as illustrated, there is furthermore a predetermined take-off direction (designated by ray 88-T) for the downstream formation of an x-ray beam. This take-off direction is oriented at an angle $\theta_T$ relative to the local surface, and the projection of this ray onto the local surface (designated by ray 88-S) in the plane that contains both the take-off angle and the surface normal is a determinant of the dimension of length L for the target. The final dimension of width W is defined as the third spatial dimension orthogonal to both the depth and the length directions.

As illustrated, the set of discrete structures of x-ray generating material is in the form of a linear array of x-ray generating microstructures, each of length $L_M$, width $W_M$, and depth $D_M$, the same as was that illustrated in FIG. 10. As illustrated, $W_M=D_M$, but in the general case, the width and depth need not be identical. In the target as illustrated in FIG. 19C, the microstructures are aligned along an axis parallel to the length L dimension, and are separated from each other by a gap $L_{Gap}$, so that the total length of the x-ray generating volume comprising 7 microstructures of x-ray generating material is $L_{Tot}=7\ L_M+6\ L_{Gap}$.

It should be noted that these dimensions of depth, length and width in a given target may or may not correspond to those that might be intuited merely from the layout of the discrete structures of x-ray generating material. As has already been illustrated, discrete structures of x-ray generating material may be laid out in 1-dimensional and 2-dimensional arrays, grids, checkerboards, staggered and buried structures, etc. and the alignment and relative orientation of these physical arrays and patterns with the predetermined take off angle and the surface normal may or may not be parallel. As defined in these embodiments, the coordinates of depth, length and width are defined only by the surface normal and the predetermined take-off angle.

As illustrated in FIG. 19A-19C, a predetermined set of cone angles is defined, centered around the take-off angle $\theta_T$. A ray propagating along the innermost portion of the cone makes an angle $\theta_1$ with respect to the take off angle, while a ray propagating along the outermost portion of the cone makes an angle $\theta_2$ with respect to the take off angle. These cone angles are generally quite small (less than 50 mrad), and the take-off angle is generally between 0° to 6° (0 to 105 mrad).

The actual design of the x-ray target may be more easily described using the concept of an "x-ray generating volume", as discussed further below. This is the volume of the target from which the substantial majority of the x-rays of a desired energy will be radiated. In the embodiments of the invention, there are four primary factors that may affect the design rules for the structure of x-ray generating material within the x-ray generating volume that may be applied in embodiments of the invention to improve the x-ray brightness radiated into this predetermined cone. These four factors are:

the volume fraction of x-ray generating material;

the relative thermal properties of the x-ray generating material and substrate;

the distance of propagation of the X-rays through x-ray generating material; and the depth of x-ray generation.

4.1.1. X-Ray Generating Volume.

The "x-ray generating volume" of a target comprising discrete structures of x-ray generating material is the volume of the target that, when bombarded with electrons, generates x-rays of a desired energy. The energy is typically specified as the characteristic x-ray radiation generated by specific transitions in the selected x-ray generating material, although for certain applications, spectral bandwidths of continuum x-rays from the x-ray generating material may also be designated.

Two "volumes" must be considered to define the "x-ray generating volume": a "geometric volume" encompassing the x-ray generating material, and the "electron excitation volume" encompassing the region in which electrons deliver enough energy to generate x-rays.

4.1.1A. Geometric Volume

The "geometric volume" for the x-ray generating material is defined as the minimum contiguous volume that completely encompasses a given set of discrete structures of x-ray generating material and the gaps between them.

Figure 20A:
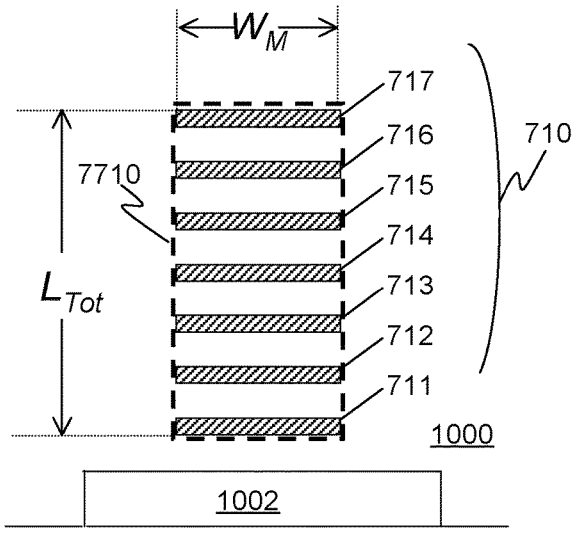
FIG. 20A illustrates a top-down view of the x-ray generating portion of a target used in the embodiment illustrated in FIGS. 19A-19C.
Figure 20B:
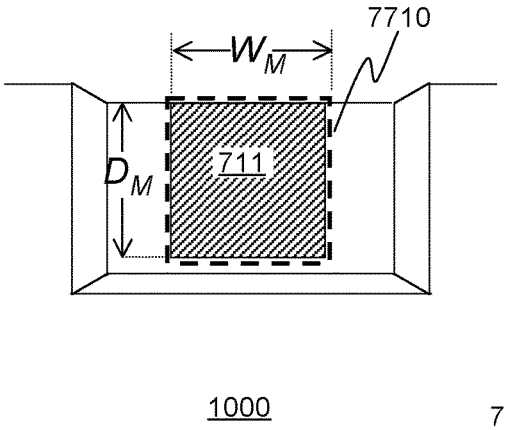
FIG. 20B illustrates an end view of the x-ray generating portion of a target used in the embodiment illustrated in FIGS. 19A-19C.
Figure 20C:
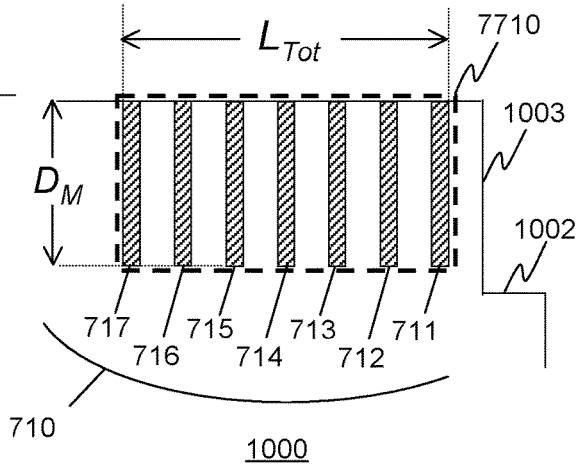
FIG. 20C illustrates a cross-section side view of the x-ray generating portion of a target used in the embodiment illustrated in FIGS. 19A-19C.

For the x-ray generating structures of FIGS. 19A-19C, also reproduced FIGS. 20A-20C, the "geometric volume" 7710 is a rectangle surrounding the microstructures of x-ray generating material.

Figure 21A:
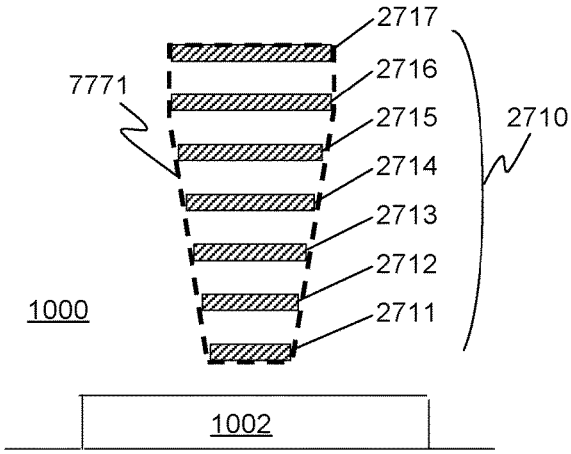
FIG. 21A illustrates a top-down view of the x-ray generating portion of a target having non-uniform x-ray generating structures.
Figure 21B:
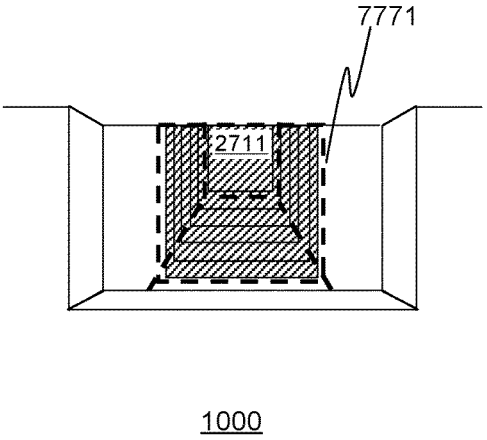
FIG. 21B illustrates an end view of the x-ray generating portion of the target of FIG. 21A.
Figure 21C:
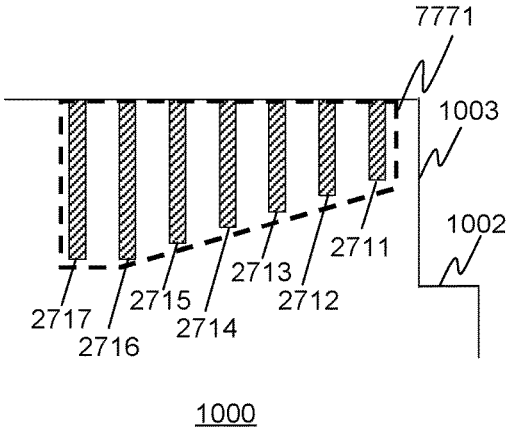
FIG. 21C illustrates a cross-section side view of the x-ray generating portion of the target of FIG. 21A.

For other configurations, such as those shown in FIG. 21A-21C, the "geometric volume" may be more complex. In this example, a set 2710 of non-uniform structures of x-ray generating material 2711, 2712 . . . 2717 are embedded within a substrate 1000, in which structures are tapered smaller as they approach the edge 1003 of the substrate. The "geometric volume" 7711 for this case is not a rectangle, but a tapered polyhedron having square ends of different sizes.

4.1.1B. Electron Excitation Volume.

The "electron excitation volume" is the volume of the target in which electrons deliver enough energy to generate x-rays of a predetermined desired energy.

Figure 22A:
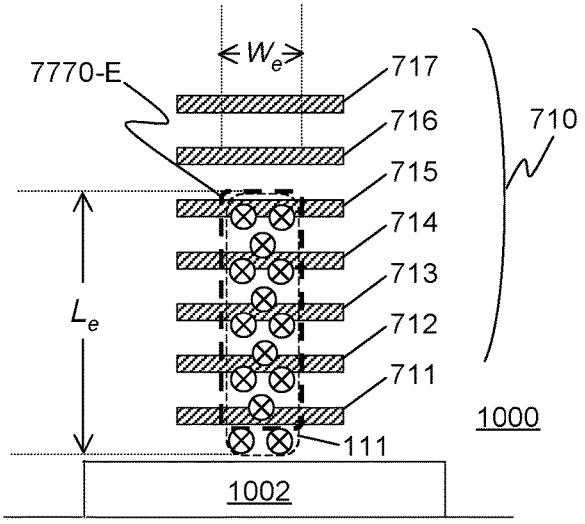
FIG. 22A illustrates a top-down view of the x-ray generating portion of the target used in the embodiment illustrated in FIGS. 19A-19C under electron bombardment.
Figure 22B:
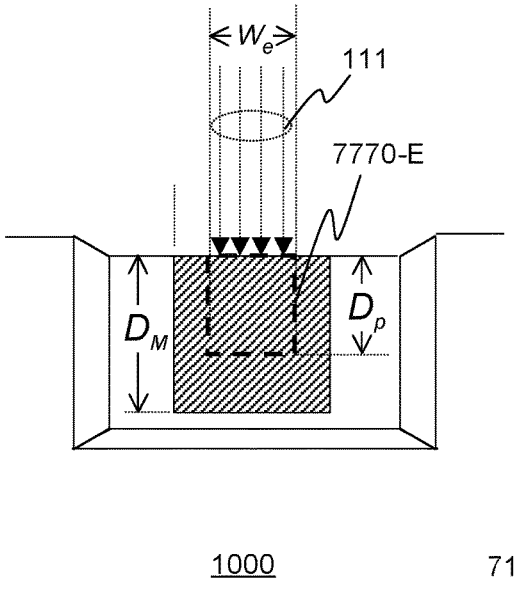
FIG. 22B illustrates an end view of the x-ray generating portion of a target used in the embodiment illustrated in FIGS. 19A-19C under electron bombardment.
Figure 22C:
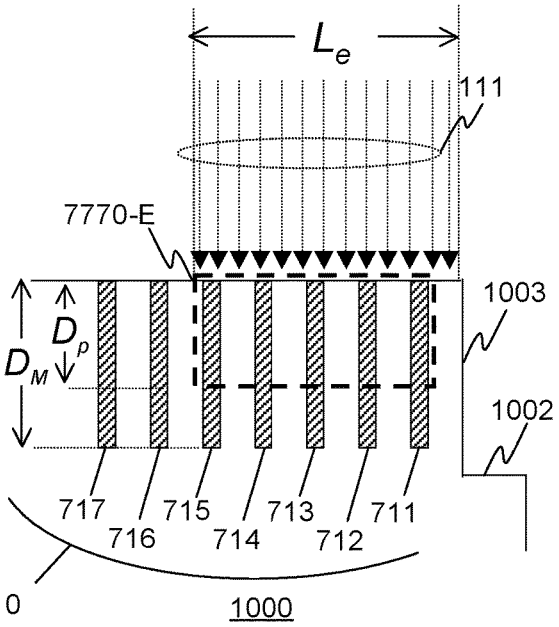
FIG. 22C illustrates a cross-section side view of the x-ray generating portion of a target used in the embodiment illustrated in FIGS. 19A-19C under electron bombardment.

FIG. 22A-22C illustrate this situation. In FIGS. 22A-22C, electron beam 111 bombards a portion of the same target comprising a set 710 of x-ray generating materials embedded in a substrate 1000—the same target layout as was shown in FIGS. 19A-19C, and 20A-20C. However, the extent of the electron beam does not encompass the entire set of structures, but has a beam width of $W_e$ less than $W_M$, and a beam length $L_e$ which is less than $L_{Tot}$ and is also not exactly aligned with the edge of the target structures. The overall area of exposure at the surface is therefore the area of the electron beam at the intersection with the surface (the electron beam "footprint"), defined at some threshold value, such as the full-width-at half-maximum (FWHM) value or the 1/e value relative to the peak intensity. In general, the defined boundary for the footprint will be defined at the contour where the electron intensity is at 50% of the maximum electron intensity.

The electron beam bombarding the target may have various sizes and shapes, depending on the electron optics selected to direct and shape the electron beam. For example, the electron beam may be approximately circular, elliptical, or rectangular. Various accelerating voltages may be used as well, although generally the accelerating voltage will be selected to be at least twice that needed to produce x-rays of a given energy (e.g. to produce x-rays with an energy of ~8 keV, the accelerating voltage is preferred to be at least 16 keV).

If the entire region of x-ray generating structures is bombarded with an equivalent footprint of electrons of high energy, the x-ray generating volume may be identical to the "geometric volume" as described above. However, in some cases, the depth of the microstructured x-ray generating material $D_M$ may be significantly deeper than the electron penetration depth into the substrate, which may be estimated using Potts' Law (as discussed above), or deeper than the continuous slowing down approximation (CSDA) range (CSDA values normalized for element density may be computed using the NIST website physics.nist.gov/PhysRefData/Star/Text/ESTAR.html). In such cases, the deeper regions of x-ray generating material may be relatively unproductive in generating x-rays, and the x-ray generating volume is preferably defined by the area overlap of the electron footprint upon the sample with the minimal geometric area containing the microstructures and the electron penetration depth of the electrons into the substrate. For 60 keV electrons bombarding copper (density ~8.96 g/cm$^3$) the electron penetration depth by Potts' Law is estimated to be ~5.2 microns, while the CSDA depth is ~10.6 microns. For a diamond substrate (density ~3.5 g/cm$^3$), the Potts' Law penetration depth is ~15.3 microns, while the CSDA depth for the diamond substrate is ~18.9 microns.

In some embodiments, the depth of the x-ray generating structures $D_M$ measured from the target surface may be limited to be less than the penetration depth of the electrons into the x-ray target substrate material. In most cases (due to the typically lower mass density of the x-ray substrate relative to the x-ray generating material), the entire depth of x-ray generating material will be generating x-rays. In some embodiments, the depth of the x-ray generating structures $D_M$ measured from the target surface may be some multiple (e.g. 1×-5×) of the penetration depth of the electrons into the x-ray target substrate material. In this case, the depth $D_P$ of the electron excitation volume 7770-E in which x-rays are generated will be less than $D_M$, as illustrated in FIGS. 22A-22C, and the depth $D_P$ will be defined as a predetermined number related to either the electron penetration depth or the CSDA depth. (Note: the depth dimension is defined as parallel to the surface normal, and if the electron beam is incident on the target surface at an angle other than 0° (normal incidence), the depth $D_P$ of the electron excitation volume must be modified from the normal incidence penetration depth by a factor of cos In other embodiments, the depth of the x-ray generating structures $D_M$ measured from the target surface may be limited to be less than the penetration depth of the electrons into the x-ray generating material. This may include 1× the penetration depth, or in some cases, preferably a fraction of the penetration depth such as ½ or ⅓ of the penetration depth.

Figure 2:
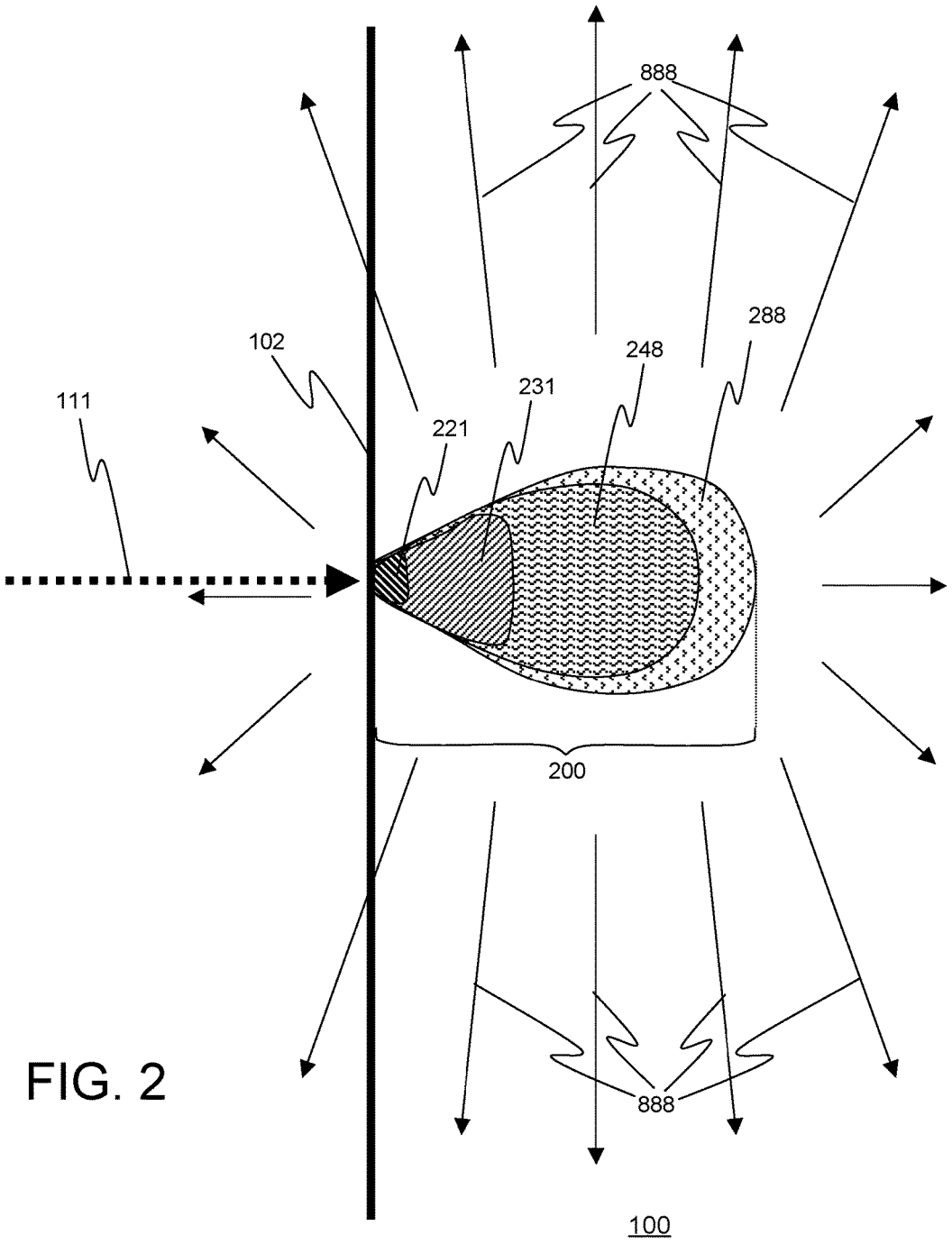
FIG. 2 Prior Art
FIG. 2 illustrates a cross-section diagram the interaction of electrons with a surface of a material in a prior art x-ray source.
Figure 3:
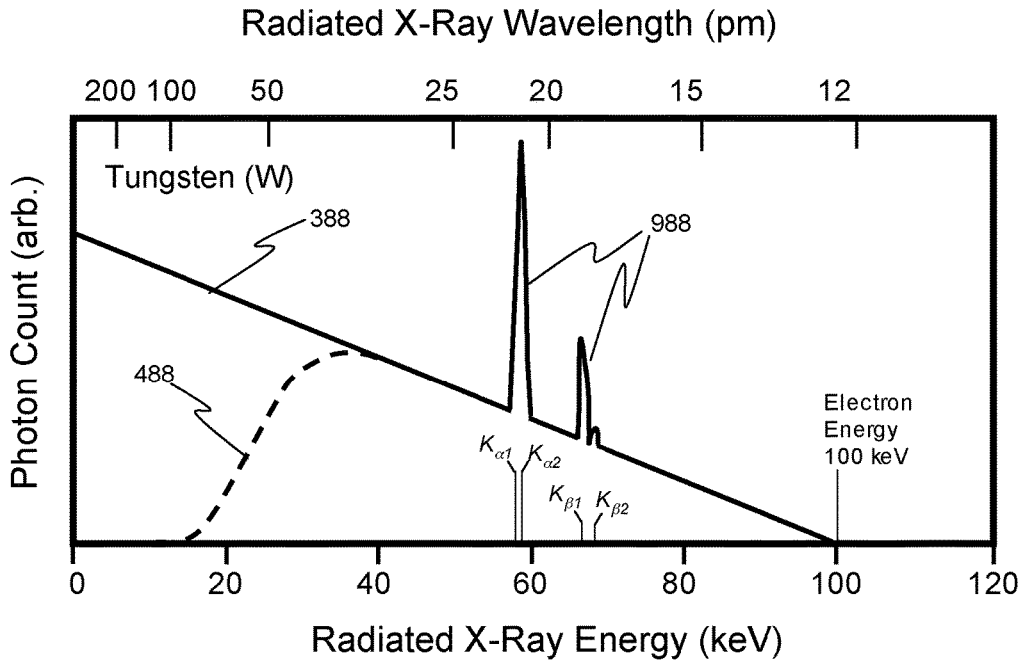
FIG. 3 Prior Art
FIG. 3 illustrates the typical x-ray radiation spectrum for a tungsten target.
Figure 4A:
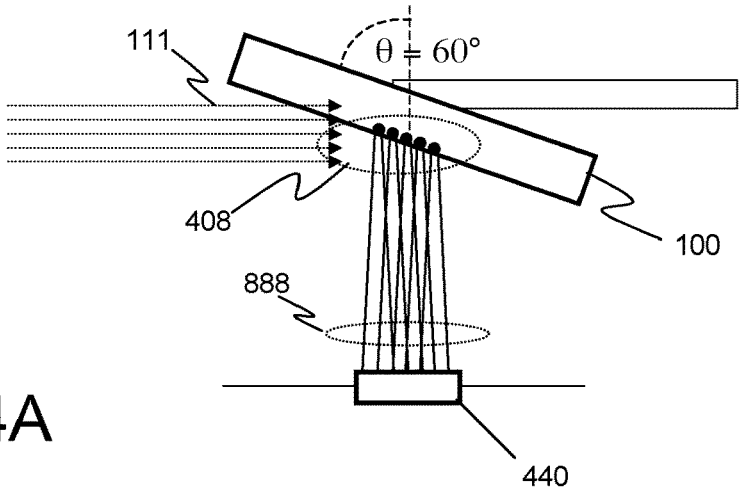
FIG. 4A illustrates x-ray radiation from a prior art target for a target at a tilt angle of 60 degrees.
Figure 4B:
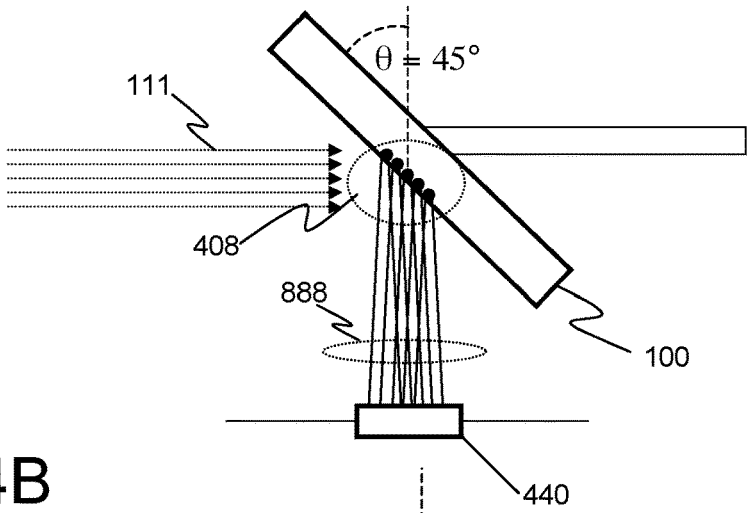
FIG. 4B illustrates x-ray radiation from a prior art target for a target at a tilt angle of 45 degrees.
Figure 4C:
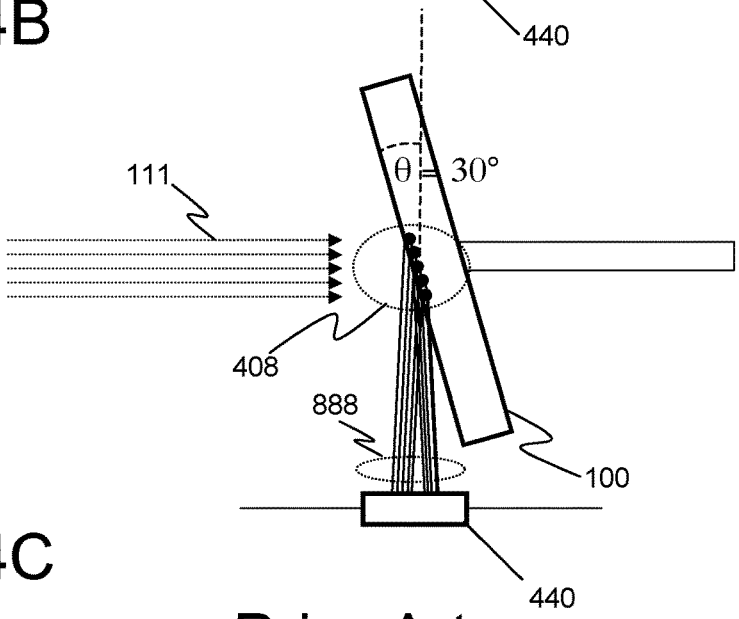
FIG. 4C Prior Art
FIG. 4C illustrates x-ray radiation from a prior art target for a target at a tilt angle of 30 degrees.

For some embodiments, the depth $D_P$ of the electron excitation volume will be defined as being equal to half the penetration depth of the target X-ray generating material, since this is the depth over which the electrons will generate more characteristic x-rays. (See the discussion of FIG. 2 above for more on the topic of characteristic x-ray generation.

4.1.1C. Synthesis of the X-Ray Generating Volume.

For any general embodiment, the x-ray generating volume will be defined as the volume overlap of the "geometric volume" for the x-ray generating material within the target and the "electron excitation volume" for electrons of a predetermined energy and known penetration depth and CSDA depth for materials of the target.

4.1.2. Design Rules for Volume Fraction.

The volume fraction of the x-ray generating volume is defined as the ratio of the volume of the x-ray generating material within the x-ray generating volume to the overall x-ray generating volume. A typical prior art x-ray target with a uniform target of x-ray generating material will have a volume fraction of 100%. Targets such those illustrated in FIG. 10, with $L_M$=1 micron and $L_{Gap}$=2 microns, have a volume fraction of ~37%.

A general rule for the x-ray sources according to the invention disclosed here is that the volume fraction of the x-ray generating volume be between 10 and 70%, with the non-x-ray generating portion being filled with material of a high thermal conductivity. The regions of non-x-ray generating material serve to conduct the heat away from the x-ray generating structures, enabling bombardment with an electron beam of higher power, thereby producing more x-rays.

The ideal volume fraction for a target typically depends on the relative thermal properties of the x-ray generating material and the substrate material in the x-ray generating volume. If the target is fabricated by embedding discrete structures of x-ray generating material with moderate thermal properties into a substrate of high thermal conductivity, good thermal transfer is generally achieved. If the thermal transfer between the x-ray generating material and the substrate is poor (for example, in circumstances of when the x-ray generating material has poor thermal properties), a smaller volume fraction may be desired. In general, for the embedded target structures described herein, a volume fraction of 30%-50% is preferred.

Figure 23:
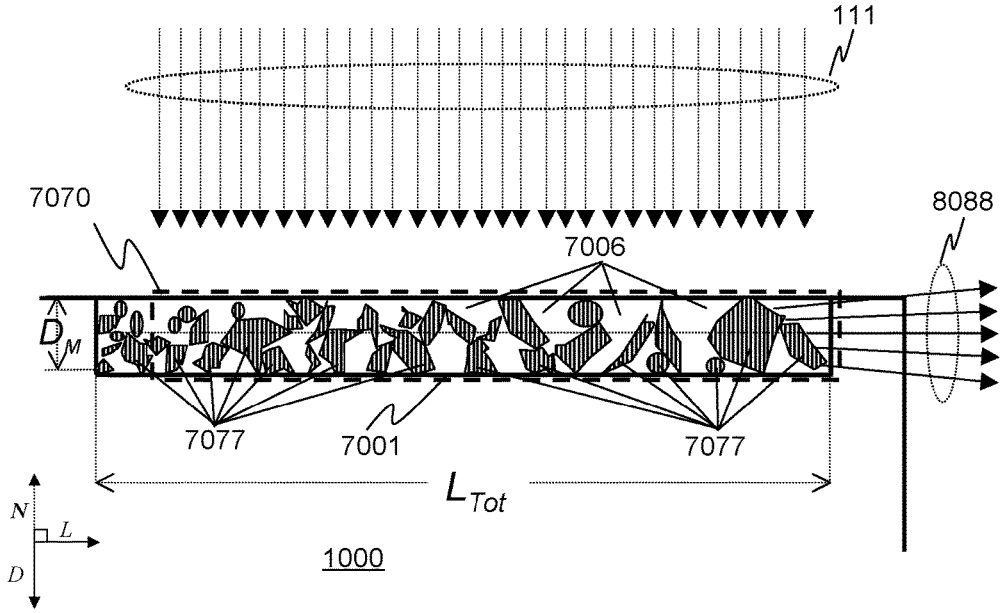
FIG. 23 illustrates a cross-section side view of the x-ray generating portion of a target comprising a powder of x-ray generating material.

It should be noted that in some embodiments, the discrete x-ray structures are not manufactured through etching or ordered patterning processes but instead formed using less ordered discrete structures, such as powders of target materials. FIG. 23 illustrates a target fabricated by such a process. In a substrate 1000, a groove 7001 or set of grooves may be formed using standard substrate patterning techniques. The groove 7001 is then filled with particles of a powder of x-ray generating material 7077. The particles 7077 may be of a predetermined average size and shape, so that a measured volume of the material may be used to produce a desired volume fraction within the groove.

Once the particles of x-ray generating material have been placed in the groove, the gaps between particles 7006 can be filled with a coating of material deposited by chemical vapor deposition (CVD) processes. This provides the thermal dissipation for the heat produced in the x-ray generating target structures. When bombarded by electrons 111, the x-ray generating material will produce x-rays 8088. As long as the space between particles is small, and the depth of the groove is less than half the penetration depth of the electrons into the substrate, the x-ray generating volume 7070 will be the overlap of the groove (defining the geometric volume) and the projection of the footprint of the electron beam at the surface.

In some embodiments, the powders may be pressed into an intact ductile substrate material. In some embodiments, additional overcoats as described for more regular structures and illustrated in FIG. 13 may be used for targets fabricated using powders as well.

For a target formed using a powder of x-ray generating material, the substrate is preferably a material with high thermal conductivity, such as diamond or beryllium, and the filling material is a matching material (e.g. diamond) deposited by CVD.

4.2.3. Design Rules for Thermal Properties.

The x-ray source target substrate material is preferred to have superior thermal properties, particularly its thermal conductivity, in respect to the x-ray generating material. Moreover, it is preferred that substrate materials of the target limit the self-absorption of x-rays produced in the target along the low take-off angle. In many embodiments, this leads to the selection of a substrate material having low atomic number, such as diamond, beryllium, sapphire, or some other carbon-based material.

For some materials, such as diamond, the thermal conductivity is severely reduced in very thin samples of the material. There may therefore be a minimum thickness required for the space between structures of x-ray generating material.

In general, for diamond having embedded structures of x-ray generating material, suitable results have been achieved when the thickness of the diamond between structures of x-ray generating material is 0.5 micrometer or more.

Likewise, if the discrete structures of x-ray generating material are too thick, heat cannot transfer efficiently from the center to the outside, and there is therefore a practical limit on how thick a given structure of x-ray generating material should be.

In general, when being embedded into diamond, suitable results have been achieved when the thickness of the x-ray generating structures is 10 micrometers or less.

4.1.4. Design Rules Based on Propagation Length.

As described previously, there will be a total length for x-ray generation after which additional x-rays generated cease to contribute additional x-rays to the output, due to reabsorption. There is therefore an upper bound on the length $L_M$ of the x-ray generating material within the x-ray generating volume.

For a given x-ray energy, which in general may correspond to a characteristic line of the selected x-ray generating material, $\mu_L$ is be defined to be the 1/e attenuation length for x-rays of that energy in the same material. Values for this number have been illustrated in FIG. 15, and numerical values are shown in Table III below for a few commonly used x-ray generating materials. The x-ray energies are taken from the NIST website physics.nist.gov/PhysRefData/XrayTrans/Html/search.html and the attenuation lengths are calculated using the same sources as were used for the data in FIG. 15.

TABLE III

1/e Attenuation lengths for various x-ray transitions

| X-ray Transition | X-ray Energy (keV) | $\mu_L$ (@ m) |
|---|---|---|
| Cu K@ | 8.05 | 21.8 |
| Mo K@ | 17.48 | 55.1 |
| W K@ | 59.32 | 136.3 |

As a general rule, the propagation path through x-ray generating material for any given x-ray path should be less than $4\times\mu_L$. For target structures such as the powder structure in FIG. 23, to insure that no path through the x-ray generating volume is significantly longer than the upper bound for x-ray production, a design rule that the entire length of the groove $L_{Tot}$ be less than $4\times\mu_L$ may be followed. In other embodiments, a design rule that $L_{Tot}$ be less than $(4\times\mu_L)$ divided by the volume fraction may be followed.

For more defined discrete target structures, such as that illustrated in FIG. 19C, a design rule limiting the length of the sum of segments in which a predetermined ray overlaps the x-ray generating material may be set.

In FIG. 19C, the designated ray is the ray 88-T corresponding to the take-off angle at $\tau_T$, shown relative to a ray 88-M running through the midpoint of the x-ray generating volume. The path of this ray 88-T through the x-ray generating volume 7710-E has several segments of overlap 711-S, 712-S, . . . , 717-S corresponding to the overlap with the slabs 711, 712, . . . , 717 of x-ray generating material. A general design rule can be stated that, for any ray parallel to the take-off angle ray, the sum of the segments of overlap with the x-ray generating material within the x-ray generating volume must be smaller than $4\times\mu_L$. In some embodiments, this sum of the segments of overlap with the x-ray generating material within the x-ray generating volume must be smaller than $2\times\mu_L$.

Although FIG. 19C uses the ray of the take-off angle as a design rule, other embodiments may instead have a restriction on the sum of segments of overlap for a ray within the cone of propagation, i.e. between angles $\theta_1$ and $\theta_2$.

Figure 24A:
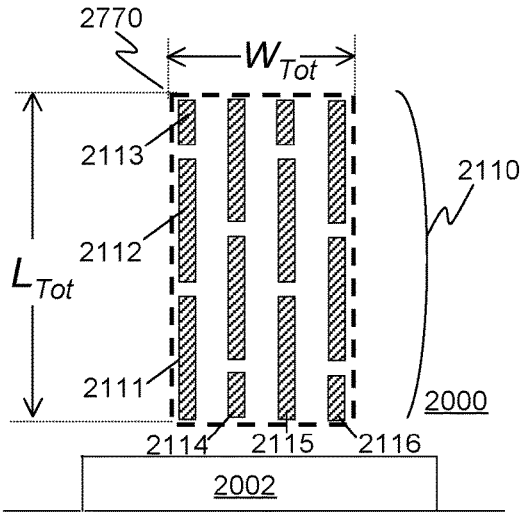
FIG. 24A illustrates a top-down view of the x-ray generating portion of a target comprising structures of x-ray generating material arranged along the length dimension.
Figure 24B:
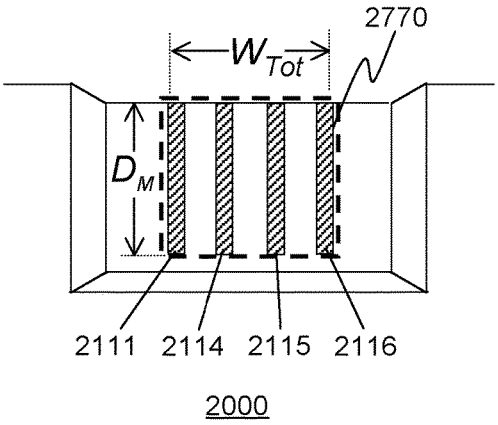
FIG. 24B illustrates an end view of the x-ray generating portion of the target of FIG. 24A.
Figure 24C:
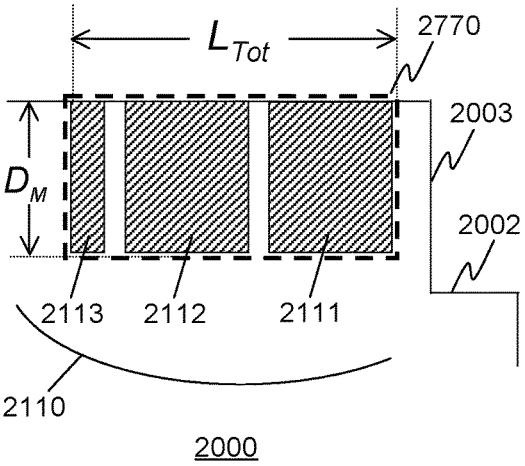
FIG. 24C illustrates a cross-section side view of the x-ray generating portion of the target of FIG. 24A.

Such a target design is illustrated in FIGS. 24A-24C. In this embodiment, a number of microstructures 2110 in the form of microslabs of x-ray generating material 2111, 2112, . . . , 2116, . . . etc. are embedded in a substrate 2000, near the edge 2003 of a shelf 2002 in a substrate 2000, but the orientation of the microstructures has the narrowest dimension aligned with the "width" direction and the longest dimension along the length dimension. The geometric volume 2770 in this example is a rectangle of volume $L_{Tot}\times W_{Tot}\times D_M$.

If the take-off angle is in the plane of the microstructures, the path for x-rays at or near the take-off angle may be longer than the reabsorption upper bound. However, for x-rays emerging from the sides of the microstructures, low attenuation through the surrounding substrate and other x-ray microstructures may be achieved. The spacing between the microstructures may be adjusted so that x-rays emerging at the maximum cone angle $\theta_2$ in the plane orthogonal to the plane of the take-off angle (i.e. in the plane of FIG. 24A) intersect a certain number of additional microstructures, achieving linear accumulation, but do not exceed the reabsorption upper bound. The appropriate metric for the limitation on length segments will therefore be for rays at angles corresponding to certain cone angles out of the plane of the microstructures, and not the take-off angle.

Note that these cone angles need not be in any particular plane, and therefore a design rule limiting the length of overlap must apply to certain rays within the cone, preferably those out of the plane of orientation for the microstructures. In some embodiments, a design rule limiting the length of the sum of segments will apply to any cone angle within a predetermined subset of cone angles. In some embodiments, a design rule limiting the length of the sum of segments will apply to a majority of cone angles.

A general design rule can be stated that, for any ray within a predetermined subset of cone of angles greater than or equal to $\theta_1$ and less than or equal to $\theta_2$ relative to the take-off angle ray, the sum of the segments of overlap with the x-ray generating material within the x-ray generating volume must be smaller than $4\times\mu_L$. Note that for prior embodiments, this design rule may also be used rather than using the ray along the take-off angle to define the amount of x-ray generating material within a giving x-ray generating volume.

Design rules may also be placed on having a minimum length for sums of segments of overlap, to ensure that at least some accumulation of x-rays may occur. For some embodiments, the sum of the segments of overlap with the x-ray generating material within the x-ray generating volume must be greater than $0.3\times\mu_L$. For other embodiments, the sum of the segments of overlap with the x-ray generating material within the x-ray generating volume must be greater than $1.0\times\mu_L$. For other embodiments, the sum of the segments of overlap with the x-ray generating material within the x-ray generating volume must be less than $1\times\mu_L$ and in other embodiments this may be $2.0\times\mu_L$.

4.1.5. Design Rules for Depth.

As discussed above, the depth $D_M$ of the structures of x-ray generating material may be determined by any number of factors, such as the ease of reliably manufacturing embedded structures of certain dimensions, the thermal load and thermal expansion of the embedded structures, a minimum thickness to minimize source degradation due to delamination or evaporation, etc.

However, creating structures with a depth $D_M$ significantly deeper than the electron penetration depth into the substrate will generally result in deep regions that are unproductive in generating x-rays. For 60 keV electrons bombarding copper (density ~8.96 g/cm$^3$) the electron penetration depth by Potts' Law is estimated to be ~5.2 microns, while the CSDA depth is ~10.6 microns. For a diamond substrate (density ~3.5 g/cm$^3$), the Potts' Law penetration depth is ~15.3 microns, while the CSDA depth for the diamond substrate is ~18.9 microns.

As a general design rule, the depth of the x-ray structures $D_M$ measured from the target surface should be limited to be less than 5 times the penetration depth of the electrons into the x-ray target substrate material. This ensures that the depth of the structures of x-ray generating material, which typically have poorer thermal properties than the substrate, is minimized, as typically only the portion closer to the surface is efficient at generating characteristic x-rays. Although some x-rays are generated at lower depths, there is also associated heat generation. In some embodiments, the depth of the x-ray generating material is preferred to be a fraction (e.g. ½) of the electron penetration depth in the x-ray generating material, providing the overlap of electron excitation and x-ray generating material primarily in the zone in which most of the characteristic x-rays are generated (see previous discussion of FIGS. 2, 8 & 9). In some embodiments, the depth of the x-ray generating material is preferred to be a fraction (e.g. ½) of the electron penetration depth in the substrate material. In some embodiments, the depth of the x-ray generating material is preferred to be half of the CSDA depth in the substrate material.

4.2. Relation of the X-Ray Generating Volume to Take-Off Angle.

Conventional reflection-type x-ray target geometries are often arranged, such that the x-ray beam emitted is centered along a take-off angle of ~6° measured from the x-ray target surface tangent. This angle is typically selected in an effort to both minimize apparent x-ray source size (smaller at lower take-off angles) and minimize self-attenuation by the x-ray target (larger at lower take-off angles).

The disclosed embodiments of the invention are preferably operated at take-off angles less than or equal to 3°, and for some embodiments at 0° take-off angle, substantially lower than for conventional x-ray sources. This is enabled by the structured nature of the x-ray source and the incorporation of an x-ray substrate, as discussed above, comprised of a material or structure that reduces or minimizes self-absorption of the x-ray energies of interest generated by the x-ray target.

Figure 25:
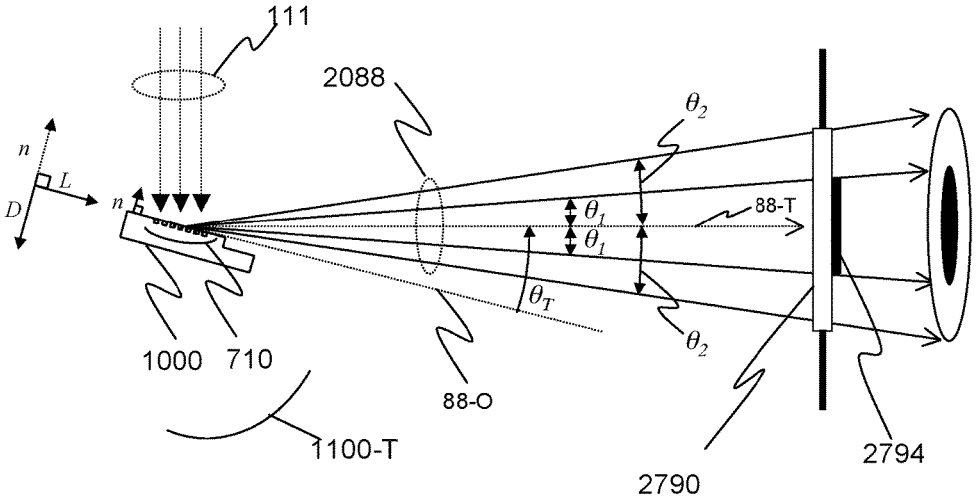
FIG. 25 illustrates a cross-section view of the x-ray generating portion of a source according to the invention paired with an external x-ray optical element.

Such a structured target is especially useful as a distributed, high-brightness source for use in systems that make use of an x-ray beam having the form of an annular cone. FIG. 25 illustrates the matching of the annular cone as defined in the previous embodiments with an aperture or window 2790 and/or beam stop 2794 in the system.

This annular output can be selected to match the acceptance angle of an x-ray optical element, such as a capillary optic with a reflecting inner surface used for directing (e.g. focusing or collimating) the generated x-ray beam for downstream applications. The predetermined cone of x-rays generated by the x-ray source can be defined to correspond to the angles and dimensions of such downstream optical elements. Likewise, a central beamstop to block the x-rays propagating at the take-off angle $\psi_T$ (which typically will not be collected by the downstream optical elements such as monocapillaries) can also be used, with the propagation angles blocked by the beam stop being those that correspond to the inner diameter of the predetermined annular x-ray cone. In some embodiments, annular cones may be defined by the acceptance angles of downstream optics, i.e. by the numerical aperture of such optics, or other parameters that may occur in such systems. Matching the volume to, for example, the depth-of-focus range for a collecting optic or to the critical angle of the reflecting surface of a collecting optic may maximize the number of useful x-rays, while limiting the total power that must be expended to generate them.

The angular range for the annular cone of x-rays is generally specified by having the inner cone angle $\psi_1$ being greater than 2 mrad relative to the take-off angle, and having the outer cone angle $\psi_2$ be less than or equal to 50 mrad relative to the take-off angle.

4.3. Rotating Anodes.

The previous discussion on take-off angles and cones of annular x-rays may also be applied to rotating anodes.

Figure 26:
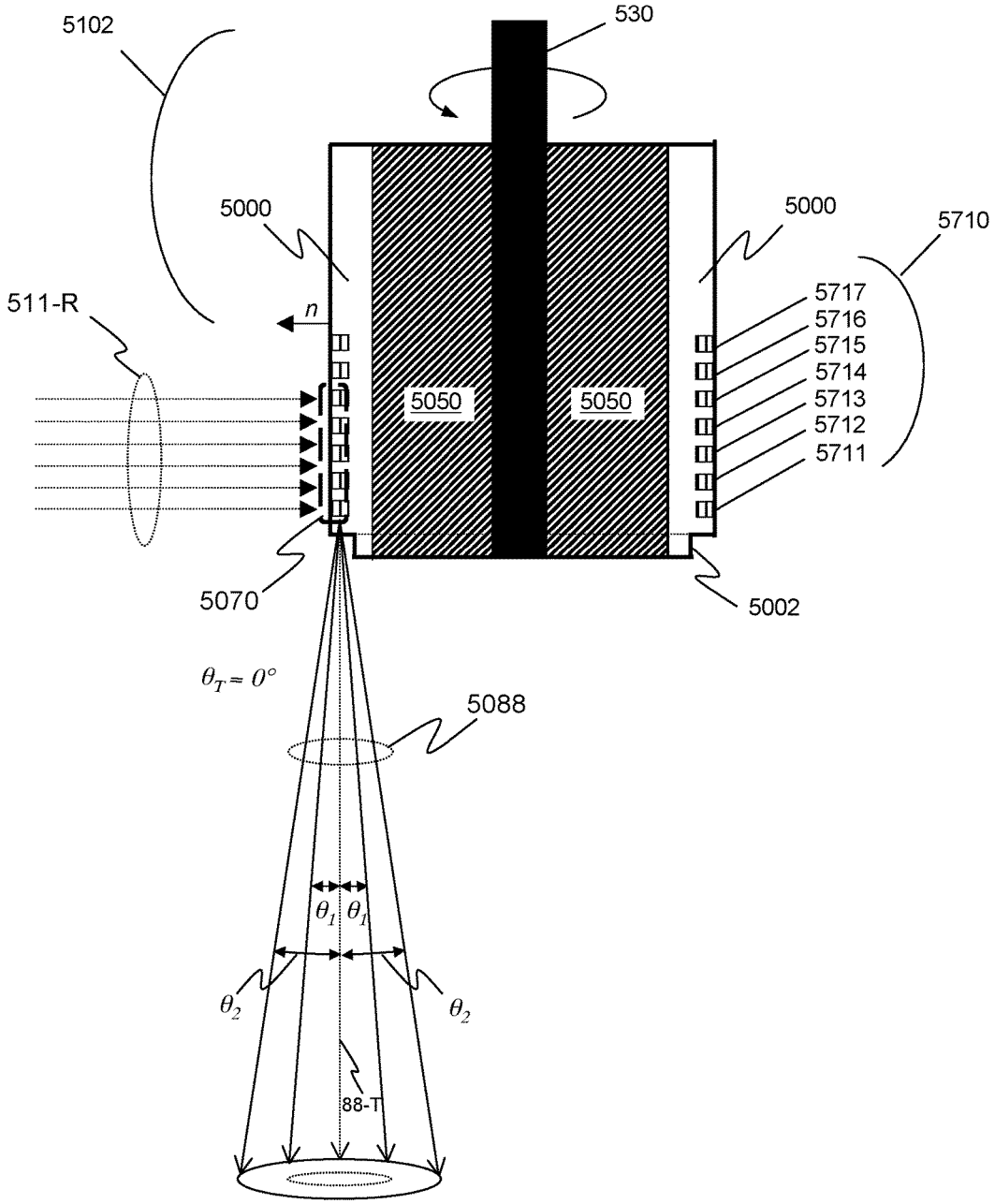
FIG. 26 illustrates a cross-section view of a rotating anode according to the invention generating x-rays at a 0° take-off angle.

FIG. 26 presents a cross-section view of a rotating anode in the form of a cylinder 5102 as may be inserted into a system as was illustrated in FIG. 17A. As in the embodiment of FIGS. 17A-17C, the cylinder 5102 is mounted on a rotating shaft 530, and has a core 5050 of a thermally conducting material such as copper.

On the outer surface of the cylinder, a layer of substrate material 5000 such as diamond or CVD diamond has been formed, and embedded in this substrate are a number of rings 5711, 5712, . . . , 5717 comprising x-ray generating material. As before, the "length" (parallel to the shaft axis in this illustration, and perpendicular to the local normal n in the region under bombardment) of each ring may be comparable to the length discussed for the set of microstructures illustrated in FIG. 10 (i.e. micron-scale), and the spacing may be comparable to $L_{Gap}$. (also micron-scale). The depth (i.e. parallel to the local normal n) into the substrate 5000 may also be comparable to the depth discussed in the previous embodiments (i.e. micron scale, and related to either the penetration depth or the CSDA depth for either the x-ray generating material or the substrate.) The "width", however, is the circumference, as the rings 5710 circle the entire cylinder 5100.

When a portion of the x-ray generating structures are bombarded by electrons 511-R, an x-ray generating volume 5070 is formed, generating x-rays 5088. Although x-rays may be radiated in many directions, for this system, as with the systems illustrated in FIGS. 19A-19C, a predetermined take-off angle $\psi_T$ may be designated, along with a cone of angles ranging from $\psi_1$ to $\psi_2$ defined relative to the take-off angle. These angles are generally selected to correspond to x-rays that the will be collected downstream to form a beam for use in x-ray optical systems. For the example illustrated in FIG. 26, the take-off angle is at 0°, making use of the x-rays that linearly accumulate through the set 5710 of rings comprising x-ray generating material. To reduce the attenuation of x-rays in the substrate 5000, the cylinder 5102 may additionally have a notch 5002 near the x-ray generating rings 5710, comparable to the shelf illustrated in the previous planar target configurations.

Figure 27:
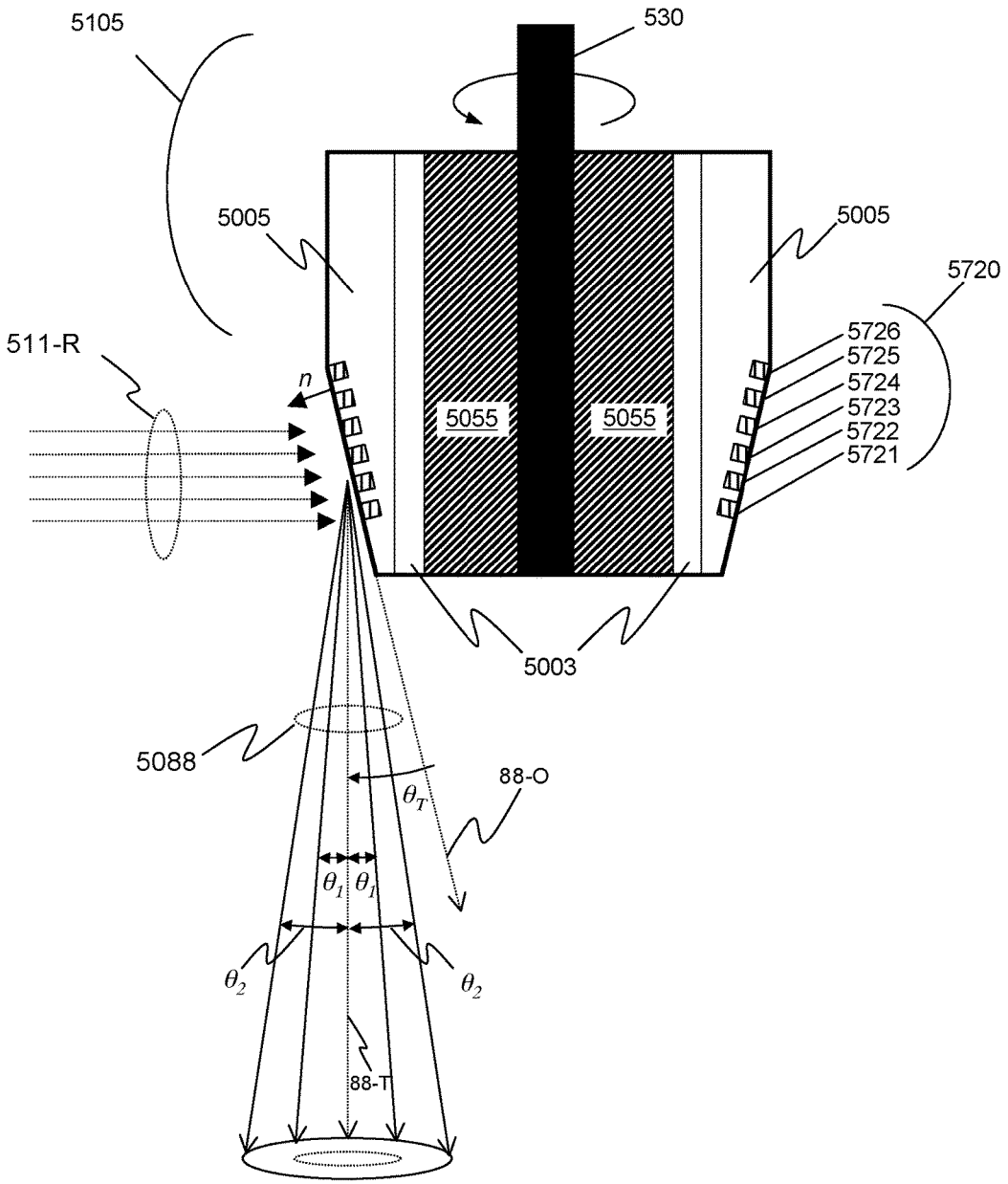
FIG. 27 illustrates a cross-section view of a rotating anode according to the invention having a beveled surface and a non-zero take-off angle.

FIG. 27 presents a cross-section view of another embodiment of a rotating anode in the form of a cylinder 5105 as may be inserted into a system as was illustrated in FIG. 17A. As in the embodiment in FIG. 26, the cylinder 5105 is mounted on a rotating shaft 530, with a conducting core 5050 and an outer coating of a substrate material 5005, in which a set 5720 of rings comprising x-ray generating material 5721, 5722, . . . , 5726 are embedded.

However, in the embodiment as illustrated, the cylinder is beveled at an angle in the region of the x-ray generating volume, and the take-off angle is at a non-zero angle 19T, similar to the configuration for the planar geometry of FIG. 19C. The bevel angle is selected so that linear accumulation through the set 5720 of rings may still occur.

Also illustrated in this embodiment, the cylinder 5105 may also be fabricated with an interface layer 5003, which may be provide a coupling between the beveled substrate 5005 and the core 5055.

Other rotating anode designs, such as patterns of lines, checkerboards, grids, etc. as have been illustrated U.S. Provisional Patent Application Ser. No. 62/141,847 (to which the Parent application of the Present application claims the benefit of priority) as well various designs and structures illustrated in other planar embodiments of the present application and the previously mentioned co-pending applications may be used in these configurations as well. These rotating anode embodiments may additionally be fabricated using conducting and/or protective overcoats, as was previously discussed for use with planar targets.

X-Ray Beam Delivery System Comprising Matched Target and Optic

The present technology, roughly described, provides an x-ray beam delivery system comprised of at least one x-ray source comprising a plurality of x-ray target materials matched with a plurality of x-ray optics. Each matched target material and optic pair provides different spectra, allowing for analysis at different levels of sensitivity. The x-ray system can provide collimated or focused beams and a system with a very high throughput due to the matching of each target material and optic.

The matching is achieved by selecting optics designed with the geometric shape, size, and surface coating for collecting as many x-rays having energies of interest as possible from the source and at an angle that satisfies the critical reflection angle of the x-ray energies of interest. In some embodiments, the matching is based on maximizing the numerical aperture (NA) of the optics for x-ray energies of interest. The NA is related to the flux an optic can collect from a source. The square of the NA is proportional to the square of the critical angle of reflection of the reflecting surface material for a specific x-ray energy, which is proportional to the inverse of the x-ray energy squared. This can be represented as follows:

$$NA^2 \propto \theta_c^2(E) \propto \frac{1}{E^2}$$

In most embodiments, the optic is matched to one of the characteristic x-ray energies of the selected target material. For example, if the optic is matched for a higher x-ray energy, the critical angle is smaller and the reflecting surface of the optic will be shaped with a shallower slope. Some embodiments in which the NA is maximized for a high x-ray energy comprise a long x-ray optic with shallow slopes.

In some instances, the x-ray optics have an interior reflecting surface with at least a portion that comprises a quadric profile. The optics are positioned such that a focus of the quadric profile is coincident with the x-ray source spot. In some embodiments, where the quadric shape is ellipsoidal, the spot is at one of the two foci, and in other embodiments, such as paraboloidal or hyperboloidal shapes, the spot is at the single focus. Furthermore, the optics are matched to a characteristic x-ray energy of the x-ray generating microstructure material. This matching is defined such that the incident angle of x-rays with the characteristic energy of interest upon a portion of the reflecting surface are approximately equal to the critical angle of the characteristic x-ray energy of interest. In some instances, the reflecting surface profile of an optic is shaped such that x-rays with the characteristic energy of interest incident upon a portion of the reflecting surface have incidence angles that are between 30 to 100% of the critical angle. In some embodiments, the characteristic x-ray energy is a K-line of the x-ray generating microstructured material. In some other embodiments, this characteristic x-ray energy may be an L or M-line energy.

Figure 28:
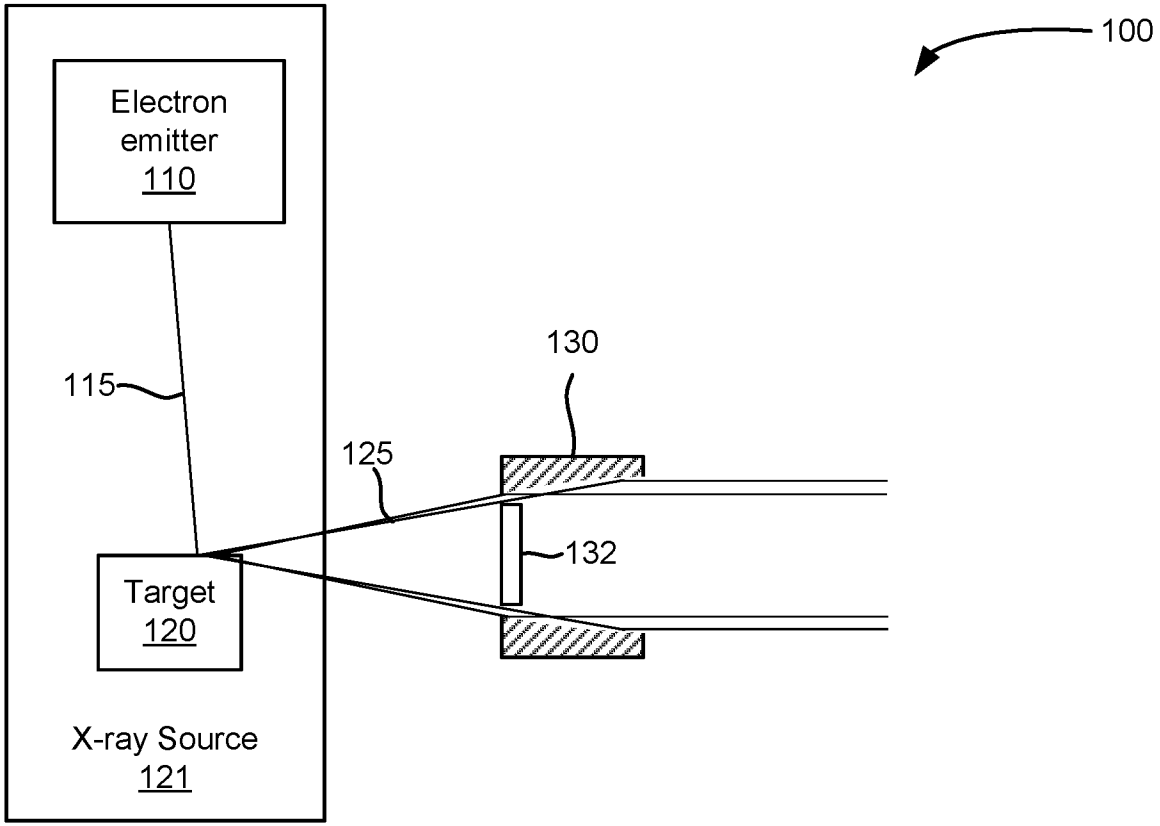
FIG. 28 is a block diagram of an x-ray beam delivery system.

FIG. 28 is a block diagram of an x-ray beam delivery system. The system of FIG. 28 includes an electron emitter 110 and target 120, which collectively comprise an x-ray source 121. System 100 of FIG. 28 also includes optics 130, and a beam stop 132. Electron emitter 110 generates an electron-beam 115 directed at target 120. The electron emitter can have an asymmetric shape, with a first dimension and a second dimension, wherein the ratio of the first dimension to the second dimension is between 3-4. The electron beam may be directed at target 120 at an angle less than 90°. More information regarding a source electron-beam striking a target and the generated x-rays are discussed with respect to FIG. 29. More information regarding the footprint of an electron beam on a target is discussed with respect to FIG. 30.

The energies and spectral properties of x-rays generated by striking an electron-beam on a target depend on the material of the target. In some instances, a target may be comprised of multiple thin strips of target material, for example in the form of a microstructure in which there is one long dimension (e.g., a length) and two dimensions <500 um (e.g., width and depth), deposited on a substrate of high thermal conductivity such as diamond or copper. X-rays generated by an electron beam striking a target material may be collected at a low take-off angle, such as between 0 degrees to +/−6 degrees to maximize brightness. The x-rays can be collimated or focused by optics designed to be matched to the target material. X-rays that are not reflected by optics 130 are blocked by beam stop 132. More information for wire targets is discussed with respect to FIGS. 31-33.

The present x-ray beam delivery system can have a source with one or more targets, with each target comprising one or more target materials, such that there are a plurality of target materials and a plurality of optics. Optics are matched to one or more target materials, as each material has unique spectra and characteristic emission lines, and therefore critical angles $\theta_c$. The critical angle can depend on the interior surface coating of an optic. In particular, different interior surface coatings, such as a platinum coating, can be used to increase the critical angle.

The optics are matched to one or more target materials and can include total external reflection mirror optics. Each of the plurality of optics in an x-ray illumination beam system can be matched to the x-ray spectra produced by at least one of a plurality of microstructures. Each optic can also be positioned to collect x-rays generated by at least one of the plurality of microstructures when bombarded by a focused electron beam. Examples of optics that may be used to match different targets are discussed with respect to FIGS. 35-36. X-rays with matching targets and optics selected by a user are illustrated with respect to FIGS. 37-38.

The system of FIG. 28 may include additional elements and components typically used within an x-ray system, but not illustrated in FIG. 28 for purposes of simplicity. For example, the x-ray source 121 of FIG. 28 may also include a helium path or vacuum enclosure, electron optics, and other elements typically found in x-ray sources. The electron emitter may generate a rastering electron beam. The system of FIG. 28 may also include mechanisms for securing and moving the target 120 and optics 130 into precise locations that satisfy a minimum and maximum tolerance for positioning such elements.

In some instances, the target 120 is a rotating anode target. In some instances, the target is comprised of a substrate and discrete microstructures having at least two dimensions being <500 μm in contact with the substrate. In some instances, the microstructures are embedded within a substrate and in some instances, the microstructures are atop a substrate. In some embodiments, the microstructures are not directly in contact with the substrate and there is at least one layer of material between the microstructures and substrate. Such layers may serve as diffusion barriers to prevent the diffusion of the microstructure material into the substrate material or vice versa, and/or may serve as thermal boundaries to improve the thermal conductivity of heat between the microstructure and the substrate.

Figure 29:
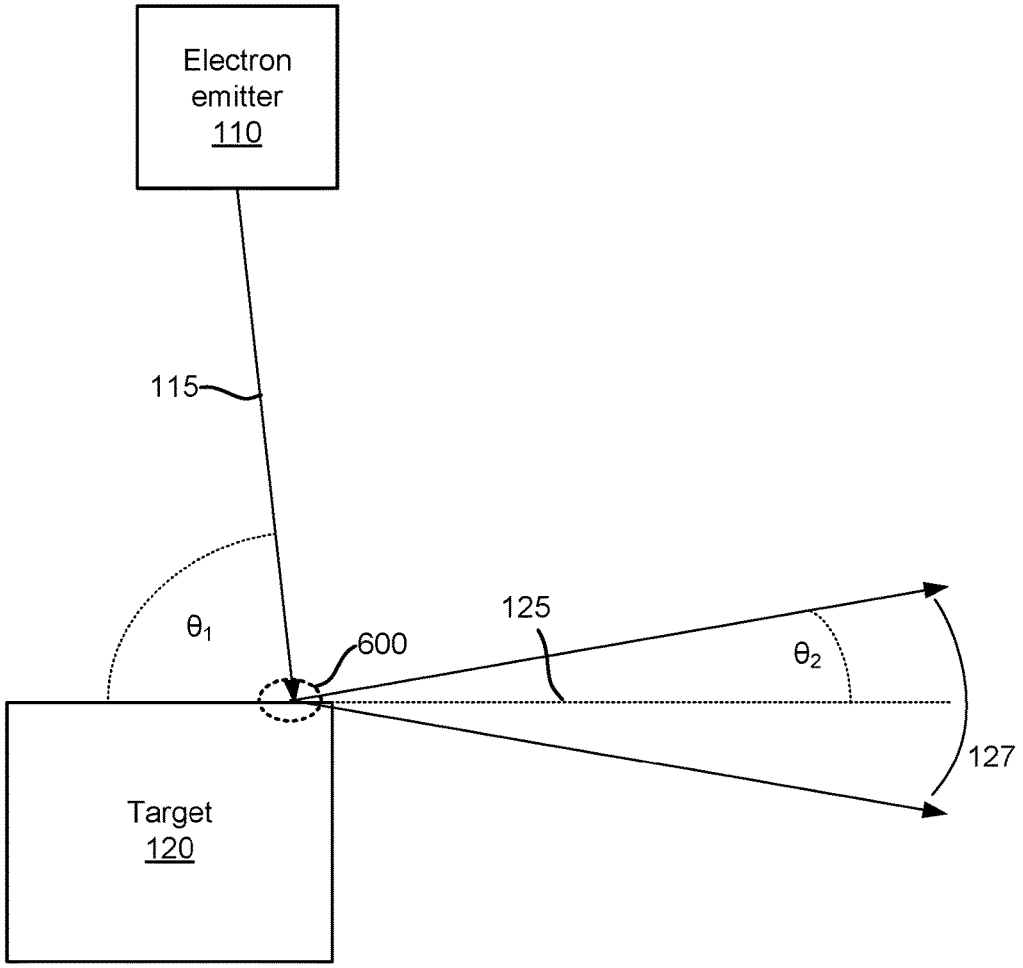
FIG. 29 is a block diagram of a bombarding electron beam and emitted x-rays associated with a target.

FIG. 29 is a block diagram of a bombarding electron beam and emitted x-rays associated with a target. FIG. 29 includes electron beam 115 generated by electron emitter 110 and received by target 120. As shown, the beam angle of incidence with respect to target 120 may be $\theta_1$. $\theta_1$ may be in the range of between 45° and 90°. When electron-beam 115 strikes the target, x-rays are emitted. The take-off angle $\Theta_2$ (the angle between the target surface and the center of the emitted x-ray cone 127) of x-rays with a central ray 125 may be between 0-20°. In some instances, an emitted x-ray beam can have a take-off angle of less than 6°. Movement of the target(s) to select different target materials to be placed in the electron beam path is relative. In some instances, the target(s) is(are) moved to position a selected target, and in some embodiments, the electron-beam and/or the electron source may move. In some other embodiments, both the target and the source may move.

Figure 30:
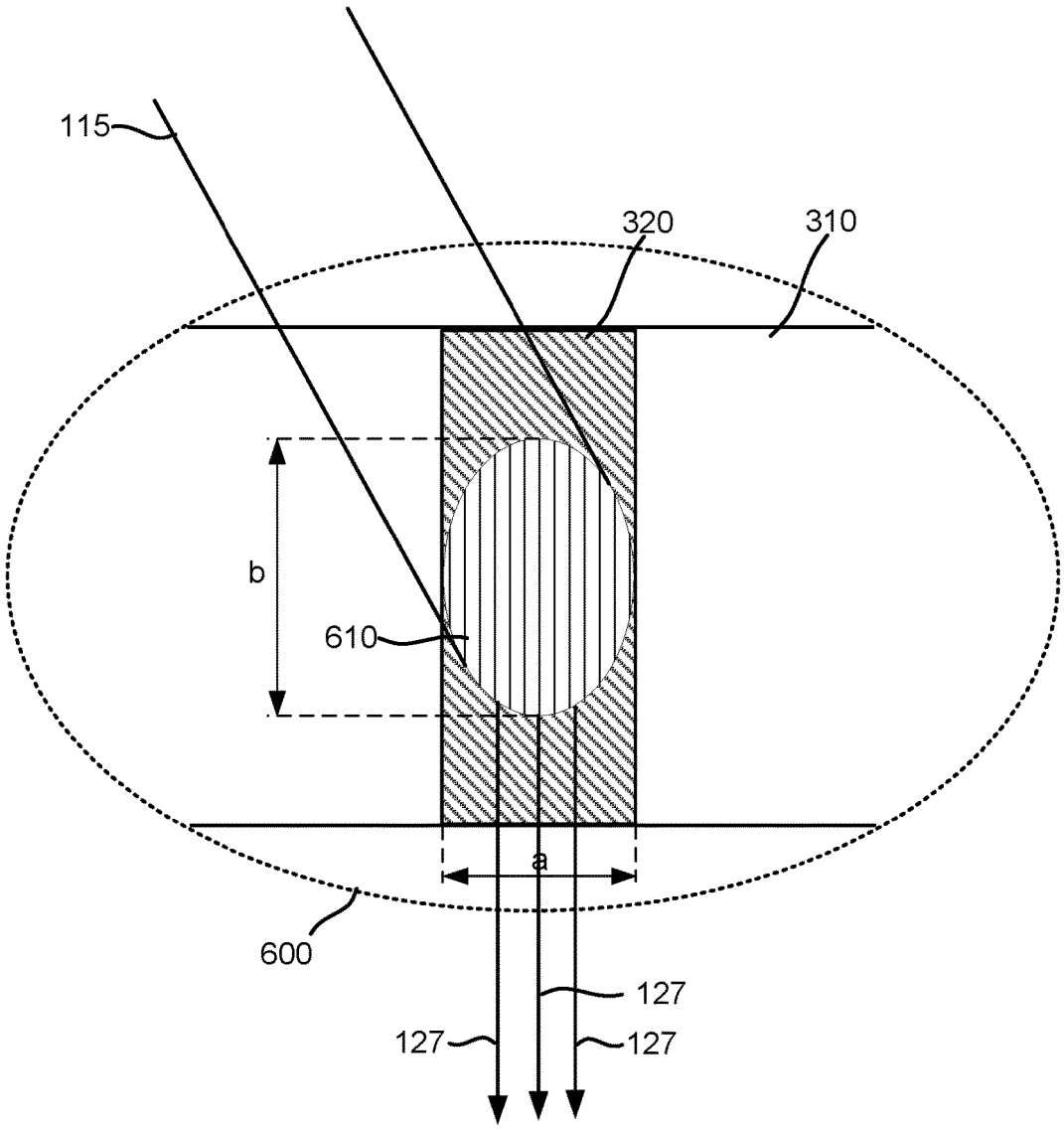
FIG. 30 is a view of an x-ray beam footprint on a target.

FIG. 30 is a view of an x-ray beam footprint on a target. FIG. 30 provides more detail for a surface of target 120, corresponding to area 600 of FIG. 29. A microstructured wire 320 may exist on substrate 310. Substrate 310 may be in contact with multiple microstructures, although only one is shown in FIG. 30. Electron beam 115 used to strike microstructure 320 has a width that can correspond to the profile of a microstructure wire 320. In some implementations, the width of the electron beam can be about the same, narrower, or wider than the target wire microstructure that receives the beam. In some instances, the footprint of the electron beam is elliptical, as shown by footprint 610. The beam may be elliptical by design, or may be circular with a raster motion to create an elliptical footprint on microstructure 320. The width of the microstructure can be used to limit the spot size of the x-ray source. The dimensions of the footprint of the electron-beam are given as "a" and "b", as shown in FIG. 30B. The width "a" may be less than or equal to 30 μm (microns). In some instances, the ratio of b to a may be about 2-20, and a:b may have an aspect ratio of between 1:70 and 1:10. As such, a compromise can be achieved by using enough power but maintaining a small focus point at the same time. In many embodiments, the take-off angle is such that the x-rays 127 emitted by the x-ray source appear from a round x-ray spot that has a diameter that is approximately equal to the smaller dimension a.

Figure 31:
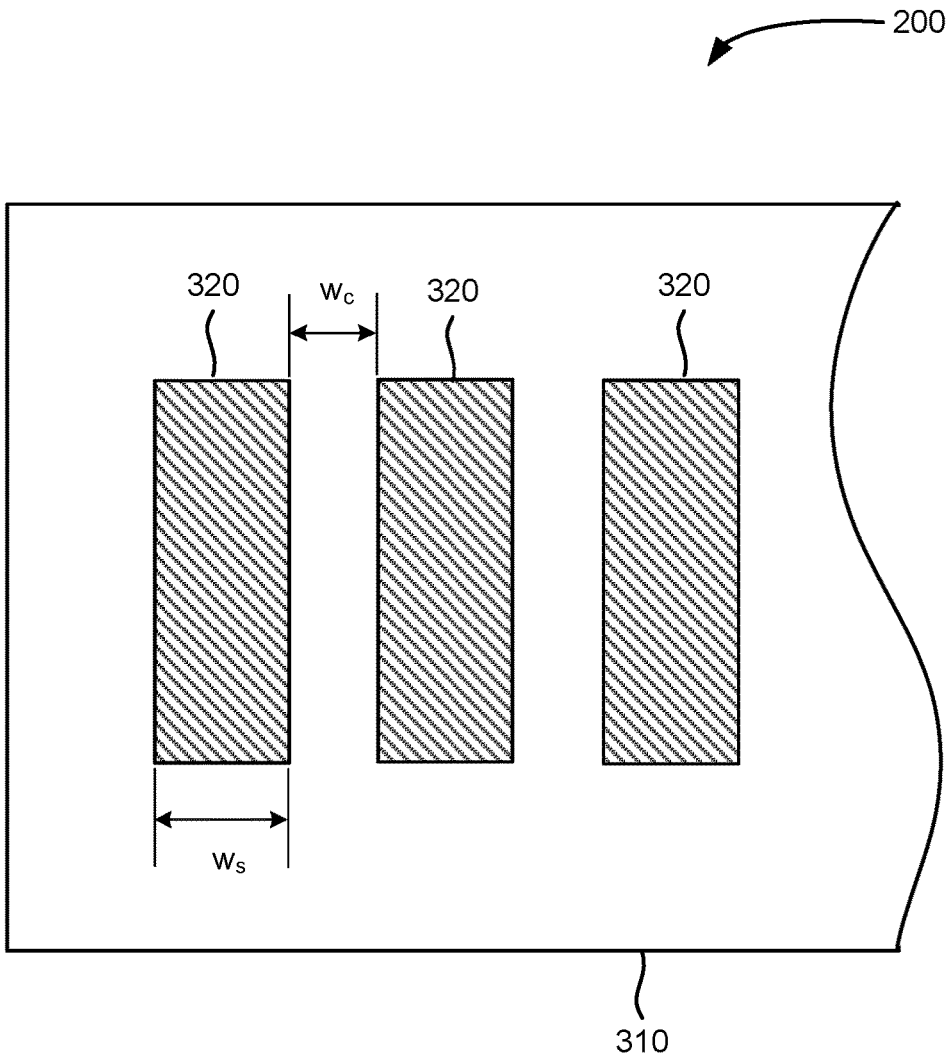
FIG. 31 is a top view of a target having multiple microstructures.

FIG. 31 is a top view of a target having multiple microstructures. Target 200 includes wire microstructures 320 and substrate 310. Spacing between the microstructures 320 may be lower bound to avoid creation of x-rays from an adjacent target when an electron-beam strikes a single target microstructure. Microstructures 320 may be any of a plurality of metals or alloys, such as titanium, aluminum, tungsten, platinum, and gold, and each microstructure can be the same or different materials from other microstructures. Substrate 310 may be any highly thermal conductive material, such as for example diamond or copper. The width of a channel between microstructures $W_c$ can be 15 μm (microns) or more. The width of a wire microstructure $W_s$ can be less than or equal to 250 or 300 μm (microns). The substrate can extend longer than one or more microstructures, as shown in FIG. 31, or may have the same length and be flush with one or more microstructures.

Figure 32:
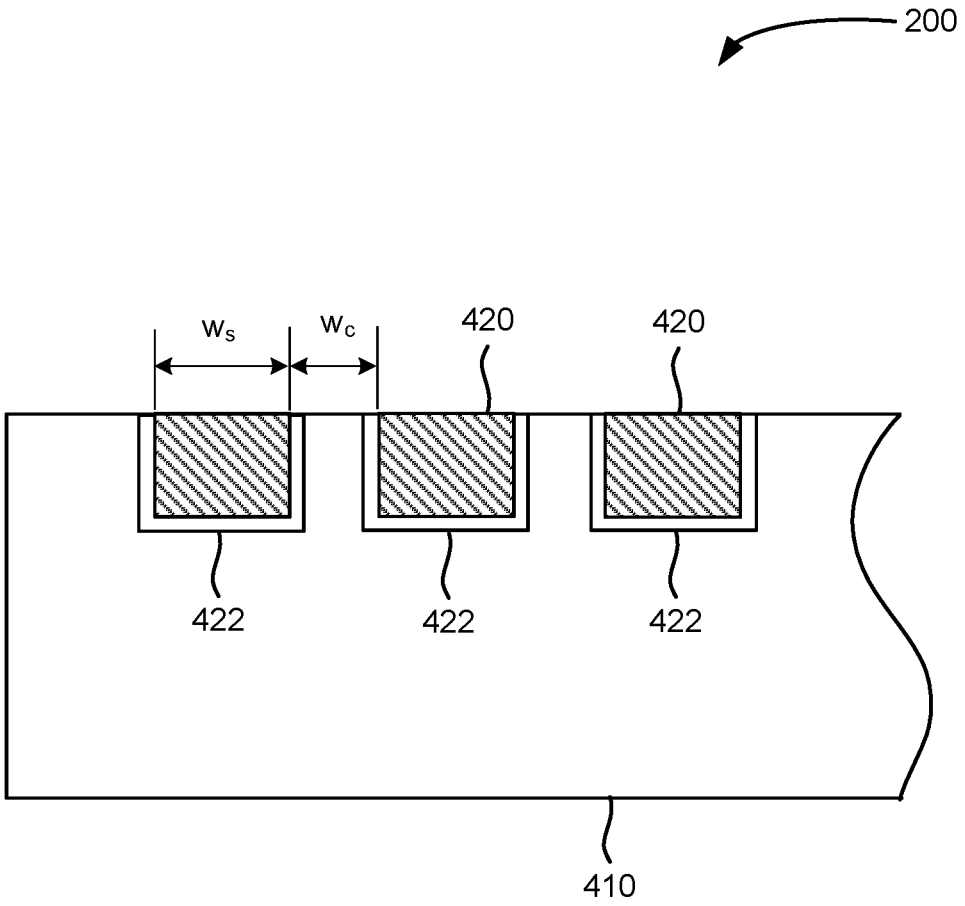
FIG. 32 is a cross-sectional side-view of a target having multiple embedded wire microstructures.

FIG. 32 is a cross-sectional side-view of a target having multiple embedded wire microstructures 420. As shown in FIG. 32, wire microstructures 420 are embedded within the substrate. The substrate 410 can be any material of high thermal conductivity and low mass density, such as diamond. The target, comprised of the substrate and microstructure(s), can be moved relative to the electron beam such that any of the microstructures 420 can be placed in the electron beam path. Each wire 420 can comprise a different material to generate x-rays with different spectra. The embedded wires can have a cross section that is rectangular (as illustrated in FIG. 32), curved, circular, square, or any other shape.

Figure 33:
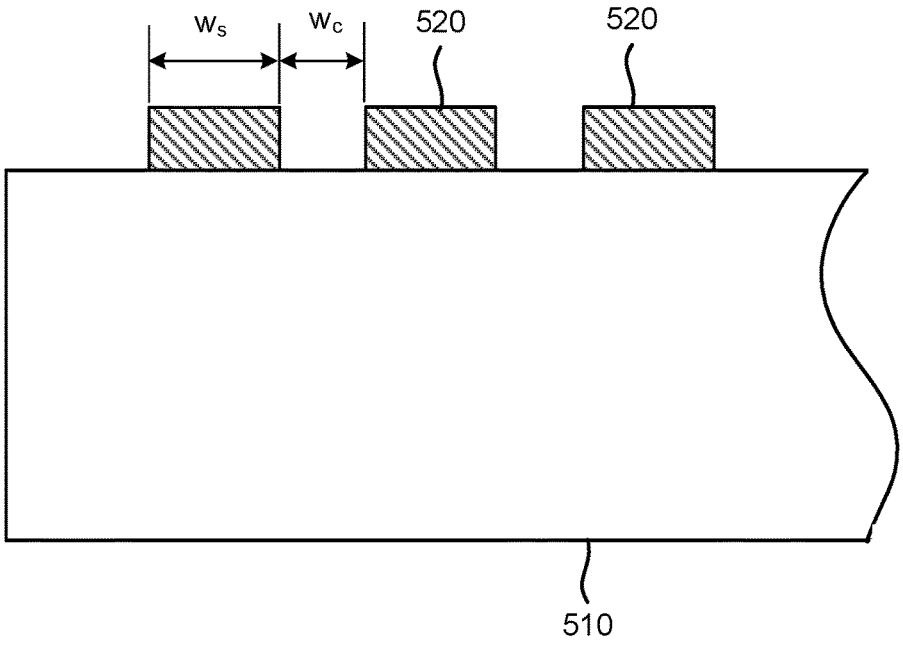
FIG. 33 is a cross-sectional side view of a target having multiple surface mounted wire microstructures.

FIG. 33 is a side view of a target having multiple surface mounted wire microstructures. Similar to the microstructures in FIG. 32, the microstructures in FIG. 33 can each receive an electron-beam and are comprised of a different or the same material. Each wire may be matched with a different optic. In some instances, multiple wires of the same material can be implemented in the present system, to provide a longer use or lifetime of the system.

In some embodiments but not shown in FIGS. 32 and 33, there may be one or more layer(s) 422 between the microstructures and substrate. These may contain a material that prevents diffusion (e.g. Ta) or a material that improves the thermal conductance between the microstructures and substrate (e.g. Cr between Cu and diamond).

Figure 34A:
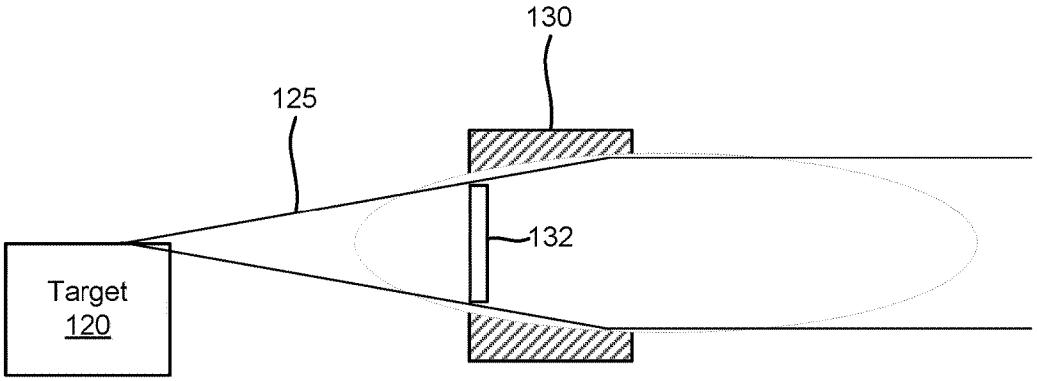
FIG. 34A is a block diagram of an optic that provides a collimated x-ray beam.

FIG. 34A is a block diagram of an optic that provides a collimated x-ray beam. The optics 130 are matched to a microstructure on target 120 such that the angle of incidence of the x-rays 125 on the optics 130 is less than or equal to the critical angle for x-ray energy(ies) of interest. A central stop 132 is used to block x-rays that are not reflected by optics 130.

The critical angle of x-rays depends on the x-ray energy and reflecting surface material. Optics with different coatings, shapes, and focal lengths and/or source-optic entrance distances may be used. In some embodiments, the optic is axially symmetric, with an inner reflecting quadratic surface, such as: ellipsoidal, paraboloidal, hyperboloidal, etc. In some embodiments, the optic has an outer diameter of <10 mm.

Figure 34B:
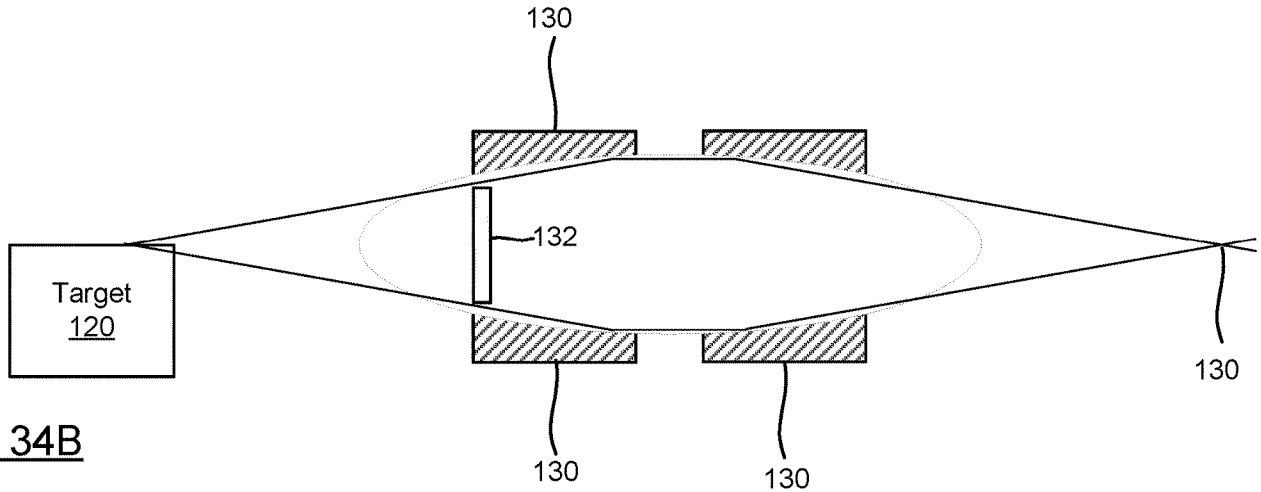
FIG. 34B is a block diagram of an optic similar to the one described by FIG. 34A that provides focused x-rays.

FIG. 34B is a block diagram of an optic similar to the one described by FIG. 34A that provides focused x-rays. In some embodiments, the focal spot produced by the optic is <10 μm FWHM. A central stop 132 is used to block x-rays that are not reflected by optics 130. In some instances, the working distance of at least one of a plurality of optics used in the present system can be defined as the distance between the end of the optics to the optic focal spot is between 5 to 50 millimeters. The distance between the source spot and the optic focal spot can be between 30 mm to 1 meter. One focus of a quadric shape optic can be coincident with an x-ray source spot, while another focus of an optic can be coincident with a sample location.

Figure 35A:
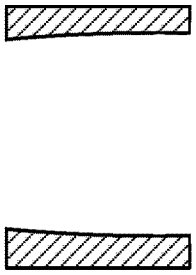
FIGS. 35A-C illustrate example cross-sections of axially symmetric optics with different reflecting interior shapes.
Figure 35B:
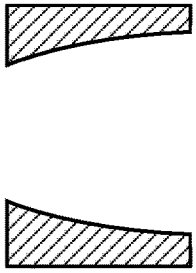
Figure 35C:
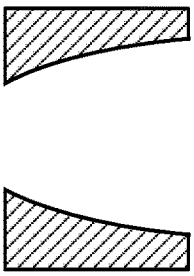

FIGS. 35A-C illustrate example cross-sections of axially symmetric optics with different reflecting interior shapes. The optics of FIGS. 35A-35C are ellipsoidal shaped optics having a different radius of curvature such that FIG. 35A has the largest radius and FIG. 35C has the shortest radius. The optics of FIG. 35B have curvature that is in between those of 35A and 35C. In some cases, only a portion of the ellipsoidal reflecting surface is used because if the location of the reflection is close to a focus point, the angle of incidence may become greater than the critical angle and no reflection occurs. In some instances, each one or more of the plurality of total external reflection mirror optics have an interior reflecting surface that has a quadric profile and is axially symmetric.

FIGS. 36A-B illustrate an optic with an interior surface coating. In some embodiments, the coating can be of materials that have a high atomic number, such as platinum or iridium, to increase the critical angle of total external reflection. In some instances, the coating may be a single layer coating (FIG. 36A). In some instances, multilayer coating comprised of many layers (e.g. several hundred) of two or more alternating materials (FIG. 36B). Layers may be of uniform thickness or may vary in thickness between layers or within a single layer, such as in the cases of depth-graded multilayers or laterally-graded multilayers. The multilayer coating will narrow the bandwidth of the reflected x-ray beam and can serve as a monochromator. The materials used in the multilayer coating may be of any known to those versed the art. In some instances, the optics may include a demagnifying optic to provide better focused x-rays.

Figure 37A:
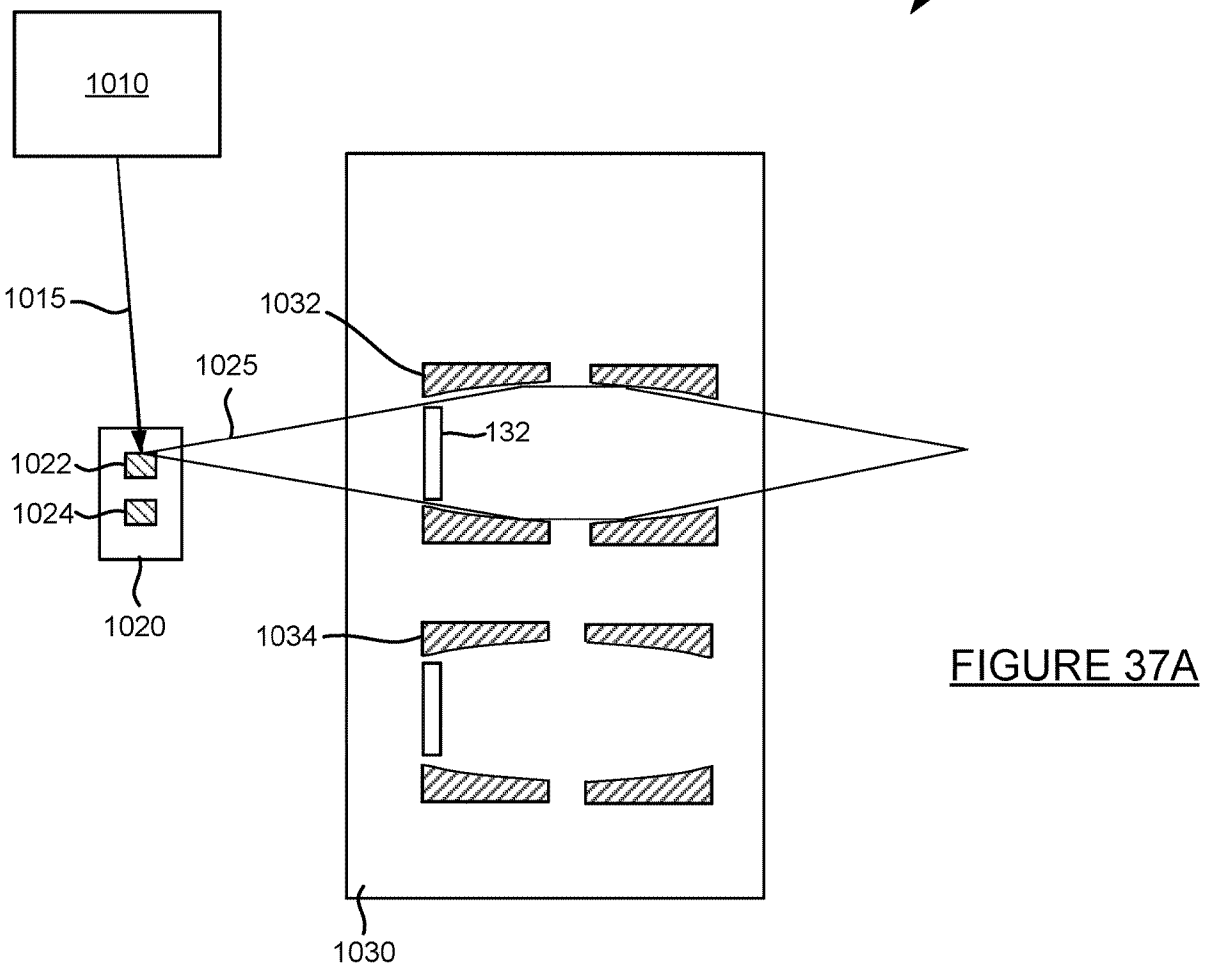
FIG. 37A illustrates an x-ray beam delivery system utilizing a first pair of matched targets and optics.

FIG. 37A illustrates an x-ray beam delivery system utilizing a first pair of matched targets and optics. The system of FIG. 37A includes electron emitter 1010, target 1020 and optics system 1030. Target 1020 may include multiple microstructures 1022 and 1024. In some instances, other components may be included in the x-ray system of FIG. 37A, such as for example one or more mounts and positioning devices.

Figure 37B:
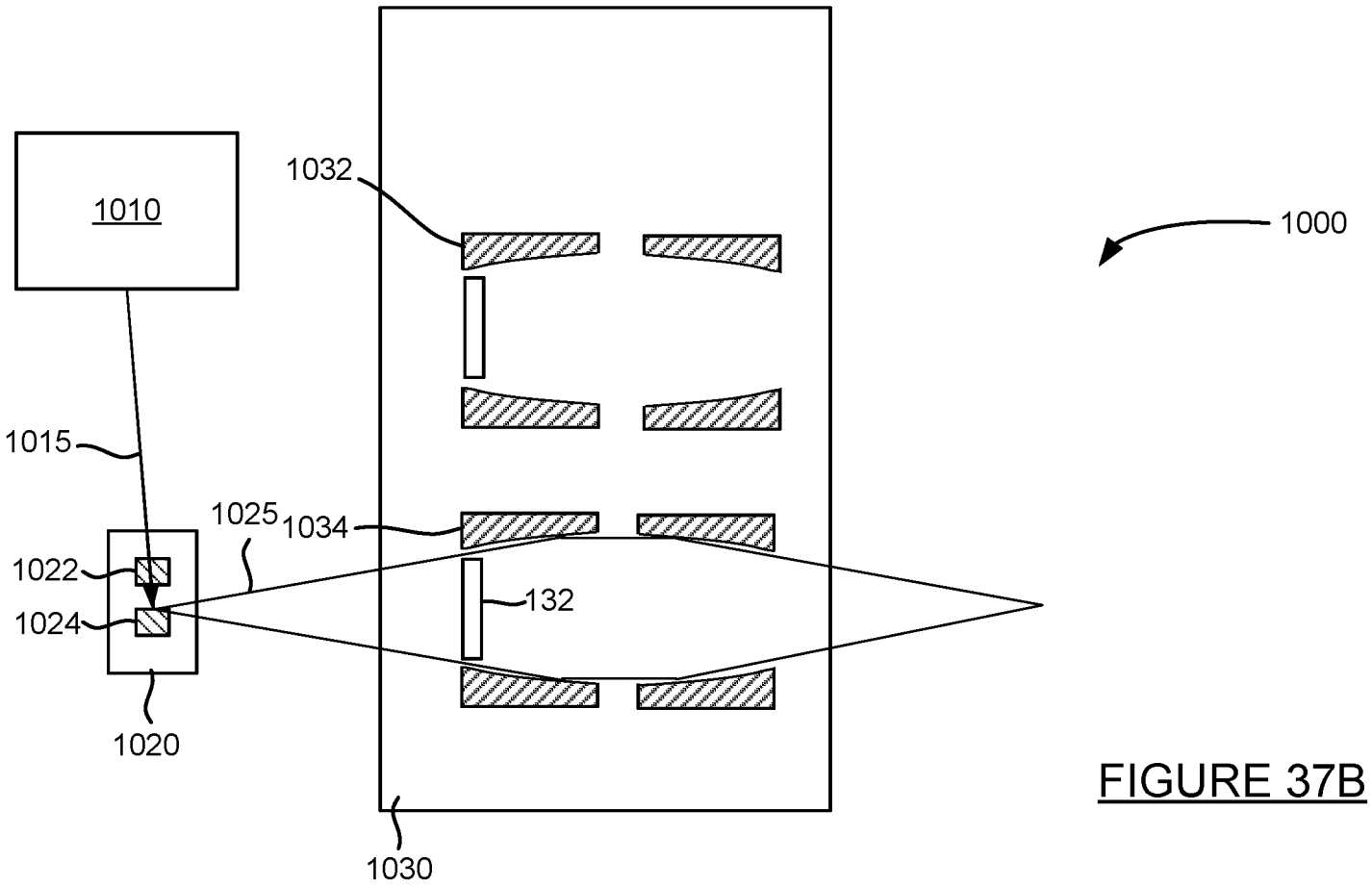
FIG. 37B illustrates the x-ray beam delivery system utilizing a second pair of matched target microstructures and optics.

Optics system 1030 may include multiple focusing optics 1032 and 1034. Each matched optic and target material may be chosen for a particular application such that the x-ray flux is optimized for x-ray spectra optimal for the application. X-rays collected by optics 1032 are focused to a point 1080. In some instances, the plurality of optics includes two quadric surface profiles FIG. 37B illustrates the x-ray beam delivery system utilizing a second pair of matched target microstructures and optics. The system of FIG. 37B includes the same components of as that of FIG. 37A. In operation, electron-beam 1015 bombards target microstructure 1024 rather than 1022. Target microstructure 1024 is matched with optics 1034. X-rays collected by optics 1034 are focused to the same point 1080 as the system of FIG. 37A so that both optics 1032 and 1034 are parfocal. As shown, the parfocal optics focus the x-ray spot onto the same position when each optic is placed in the path of the x-rays.

One or more mechanisms can be sued for moving the optics, the target, and the electron beam to provide different x-ray spectra. The mechanism may ensure the optics are parfocal and that different targets can be bombarded with electron beams to create different x-ray spectra.

The x-ray source (consisting of an electron emitter and a target having microstructures) can be used with a matching optic in several types of systems. Though FIG. 38 describes fluorescence, the x-ray source and optics described herein can be used with other systems as well.

Figure 38:
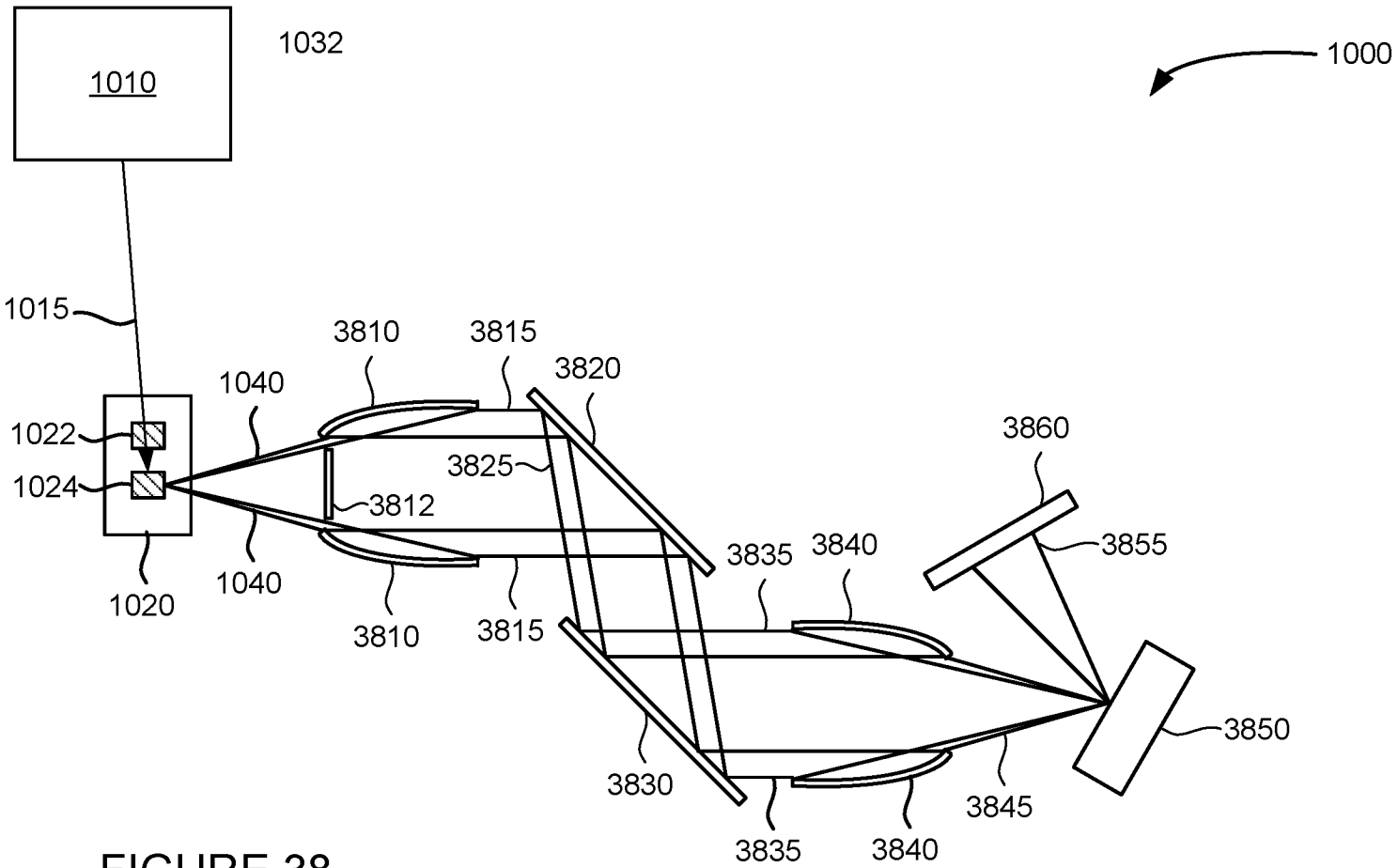
FIG. 38 illustrates an x-ray source and optics within a system using X-ray fluorescence (XRF) to analyze a sample.

FIG. 38 illustrates an x-ray source and optic for use in spectroscopy. The x-ray source and optic includes x-rays 1040 generated by target microstructure 1024. X-rays having an energy of interest are collected by optics 3810, a paraboloid mirror lens. Central stop 3812 blocks x-rays that would otherwise propagate without having been reflected by the quadric surface.

The collected x-rays are reflected by optic 3810, and the reflected x-rays 3815 are incident on a two-bounce monochromator. X-rays 3815 are first diffracted by crystal 3820, and the diffracted x-rays 3825 are directed to and diffracted again by a second crystal 3830. In some instances, other monochromators can be used, such as for example a channel cut, or a four-bounce monochromator. The monochromatized beam 3835 diffracted by the second crystal 3830 is received by a second optic 3840, also a paraboloid mirror lens. Optic 3840 focuses the monochromatized beam 3835 onto sample 3850. Fluorescence x-rays 3855 are then detected by a detector, such as a high efficiency SDD detector.

Figure 39:
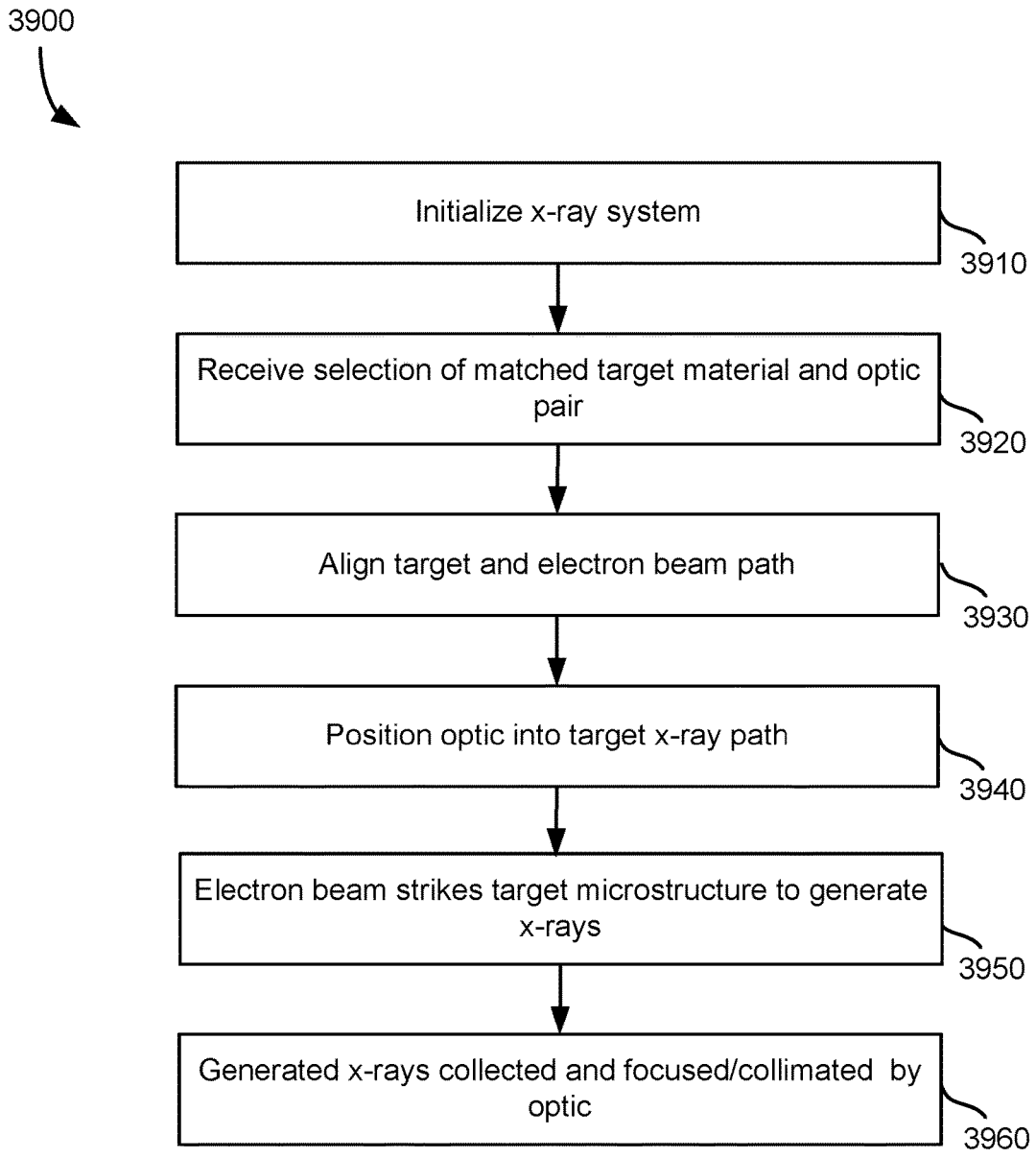
FIG. 39 illustrates a method for providing a matched target and optic from a plurality of pairs of matched targets and optics.

FIG. 39 illustrates a method for providing a matched target and optic from a plurality of pairs of matched targets and optics. First, an x-ray system is initialized at step 3910. Initializing may include powering on the system, performing calibration, and other preliminary functions that enable the x-ray system to operate. A selection of a matched target material and optic pair is received at step 3920. In some instances, each of multiple target materials may be matched to a particular optic.

Once a selection is received, a target region and electron beam are aligned at step 3930. The motion is relative and may involve one or several of the components moving. The optic is positioned into the emitted x-ray path at step 3940 to collect x-rays at a low take-off angle. The optic may be positioned such that it collects the maximum flux of the x-ray energy(ies) of interest. In some instances, this is one of the characteristic x-ray lines of the selected target material. The optic may then provide a collimated or focused beam.

An electron beam is produced and strikes the selected target microstructure at step 3950 and generates x-rays. The generated x-rays are collected and focused or collimated by the matching optic at step 3960.

With this application, several embodiments of the invention, including the best mode contemplated by the inventors, have been disclosed. It will be recognized that, while specific embodiments may be presented, elements discussed in detail only for some embodiments may also be applied to others. Also, details and various elements described as prior art may also be applied to various embodiments of the invention.

While specific materials, designs, configurations and fabrication steps have been set forth to describe this invention and the preferred embodiments, such descriptions are not intended to be limiting. Modifications and changes may be apparent to those skilled in the art, and it is intended that this invention be limited only by the scope of the appended claims.

What is claimed is:

1. An x-ray illumination beam system comprising:

a vacuum chamber including an electron emitter;

a window transparent to x-rays and attached to a wall of the vacuum chamber;

an electron optical system that focusses an electron beam from the electron emitter;

a target comprising a plurality of microstructures coupled to a substrate, wherein each microstructure includes a material configured to generate x-rays in response to bombardment by the electron beam, and in which a lateral dimension of said material is less than 250 microns;

a support configured to position the target relative to the electron beam; and a plurality of total external reflection mirror optics, wherein each optic of the plurality of optics is matched to x-ray spectra produced by at least one microstructure of the plurality of microstructures and positioned to collect x-rays generated by the at least one microstructure of the plurality of microstructures when bombarded by the electron beam.

2. The x-ray illumination beam system of claim 1, wherein one or more optics of the plurality of total external reflection mirror optics have an interior reflecting surface that has a quadric profile and is axially symmetric.

3. The x-ray illumination beam system of claim 2, wherein a focus of the quadric profile is coincident with an x-ray source spot.

4. The x-ray illumination beam system of claim 1, wherein each optic of the plurality of total external reflection mirror optics is matched to a characteristic x-ray energy of the material.

5. The x-ray illumination beam system of claim 4, wherein a reflecting surface of the optic is shaped such that x-rays with the characteristic x-ray energy incident upon a portion of the reflecting surface have incidence angles that are between 30% and 100% of the critical angle of the portion of the reflecting surface.

6. The x-ray illumination beam system of claim 4, wherein the characteristic x-ray energy is a K-line of the material.

7. The x-ray illumination beam system of claim 1, wherein the plurality of total external reflection mirror optics are parfocal.

8. The x-ray illumination beam system of claim 1, wherein a spot size of the electron beam on the target has a length and a width, the ratio of the width to the length being between 2 and 20.

9. The x-ray illumination beam system of claim 1, wherein the electron beam has a width that corresponds to a width of a microstructure bombarded by the electron beam.

10. The x-ray illumination beam system of claim 1, wherein a distance from an end of at least one optic of the plurality of optics to an optic focal spot is between 5 millimeters to 50 millimeters.

11. The x-ray illumination beam system of claim 1, wherein a distance between a source spot of the x-rays and an optic focal spot is between 30 millimeters and 1 meter.

12. The x-ray illumination beam system of claim 1, wherein the plurality of optics includes two quadric surface profiles.

13. The x-ray illumination beam system of claim 1, wherein an emitted x-ray beam has a take-off angle of less than 6 degrees with respect to a target surface tangent.

14. The x-ray illumination beam system of claim 1, wherein one or more of the optics includes a surface coating on an inner surface of the optic.

15. The x-ray illumination beam system of claim 14, in which the surface coating is a multilayer coating.

16. The x-ray illumination beam system of claim 1, wherein the target is moveable to allow each microstructure of the plurality of microstructures to be bombarded by the electron beam.

17. The x-ray illumination beam system of claim 1, wherein the electron beam is movable to allow each microstructure of the plurality of microstructures to be bombarded by the electron beam.

18. The x-ray illumination beam system of claim 1, wherein at least two microstructures of the plurality of microstructures generate different x-ray spectra when bombarded by the electron beam.

19. The x-ray illumination beam system of claim 1, wherein the electron beam is rastered over one or more of the microstructures.

20. The x-ray illumination beam system of claim 1, wherein the microstructures are embedded within the substrate.

* * * * *